US010154549B2

(12) United States Patent
Nasu et al.

(10) Patent No.: US 10,154,549 B2
(45) Date of Patent: Dec. 11, 2018

(54) HEATING COOKER

(71) Applicant: Sharp Kabushiki Kaisha, Sakai, Osaka (JP)

(72) Inventors: Tadashi Nasu, Sakai (JP); Akihiro Yoshidome, Sakai (JP); Masayuki Iwamoto, Sakai (JP); Junichi Takeuchi, Sakai (JP); Hiroshi Hirano, Sakai (JP)

(73) Assignee: Sharp Kabushiki Kaisha, Sakai (JP)

( * ) Notice: Subject to any disclaimer, the term of this patent is extended or adjusted under 35 U.S.C. 154(b) by 25 days.

(21) Appl. No.: 15/121,853

(22) PCT Filed: Aug. 21, 2015

(86) PCT No.: PCT/JP2015/073626
§ 371 (c)(1),
(2) Date: Aug. 26, 2016

(87) PCT Pub. No.: WO2016/031737
PCT Pub. Date: Mar. 3, 2016

(65) Prior Publication Data

US 2017/0171921 A1 Jun. 15, 2017

(30) Foreign Application Priority Data

Aug. 29, 2014 (JP) ..... 2014-175378
Sep. 1, 2014 (JP) ..... 2014-177261
(Continued)

(51) Int. Cl.
*H05B 6/64* (2006.01)
*F24C 15/16* (2006.01)
*F24C 15/32* (2006.01)

(52) U.S. Cl.
CPC ..... *H05B 6/6473* (2013.01); *F24C 15/162* (2013.01); *F24C 15/325* (2013.01); *H05B 6/6414* (2013.01)

(58) Field of Classification Search
CPC .... H05B 6/6411; H05B 6/6414; H05B 6/642; H05B 6/6429; H05B 6/6473; H05B 6/80;
(Continued)

(56) References Cited

U.S. PATENT DOCUMENTS

2005/0173399 A1 8/2005 Yoshidome et al.
2005/0173426 A1 8/2005 Iwamoto
(Continued)

FOREIGN PATENT DOCUMENTS

JP 48-4617 Y 2/1973
JP 03-45820 A 2/1991
(Continued)

OTHER PUBLICATIONS

Official Communication issued in International Patent Application No. PCT/JP2015/073626, dated Oct. 27, 2015.

*Primary Examiner* — Hung D Nguyen
(74) *Attorney, Agent, or Firm* — Keating & Bennett, LLP

(57) ABSTRACT

A microwave oven includes: a cooker body in the shape of a box having a heating chamber with an opening at the front side thereof; a storage having a door which opens and closes the opening, and an inner box including two side plates, a bottom plate and a back plate connected to the door, the storage being movable to the front side and storing an object to be cooked; and a hot-air generating unit generating hot air. The hot-air generating unit is located at the outer side of a rear wall of a heating chamber, and an air outlet from which hot air is blown out is located on the rear wall at a position higher than the back plate.

3 Claims, 48 Drawing Sheets

(30) Foreign Application Priority Data

Sep. 5, 2014 (JP) ..... 2014-181397
Sep. 8, 2014 (JP) ..... 2014-182319
Sep. 11, 2014 (JP) ..... 2014-185496

(58) Field of Classification Search
CPC .. F24C 15/006; F24C 15/162; F24C 15/2007; F24C 15/325; F24C 15/327
USPC ..... 219/399, 400, 401, 402, 403, 449.1, 219/452.11, 678, 679, 680, 681, 682, 752, 219/753, 754, 756, 757, 762, 763; 126/21 R, 21 A, 339, 340
See application file for complete search history.

(56) References Cited

U.S. PATENT DOCUMENTS

| | | | | |
|---|---|---|---|---|
| 2006/0016350 | A1 | 1/2006 | Yoshidome | |
| 2006/0163239 | A1 | 7/2006 | Yoshidome et al. | |
| 2008/0307977 | A1 | 12/2008 | Yoshidome | |
| 2010/0064902 | A1 | 3/2010 | Sakane et al. | |
| 2010/0133263 | A1 | 6/2010 | Toyoda et al. | |
| 2012/0118169 | A1* | 5/2012 | Hirano | F24C 15/006 99/325 |

FOREIGN PATENT DOCUMENTS

| | | | | |
|---|---|---|---|---|
| JP | 03-144218 | A | | 6/1991 |
| JP | 06-109257 | A | | 4/1994 |
| JP | 07-160985 | A | | 6/1995 |
| JP | 2656316 | B2 | | 9/1997 |
| JP | 11-237053 | A | | 8/1999 |
| JP | 2005-172301 | A | | 6/2005 |
| JP | 2005-201501 | A | | 7/2005 |
| JP | 2005-221081 | A | | 8/2005 |
| JP | 2006-038296 | A | | 2/2006 |
| JP | 2007-333309 | A | | 12/2007 |
| JP | 4027325 | B2 | | 12/2007 |
| JP | 2008-025889 | A | | 2/2008 |
| JP | 2008-116094 | A | | 5/2008 |
| JP | 2009-58136 | A | * | 3/2009 |
| JP | 2009-058136 | A | | 3/2009 |
| JP | 4296190 | B2 | | 7/2009 |
| JP | 2009-293339 | A | | 12/2009 |
| JP | 4404918 | B2 | | 1/2010 |
| JP | 2010-133634 | A | | 6/2010 |
| JP | 4528640 | B2 | | 8/2010 |
| JP | 2011-043277 | A | | 3/2011 |
| JP | 2011-158184 | A | | 8/2011 |
| JP | 2011-247485 | A | | 12/2011 |

* cited by examiner

12

2001

2001

2001

2001

HEATING COOKER

CROSS-REFERENCE TO RELATED APPLICATIONS

This application is the national phase under 35 U.S.C. § 371 of PCT International Application No. PCT/JP2015/073626 which has an International filing date of Aug. 21, 2015 and designated the United States of America.

FIELD

The present invention relates to a heating cooker including a cooker body in a box-like shape having an opening at the front side thereof, a storage which stores an object to be cooked, the storage having a door which opens and closes the opening as well as an inner box and being movable to the front side, and the heating cooker further including a hot-air generating unit which generates hot air.

BACKGROUND

A known heating cooker is so configured that a storage with an inner box which stores an object to be cooked and which is integrated with a door for opening/closing slides from a cooker body to put in and take out the object to be cooked to/from the heating chamber.

Japanese Patent Application Laid-Open Publication No. 2010-133634 discloses the invention of a heating cooker including, as a function of heating an object to be cooked in a heating chamber, a microwave heating function of irradiating the object to be cooked with microwave, and a high-speed hot-air heating function including an air-blowing fan, an upper duct and a side duct, the heating cooker being capable of complex heat cooking.

In this heating cooker, a rotating table is located at the bottom face of the heating chamber and a waveguide is arranged in a space at the side part of the heating chamber, which allows the upper duct to be arranged in a ceiling structure, and thus the function of high-speed hot-air heat cooking is incorporated into the cooker body.

SUMMARY

In the heating cooker according to Japanese Patent Application Laid-Open Publication No. 2010-133634 described above, hot air is blown out downward from an outlet port provided at the upper duct, and hot air is blown out toward the right side from another outlet port of the side duct provided at a middle part of the left side surface of the heating chamber. The hot air blown out from the both outlet ports merge into each other and reaches an inlet port of the air-blowing fan through the air-intake opening formed at the lower right corner on the back surface of the heating chamber, to form circulating air flow.

The heating cooker according to Japanese Patent Application Laid-Open Publication No. 2010-133634 is so configured, as described above, that hot air flows from the outlet port at the left side of the heating chamber toward the air-intake opening at the lower right corner of the back surface. Thus, hot air hardly reaches the front lower right part and the back lower left part of the object to be cooked, possibly causing unevenness in heating. It is therefore necessary to rotate the object to be cooked with the use of a rotating table in order to prevent the occurrence of unevenness in heating.

The present disclosure has been made in view of the circumstances described above, and aims to provide a heating cooker with a simple structure capable of rectifying the flow of hot air, uniformly heating an object to be cooked, and having a preferable heat cooking efficiency.

The heating cooker according to an embodiment of the present disclosure including: a cooker body in a shape of a box having the heating chamber provided with an opening at the front side; a storage having a door which opens and closes the opening, and an inner box including two side plates connected to the door, a bottom plate and a back plate, movable to the front side and storing an object to be cooked; and a hot-air generating unit generating hot air, the hot-air generating unit is located outside the rear wall of the heating chamber and is provided with an outlet port for blowing out the hot air at a position on the rear wall which is higher than the back plate of the storage.

The heating cooker according to an embodiment of the present disclosure comprises an introducing plate which bridges the upper end of the back plate and the lower portion of the outlet port to introduce the hot air into the storage.

The heating cooker according to an embodiment of the present disclosure including: a cooker body in a shape of a box having a heating chamber provided with an opening at the front side; a storage having a door which opens and closes the opening, and the inner box including two side plates connected to the door, bottom plates and a back plate, movable to the front side and storing an object to be cooked; and a hot-air generating unit generating hot air, the hot-air generating unit is located outside the heating chamber and is provided with an outlet port blowing out the hot air on a wall surface of the heating chamber, and a guide part guiding the hot air to the outside of the side plate of the storage at a position corresponding to the outlet part.

The heating cooker according to an aspect of the present disclosure is configured to have the outlet port for blowing out the hot air at the door side of the side plate of the storage or at the bottom plate of the storage.

The heating cooker according to an aspect of the present disclosure, the hot-air generating unit is provided outside the upper wall of the heating chamber and the outlet port is provided at the upper wall.

According to the present disclosure, as an outlet port from which hot air is blown out is provided at a position higher than the back plate of the storage at the rear wall of the heating chamber, hot air generated by the hot-air generating unit is blown out from the outlet port, is introduced into the storage from the upper side of the edge of the back plate of the storage, is blown onto an object to be cooked from back to front, and reaches the intake port of the air-blowing fan.

Accordingly, hot air may be rectified with a simple structure, which can uniformly heat an object to be cooked with a preferable heat cooking efficiency.

The speed and direction of rotation of the air-blowing fan may be changed depending on the material, shape, weight, type of cooking and the like for an object to be cooked, to change the volume and position of the hot air directed to the object to be cooked so as to adjust the cooking time, the degree of heating and the like.

The above and further objects and features will more fully be apparent from the following detailed description with accompanying drawings.

DETAILED DESCRIPTION

Embodiments 1 to 5

The present invention will be described below in detail with reference to the drawings illustrating the embodiments thereof.

Embodiment 1

Figure 1:
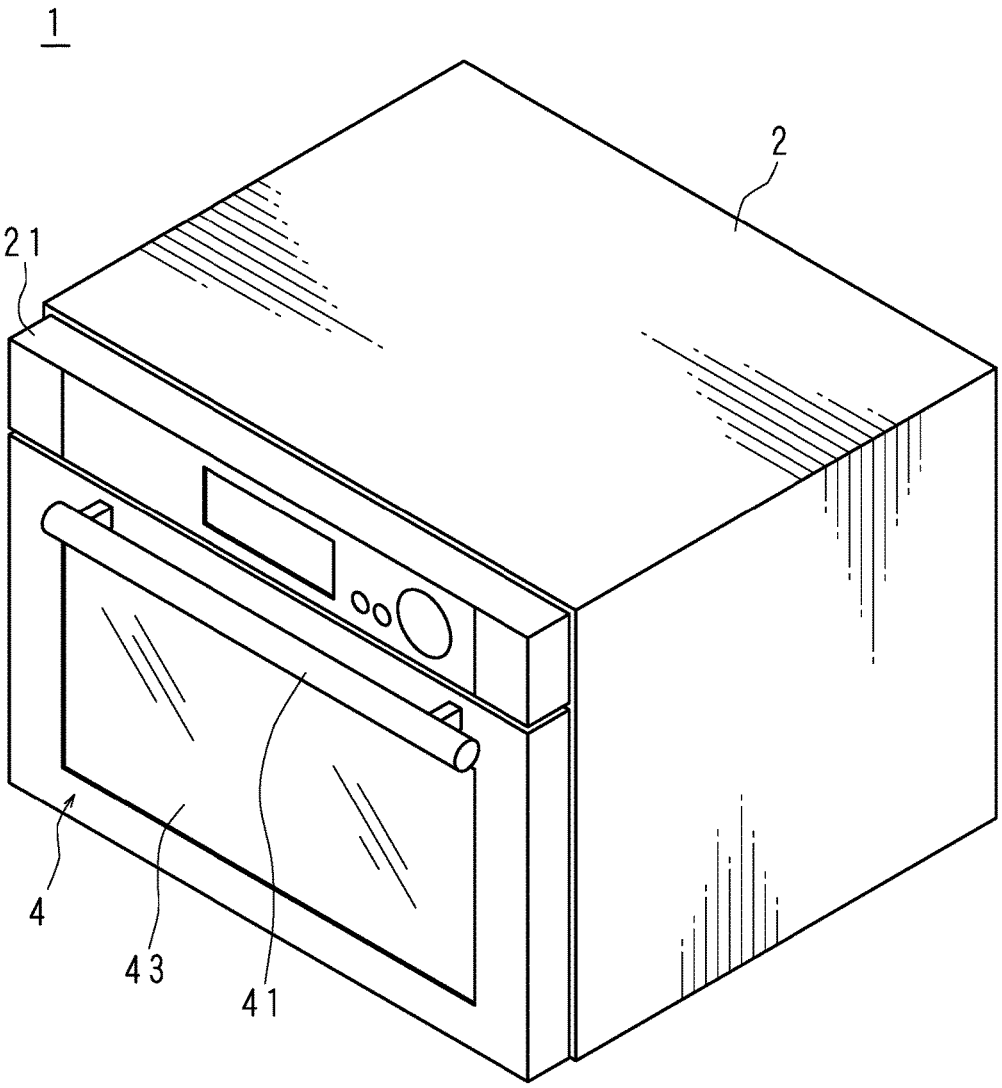
FIG. 1 is a perspective view of a microwave oven as a heating cooker according to Embodiment 1 of the present invention.
Figure 2:
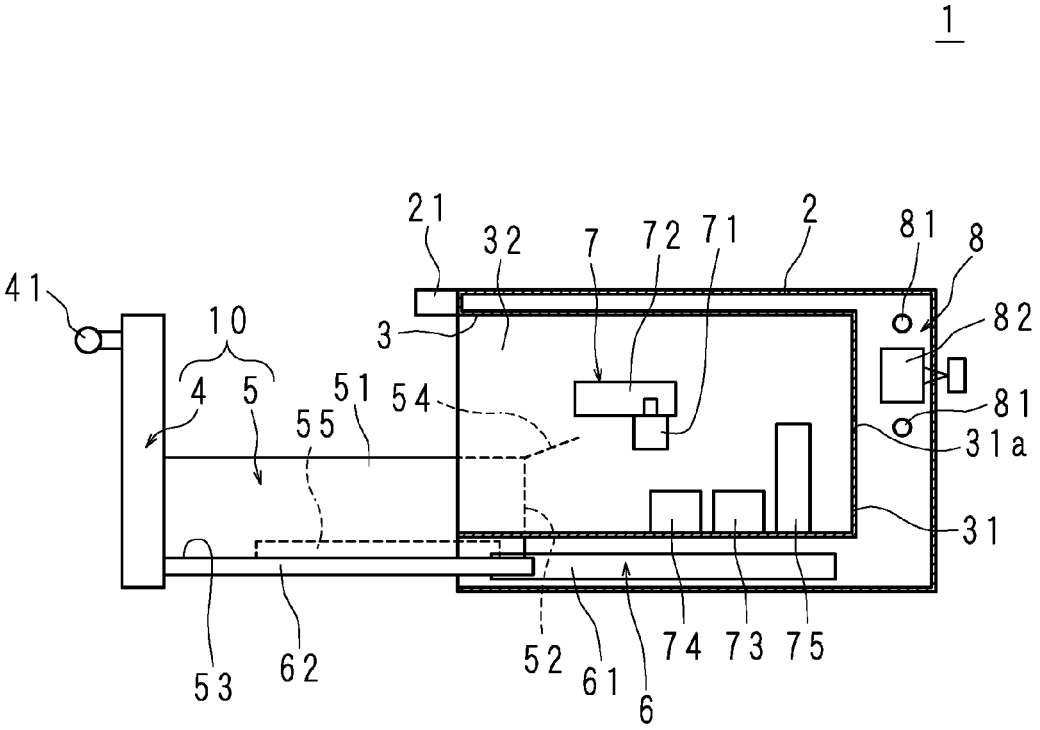
FIG. 2 is a schematic side section view illustrating a state where a storage is pulled out from the microwave oven according to Embodiment 1 of the present invention.
Figure 3:
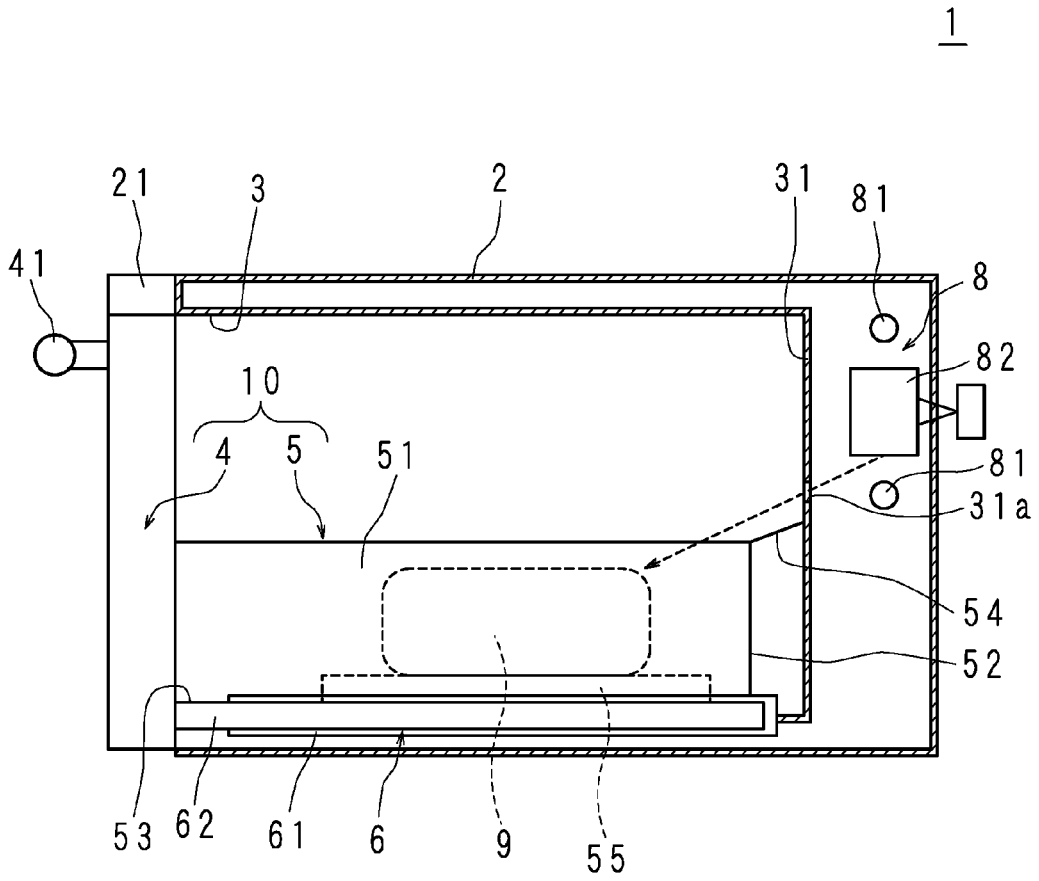
FIG. 3 is a schematic side section view illustrating a state where an inner box is stored in the microwave oven according to Embodiment 1 of the present invention.

FIG. 1 is a perspective view of a microwave oven 1 as a heating cooker according to Embodiment 1 of the present invention. FIG. 2 is a schematic side section view illustrating the state where a storage 10 of the microwave oven 1 is pulled out. FIG. 3 is a schematic side section view illustrating the state where an inner box 5 is stored in the microwave oven 1. In FIG. 3, a microwave irradiation unit 7 as well as a side wall 32 on the right side of the heating chamber 3 are not illustrated.

The microwave oven 1 includes a cooker body 2, a storage 10 having a door 4 and an inner box 5, a microwave irradiation unit 7, and a hot-air generating unit 8.

The cooker body 2 is in the shape of a box with an opening on the front side thereof. A panel unit 21 is provided at the upper edge of the opening. The panel unit 21 has an operation unit having various types of keys for the user to operate the microwave oven 1, and a display unit on which various types of information for the user to be notified thereof. Inside the cooker body 2, a heating chamber 3 is located which accommodates and heats an object to be cooked 9 such as a block of meat, for example.

The door 4 of the storage 10 has the shape of a rectangular plate and is configured to open and close the opening of the cooker body 2.

The door 4 includes a handle 41 and a window 43. The handle 41 is located at an upper part of the body of the door 4, and has a bar-like grip extending in the lateral direction. The window 43 is located at a middle part of the door 4, and is configured to allow the user to look into the heating chamber 3.

The inner box 5 includes two side plates 51, 51, a back plate 52 and a bottom plate 53. At the upper edge of the back plate 52, an introducing plate 54 is provided which is so inclined as to be higher toward the back. A placement table 55 on which the object to be cooked 9 is placed is arranged on the bottom plate 53. The placement table 55 is, for example, made of metal and formed by a net-like rectangular plate with legs at four corners thereof.

The slide unit 6 includes two pairs of fixed rails 61 and movable rails 62. The two pairs of fixed rails 61 and movable rails 62 are located at lower parts between the side walls of the heating chamber 3 and the side plates of the cooker body 2. The movable rails 62, 62 have the shape of plates and are attached to the lower parts at both sides on the back face of the door 4. The fixed rails 61, 61 also have the shape of plates and are attached to the cooker body 2 sides. The movable rails 62 are fitted into the fixed rails 61 and are supported by the fixed rails 61 while being slidable in the front-back direction.

At the middle part of the lower surface of the bottom plate 53 of the inner box 5, a rack gear (not illustrated) is located with its longitudinal direction aligned in the front-back direction, while a pinion gear (not illustrated) is pivotally supported by the cooker body 2, thereby forming a rack and pinion structure. The pinion gear is connected with a motor (not illustrated), and the storage 10 automatically moves back and forth as the user operates the operation unit. The storage 10 may be moved back and forth also manually.

In the case where the user gives an instruction through the operation unit to pull out the inner box 5, or grips and pulls the handle 41 of the door 4 toward the user, the movable rails 62 slide in the fixed rails 61 to the front side, the rack gear moves to the front side, and thus the storage 10 is pulled out. In the case where the user gives an instruction through the operation unit to store the inner box 5, or pushes the handle 41 away from the user, the movable rails 62 slide in the fixed rails 61 to the back side, the rack gear moves to the back side, the inner box 5 is accommodated into the heating chamber 3, and the door 4 closes the opening of the cooker body 2.

A microwave irradiation unit 7 is built in between the right side wall of the heating chamber 3 and the right side plate of the cooker body 2 in FIG. 1.

The microwave irradiation unit 7 includes a magnetron 71, a waveguide 72, a high-pressure transformer 73, a high-pressure capacitor 74 and a cooling fan 75.

Electric power is supplied to the magnetron 71 from a power source unit including the high-pressure transformer 73 and the high-pressure capacitor 74, and the magnetron 71 generates microwave. The generated microwave is propagated through the waveguide 72, and is directed from the right side wall of the heating chamber 3 into the heating chamber 3. The cooling fan 75 blows air to the power source unit to cool the power source unit.

A hot-air generating unit 8 for heating with hot air by, for example, convection heating is built in between a rear wall 31 of the heating chamber 3 and the back plate of the cooker body 2.

The hot-air generating unit 8 includes multiple heaters 81 and an air-blowing fan 82 such as a centrifugal air-blowing fan, for example.

At the rear wall 31 of the heating chamber 3, multiple outlet ports 31*a* are so provided as to be in positions higher than the upper edge of the introducing plate 54 and corresponding to both sides in the width direction (left-right direction in FIG. 1) of the air-blowing fan 82 when the inner box 5 is accommodated in the heating chamber 3.

In the microwave oven 1 configured as described above, the storage 10 is brought in by the operation of the user to arrange on the bottom plate 53 the placement table 55 having the object to be cooked 9 thereon, and thereafter the door 4 is closed to move the storage 10 rearward and accommodates the inner box 5 in the heating chamber 3. A heater 81 is energized to rotate the air-blowing fan 82 at a predetermined rotation speed.

The hot air generated thereby is blown out from the outlet port 31*a*, is guided diagonally downward by the introducing plate 54, is introduced into the inner box 5 and is blown onto the object to be cooked 9 from the rear to the front along the front-back direction, and thereafter reaches the inlet port of the air-blowing fan 82 through the air-intake opening (not illustrated) which penetrates the front side portion of the bottom wall of the heating chamber 3 and the bottom plate 53.

According to the present embodiment, with a simple structure, the hot air blown out from the outlet port 31*a* is rectified and can thus be uniformly and efficiently in contact with the object to be cooked 9, achieving preferable heat cooking efficiency.

The speed and direction of rotation of the air-blowing fan 82 may be changed depending on the material, shape, weight, type of cooking and the like of the object to be cooked 9, to change the volume and position of the hot air directed to the object to be cooked 9 so as to adjust the cooking time, the degree of heating and the like.

Moreover, in the case where the introducing plate 54 is so configured as to have a variable inclined angle, the amount and position of the hot air directed to the object to be cooked 9 may be changed by changing the inclined angle.

It is noted that the microwave irradiation unit 7 is not limited to that built in between the right side wall of the heating chamber 3 and the right side plate of the cooker body 2, but may also be built in between the upper plate of the heating chamber 3 and the upper plate of the cooker body 2.

Embodiment 2

The microwave oven 11 according to Embodiment 2 of the present invention has a configuration similar to that of the microwave oven 1 according to Embodiment 1, except for a different configuration of the inner box 5.

Figure 4:
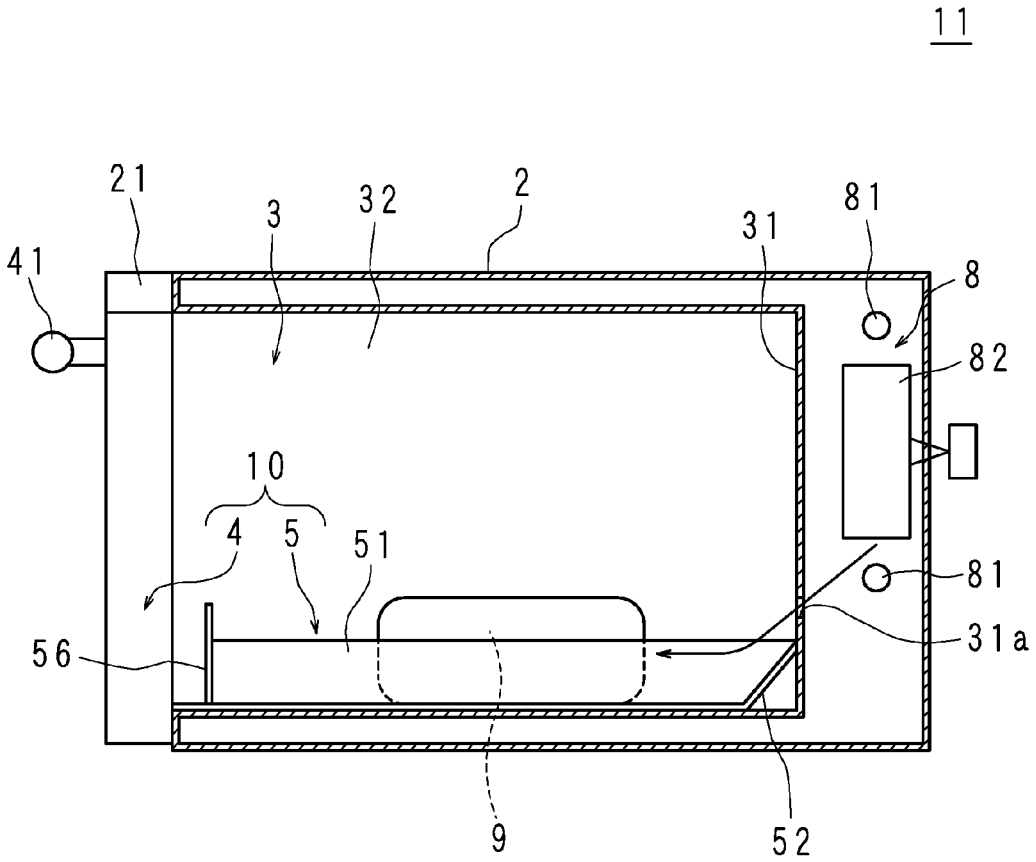
FIG. 4 is a schematic side section view illustrating a microwave oven according to Embodiment 2 of the present invention.

FIG. 4 is a schematic side section view illustrating the microwave oven 11 according to Embodiment 2 of the present invention. In FIG. 4, the same portions as those in FIGS. 2 and 3 are denoted by the same reference codes and will not be described in detail.

The back plate 52 of the inner box 5 of the microwave oven 11 according to the present embodiment is so inclined that the upper edge thereof is inclined toward the rear wall 31 of the heating chamber 3. Moreover, the inner box 5 includes a front plate 56 at the front side.

In the microwave oven configured as described above, the heater 81 is energized, so that the hot air generated by rotating the air-blowing fan 82 at a predetermined rotation speed is guided diagonally downward by the back plate 52, is introduced into the inner box 5 and is blown onto the object to be cooked 9 along the front-back direction. The hot air makes contact with the front plate 56 and changes its direction, and reaches the inlet port of the air-blowing fan 82 through the air-intake opening provided at the front side portion of the bottom wall of the heating chamber 3 and the bottom plate 53.

According to the present embodiment, with the structure as described above, the hot-air blown out from the outlet port 31*a* is rectified and can thus make uniformly and efficiently in contact with the object to be cooked 9, achieving preferable heat cooking efficiency.

Embodiment 3

The microwave oven 12 according to Embodiment 3 of the present invention has a configuration similar to that of the microwave oven 1 according to Embodiment 1, except for the different configuration of the inner box 5.

Figure 5:
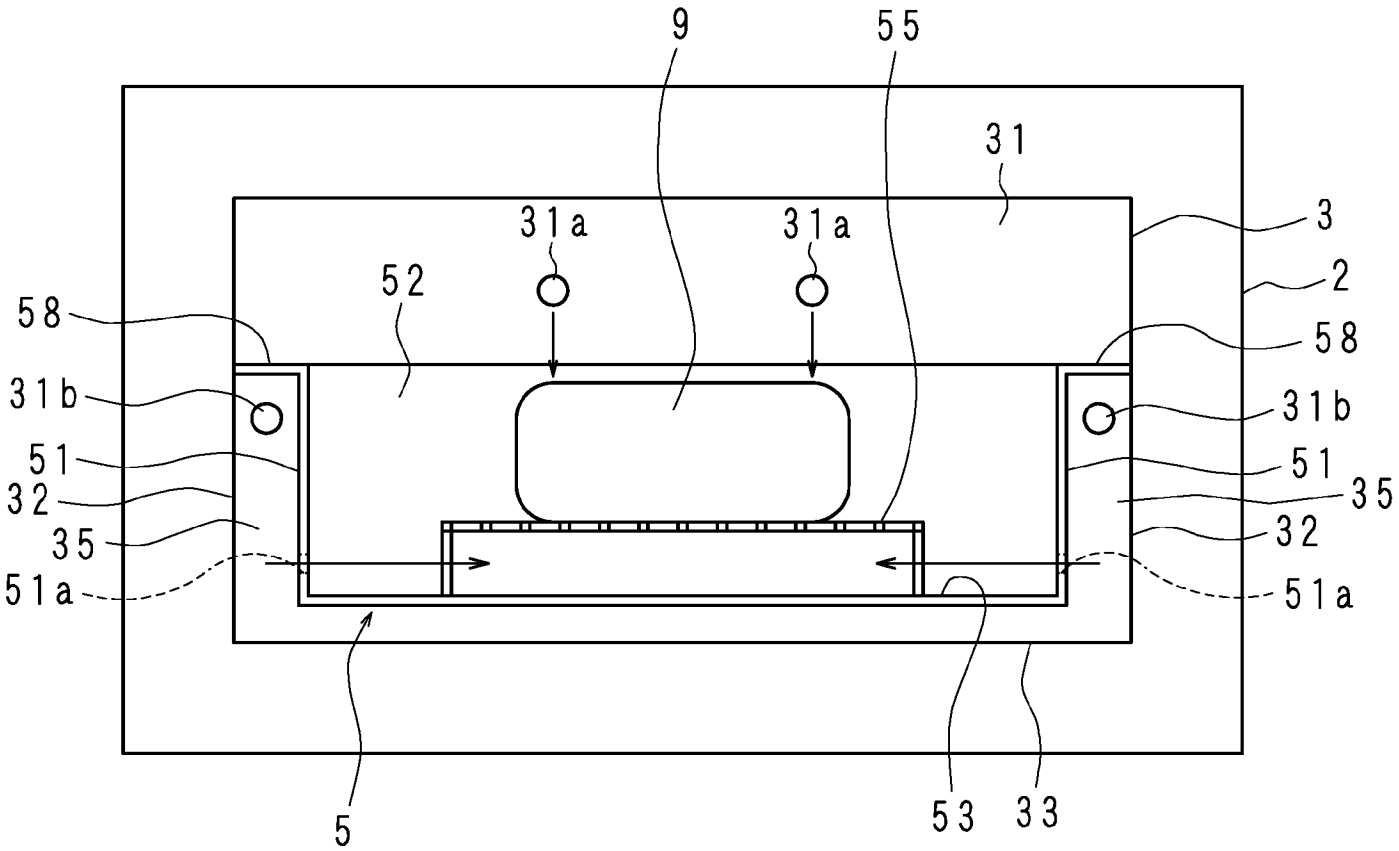
FIG. 5 is a schematic front view illustrating a microwave oven according to Embodiment 3 of the present invention.
Figure 6:
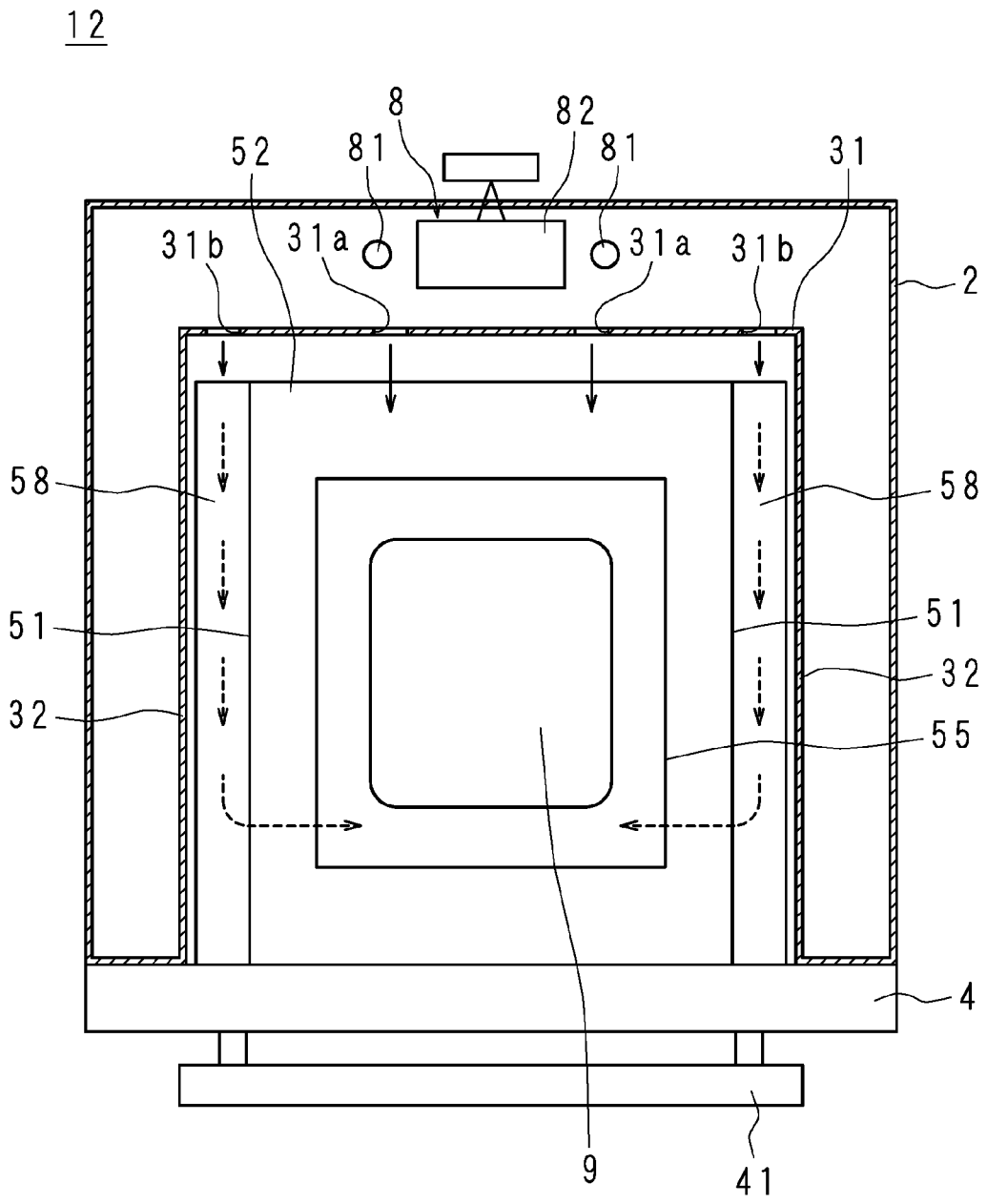
FIG. 6 is a schematic plan section view illustrating the microwave oven according to Embodiment 3 of the present invention.

FIG. 5 is a schematic front view illustrating the microwave oven 12 according to Embodiment 3 of the present invention. FIG. 6 is a schematic plan section view illustrating the microwave oven 12. In FIGS. 5 and 6, the same portions as those in FIGS. 2 and 3 are denoted by the same reference codes and will not be described in detail. Moreover, in FIG. 5, the door 4 is not illustrated.

In the microwave oven 12 according to the present embodiment, guide plates 58, 58 extending toward the side wall 32 of the heating chamber 3 in the lateral direction are provided at the upper edges of the both side plates 5 of the inner box 5.

Multiple outlet ports 51*a* are then provided at portions corresponding to the placement position of the placement table 55 at the lower part of the door 4 of the side plates 51, 51.

A hot-air generating unit 8 is built in between the rear wall 31 of the heating chamber 3 and the back plate of the cooker body 2, as in the microwave oven 1 or 11.

The hot-air generating unit 8 includes multiple heaters 81 and an air-blowing fan 82.

At the rear wall 31 of the heating chamber 3, multiple outlet ports 31*a* are formed at positions higher than the upper edge of the back plate 52 and corresponding to both sides in the width direction of the air-blowing fan 82, while multiple outlet ports 31*b* are formed at positions close to the ends and lower than the guide plates 58.

In the microwave oven 12 configured as described above, the heater 81 is energized, so that the hot air generated by rotating the air-blowing fan 82 at a predetermined rotation speed is introduced into the inner box 5 from the upper side of the back plate 52, and is blown onto the object to be cooked 9 from the back to the front.

Moreover, the hot air blown out from the outlet ports 31*b* flows through guide parts 35, each of which is a space formed by the guide plate 58, side plate 51, bottom wall 33 of the heating chamber 3 and the side wall 32 from the rear to the front, pass through the outlet ports 51*a* and is blown from the bottom at the front side onto the object to be cooked 9.

The streams of hot air merge with each other and the merged hot air reaches the inlet port of the air-blowing fan 82 through the air-intake opening.

Accordingly, the hot air is rectified and is uniformly and efficiently made contact with the object to be cooked 9, achieving preferable heat cooking efficiency.

The back plate 52 may be provided with an introducing plate 54, as in the microwave oven 1, which is so inclined that the height is increased toward the back, or the upper edge of the back plate 52 may be inclined toward the rear wall 31 of the heating chamber 3, as in the microwave oven 11.

Furthermore, instead of the outlet port 51*a* formed at the side plate 51, an outlet port may also be formed at a portion in the middle part of the bottom plate 53 in the width direction which corresponds to the front side of the placement position of the placement table 55.

Embodiment 4

A microwave oven 13 according to Embodiment 4 of the present invention has a configuration similar to that of the microwave oven 1 according to Embodiment 1, except for the hot-air generating unit 8 at the upper part and the different configuration of the inner box 5.

Figure 7:
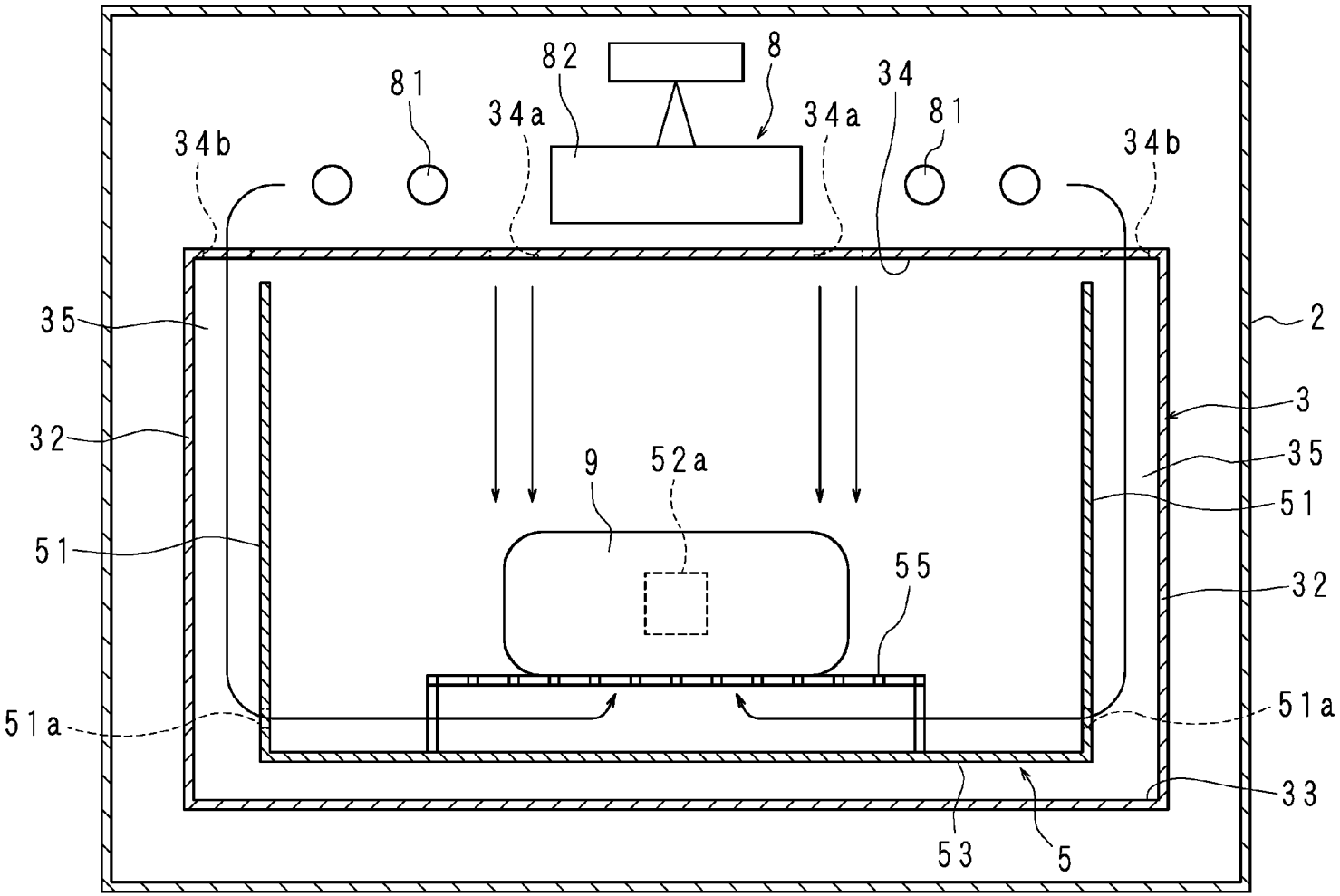
FIG. 7 is a schematic front section view illustrating a microwave oven according to Embodiment 4 of the present invention.

FIG. 7 is a schematic front section view illustrating the microwave oven 13 according to Embodiment 4 of the present invention. In FIG. 7, the same portions as those in FIGS. 2 and 3 are denoted by the same reference codes and will not be described in detail.

A hot-air generating unit 8 is provided between the upper wall 34 of the heating chamber 3 and the upper plate of the cooker body 2. Multiple outlet ports 34*a* are provided at portions on the upper wall 34 corresponding to both sides of the air-blowing fan 82 in the width direction (left-right direction FIG. 7), while multiple outlet ports 34*b* are provided at portions close to the side walls 32.

The side plates 51, 51 of the inner box 5 are made higher compared to the side plates 51 of the microwave oven 1, 11 or 12. Multiple outlet ports 51*a* are provided at portions corresponding to the front side of the placement position of the placement table 55 at the lower parts of the side plates 51, 51 on the door 4 side.

In the microwave oven 13 configured as described above, the heater 81 is energized, so that the hot air generated by rotating the air-blowing fan 82 at a predetermined rotation speed is blown out from the outlet port 34*a* and is blown onto the object to be cooked 9 from the above.

Moreover, the hot air blown out from the outlet ports 34*b* flows along the guide parts 35 each of which is a space formed by the side plates 51, and the upper wall 34, side wall 32 and bottom wall 33 of the heating chamber 3, passes through the outlet ports 51*a* and between legs of the placement table 55, and is blown through the net of the rectangular plate onto the lower part of the object to be cooked 9.

The hot air merge with each other and reaches the inlet port of the air-blowing fan 82 through the air-intake opening formed at the lower part of the back plate 52.

This makes it possible to directly heat the lower part of the object to be cooked 9, and the hot air is rectified and is uniformly and efficiently made contact with the object to be cooked 9, achieving preferable heat cooking efficiency.

It is noted that the hot-air generating unit 8 is provided at the lower side of the upper wall 34 of the heating chamber 3 while a plate having an outlet port is provided between the hot-air generating unit 8 and the opening of the inner box 5.

It is also possible not to provide any outlet port 34*a*.

Embodiment 5

A microwave oven 14 according to Embodiment 5 of the present invention has a configuration similar to that of the microwave oven 13 according to Embodiment 4, except for the different configuration of the inner box 5.

Figure 8:
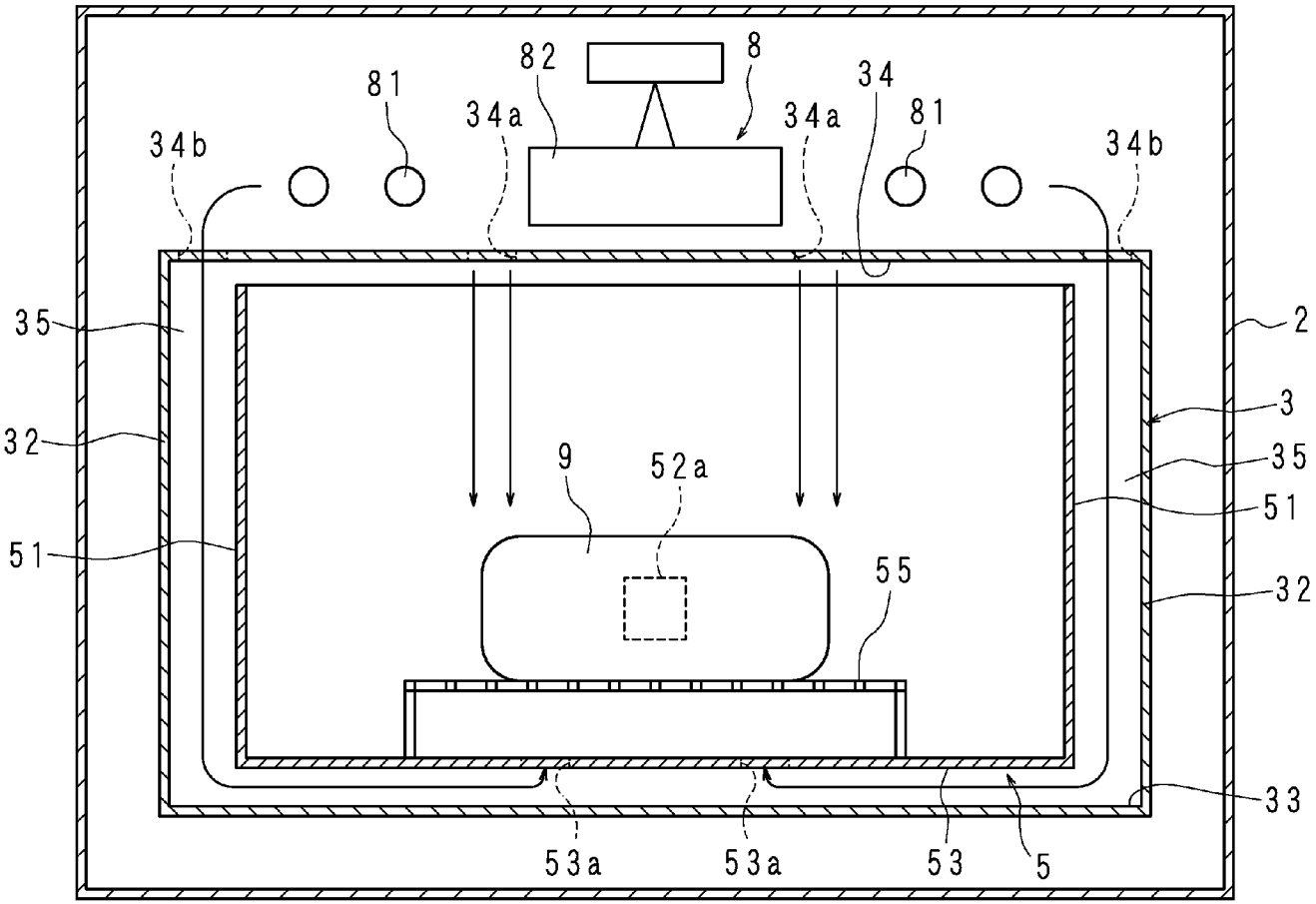
FIG. 8 is a schematic front section view illustrating a microwave oven according to Embodiment 5 of the present invention.

FIG. 8 is a schematic front section view illustrating the microwave oven 14 according to Embodiment 5 of the present invention. In FIG. 8, the same portions as those in FIG. 7 are denoted by the same reference codes and will not be described in detail.

A hot-air generating unit 8 is provided between the upper wall 34 of a heating chamber 3 and the upper plate of a cooker body 2. Multiple outlet ports 34*a* are provided at portions on the upper wall 34 corresponding to both sides of an air-blowing fan 82 in the width direction (left-right direction FIG. 8), while multiple outlet ports 34*b* are provided at portions close to side walls 32.

Multiple outlet ports 53*a* are provided at portions corresponding to the front side of the placement position of a placement table 55 at the middle part of a bottom plate 53 in an inner box 5 in the width direction.

In the microwave oven 14 configured as described above, a heater 81 is energized, so that the hot air generated by rotating an air-blowing fan 82 at a predetermined rotation speed is blown out from an outlet port 34*a* and blown onto an object to be cooked 9 from the above.

Moreover, the hot air blown out of the outlet ports 34*b* flows through the guide part 35 each of which is a space formed by the side plates 51, and the upper wall 34, side wall 32 and bottom wall 33 of the heating chamber 3, passes through the outlet port 53*a*, and is blown through the net of the rectangular plate onto the lower part of the object to be cooked 9.

This makes it possible to directly heat the lower part of the object to be cooked 9, so that the hot air is efficiently made contact with the object to be cooked 9, achieving preferable heat cooking efficiency.

As described above, in the heating cooker (1, 11) according to an embodiment of the present disclosure including: a cooker body (2) in the shape of a box having the heating chamber (3) provided with an opening at the front side; a storage (10) having a door (4) which opens and closes the opening, and an inner box (5) including two side plates (51) connected to the door, a bottom plate (53) and a back plate (52), movable to the front side and storing an object to be cooked (9); and a hot-air generating unit (8) generating hot air, the hot-air generating unit is located outside the rear wall (31) of the heating chamber and is provided with an outlet port (31*a*) for blowing out the hot air at a position on the rear wall which is higher than the back plate of the storage.

According to an embodiment of the present disclosure, hot air generated by the hot-air generating unit is blown out from the outlet port, is introduced into the storage from the upper side of the edge of the back plate of the storage, is blown onto an object to be cooked from back to front, and reaches the inlet port of the hot-air generating unit.

Accordingly, hot air may be rectified with a simple structure, which can uniformly and efficiently heat an object to be cooked.

The speed and direction of rotation of the air-blowing fan may be changed depending on the material, shape, weight, type of cooking and the like for the object to be cooked, to change the volume and position of the hot air directed to the object to be cooked, so as to adjust the cooking time, the degree of heating and the like.

The heating cooker (1) according to an embodiment of the present disclosure comprises an introducing plate (54) which bridges the upper end of the back plate and the lower portion of the outlet port to introduce the hot air into the storage.

According to an embodiment of the present disclosure, hot air generated by the hot-air generating unit is blown out from the outlet port, is guided diagonally downward by the introducing plate, is introduced into the storage, and is blown onto an object to be cooked, to heat the object to be cooked.

Accordingly, hot air may be rectified with a simple structure, which can uniformly heat an object to be cooked with a preferable heat cooking efficiency.

In the case where the introducing plate is configured to have a variable inclined angle, the amount of air as well as the position of the object to be cooked with which hot air makes contact may easily be changed by changing the inclined angle.

In the heating cooker (12, 13, 14) according to an embodiment of the present disclosure including: a cooker body (2) in the shape of a box having a heating chamber (3) provided with an opening at the front side; a storage (10) having a door (4) which opens and closes the opening, and the inner box (5) including two side plates (51) connected to the door, bottom plates (53) and a back plate (52), movable to the front side and storing an object to be cooked (9); and a hot-air generating unit (8) generating hot air, the hot-air generating unit is located outside the heating chamber and is provided with an outlet port (31*a*, 31*b*, 34*a*, 34*b*) blowing out the hot air on a wall surface (31, 34) of the heating chamber, and a guide part (35) guiding the hot air to the outside of the side plate of the storage at a position corresponding to the outlet part.

According to the present disclosure, hot air generated by the hot-air generating unit is blown out from the outlet port (31*a*, 34*a*), is introduced into the storage from the upper side, and is blown onto an object to be cooked.

Moreover, the hot air blown out from the outlet port (31*b*, 34*b*) flows through the guide part and is blown onto the object to be cooked from the bottom at the front side.

Accordingly, hot air may be rectified with a simple structure, which can uniformly heat an object to be cooked with a preferable heat cooking efficiency.

The speed and direction of rotation of the air-blowing fan may be changed depending on the material, shape, weight, type of cooking and the like for the object to be cooked, to change the volume and position of the hot air directed to the object to be cooked so as to adjust the cooking time, the degree of heating and the like.

The heating cooker (12, 13, 14) according to an aspect of the present disclosure is configured to have the outlet port (51*a*) for blowing out the hot air at the door side of the side plate of the storage or at the bottom plate of the storage.

According to an aspect of the present disclosure, hot air may be surely blown onto the object to be cooked from the front side in the case where the outlet port is formed at the door side of the side plate of the storage, whereas hot air may be blown onto the lower part of the object to be cooked in the case where the outlet port is formed at the bottom plate of the storage.

In the heating cooker (13, 14) according to an aspect of the present disclosure, the hot-air generating unit is provided outside the upper wall (34) of the heating chamber and the outlet port (34*a*) is provided at the upper wall.

According to an aspect of the present disclosure, the hot air generated by the hot-air generating unit is blown out from the outlet port formed at the upper wall to be blown onto the object to be cooked from the above, while flowing between the side plates of the storage and the side plates of the heating chamber and through the outlet port formed at the door side of the side plate of the storage or at the bottom plate of the storage, to be blown onto the lower part of the object to be cooked.

This makes it possible to rectify the hot air with a simple structure and to directly heat the lower part of the object to be cooked which may be heated uniformly, so that the hot air is efficiently made contact with the object to be cooked, achieving preferable heat cooking efficiency.

It should be understood that the embodiments disclosed herein are illustrative and non-restrictive in every respect. All changes that fall within metes and bounds of the claims, or equivalence of such metes and bounds thereof are therefore intended to be embraced by the scope of the present invention.

For example, while Embodiments 1 to 5 illustrate the case where the microwave oven 1, 11, 12, 13 or 14 is applied as a heating cooker, it is not limited thereto but a case without a microwave irradiation unit 7 may also employed. Here, it is unnecessary for an outlet port to have a size through which electromagnetic wave cannot pass but may have a larger size.

Moreover, the placement table 55 may also be a rotating table.

Embodiment 6

Figure 9:
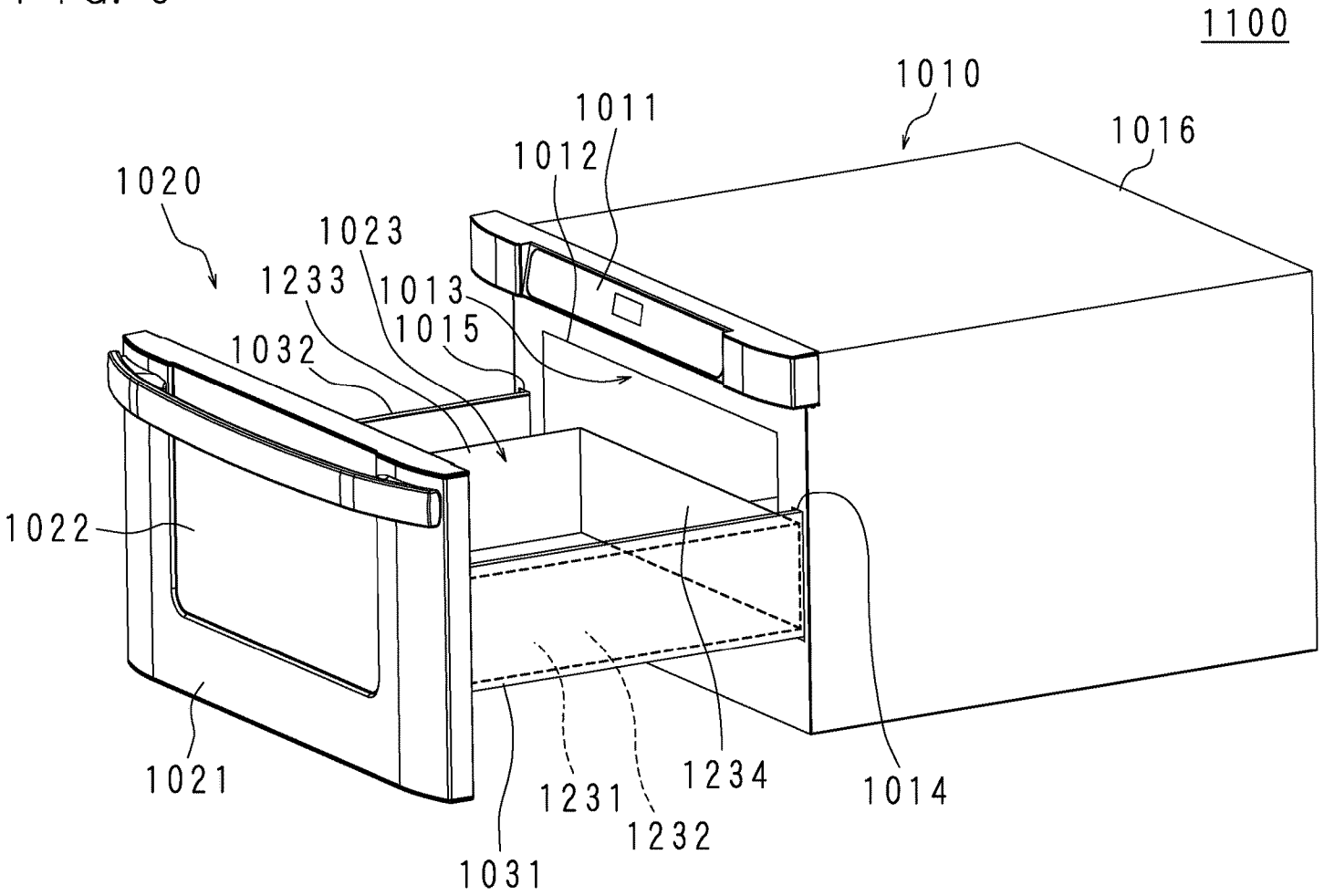
FIG. 9 is an outer perspective view illustrating the first example of a heating cooker according to Embodiment 6.

FIG. 9 is an outer perspective view illustrating the first example of a heating cooker 1100 according to Embodiment 6. The heating cooker 1100 comprises a cooker body 1010 and a drawer unit 1020 which may be pulled out from the cooker body 1010. The cooker body 1010 is in the shape of a box and has an outer casing 1016. Inside the cooker body 1010, a casing (1055) which will be described later is arranged while being provided with a heating chamber 1013 having an opening 1012 at the front side. At the upper side on the front face of the cooker body 1010, an operation unit 1011 provided with an operation button for controlling the operation (e.g., cooking method, heating time, operation start, stop or the like) of the heating cooker 1100 is located.

The drawer unit 1020 includes an open/close door 1021 for opening and closing an opening 1012 and a container 1023 contained in the heating chamber 1013. The container 1023 is in the shape of a box with the upper side opened, and has a rectangular bottom plate 1231, opposing rectangular side plates 1232, 1233 located at both edges of the respective bottom plates 1231 and a rectangular rear plate 1234 located to correspond to the open/close door 1021. At a middle part of the open/close door 1021, a glass window 1022 is provided through which the inside of the container 1023 can be viewed from the outside.

A box-shaped casing (1055) described later which covers the heating chamber 1013 is arranged inside the cooker body 1010, and long fixed rail units (1041, 1042) described later are fixed, respectively, to the side walls of the casing (1055). Long movable rail units 1031, 1032 that are slidable with respect to the fixed rail units (1041, 1042), respectively, are fixed to the drawer unit 1020. On both sides of the front face of the cooker body 1010, insertion holes 1014, 1015 of a rectangular shape through which the movable rail units 1031, 1032 are inserted are formed so that the movable rail units 1031, 1032 are allowed to move. The fixed rail units (1041, 1042) and the movable rail units 1031, 1032 constitute a moving mechanism (slide mechanism) for pulling out the drawer unit 1020.

Figure 10:
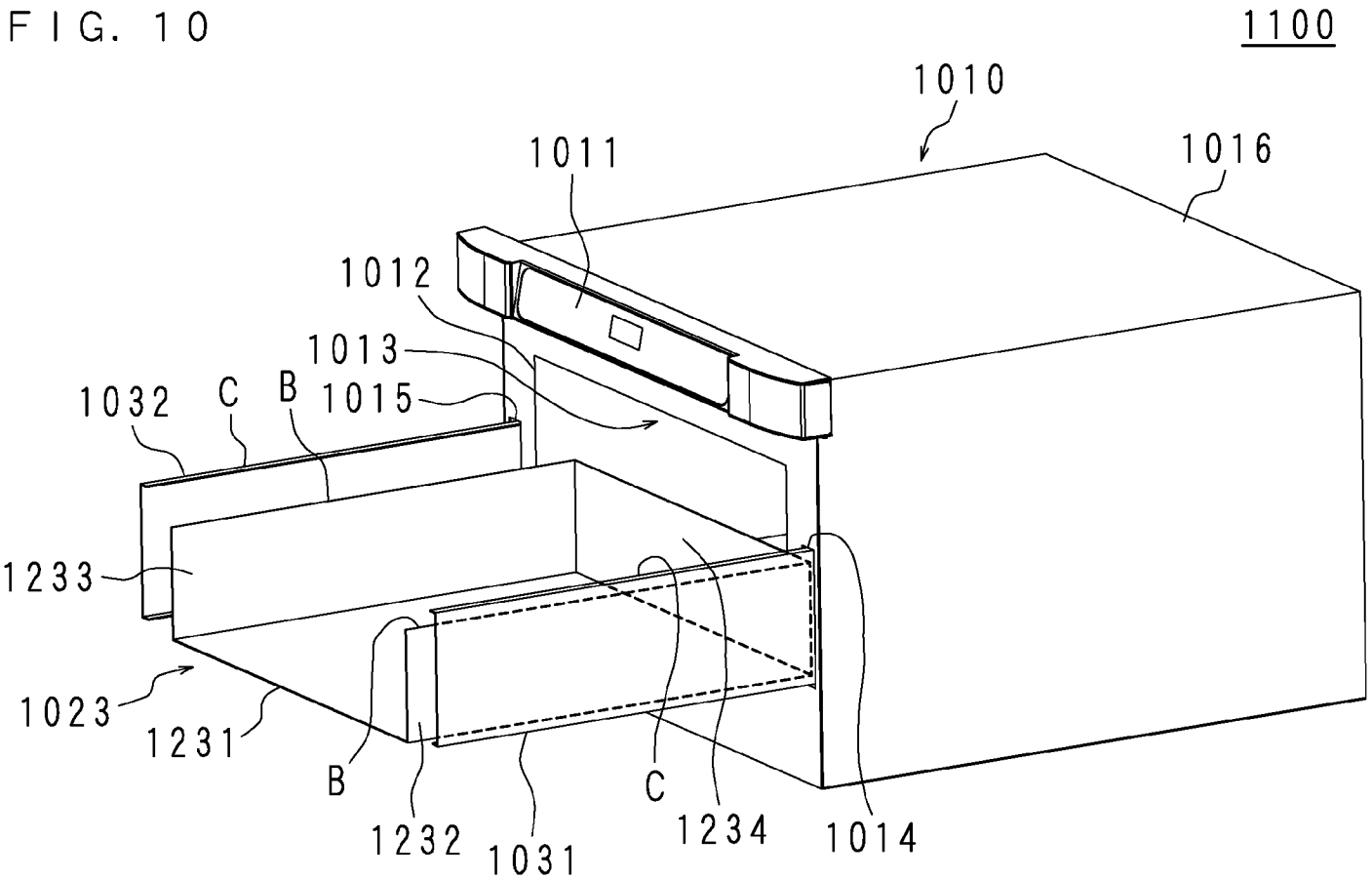
FIG. 10 is a perspective view of main parts illustrating the first example of the heating cooker according to Embodiment 6.
Figure 11:
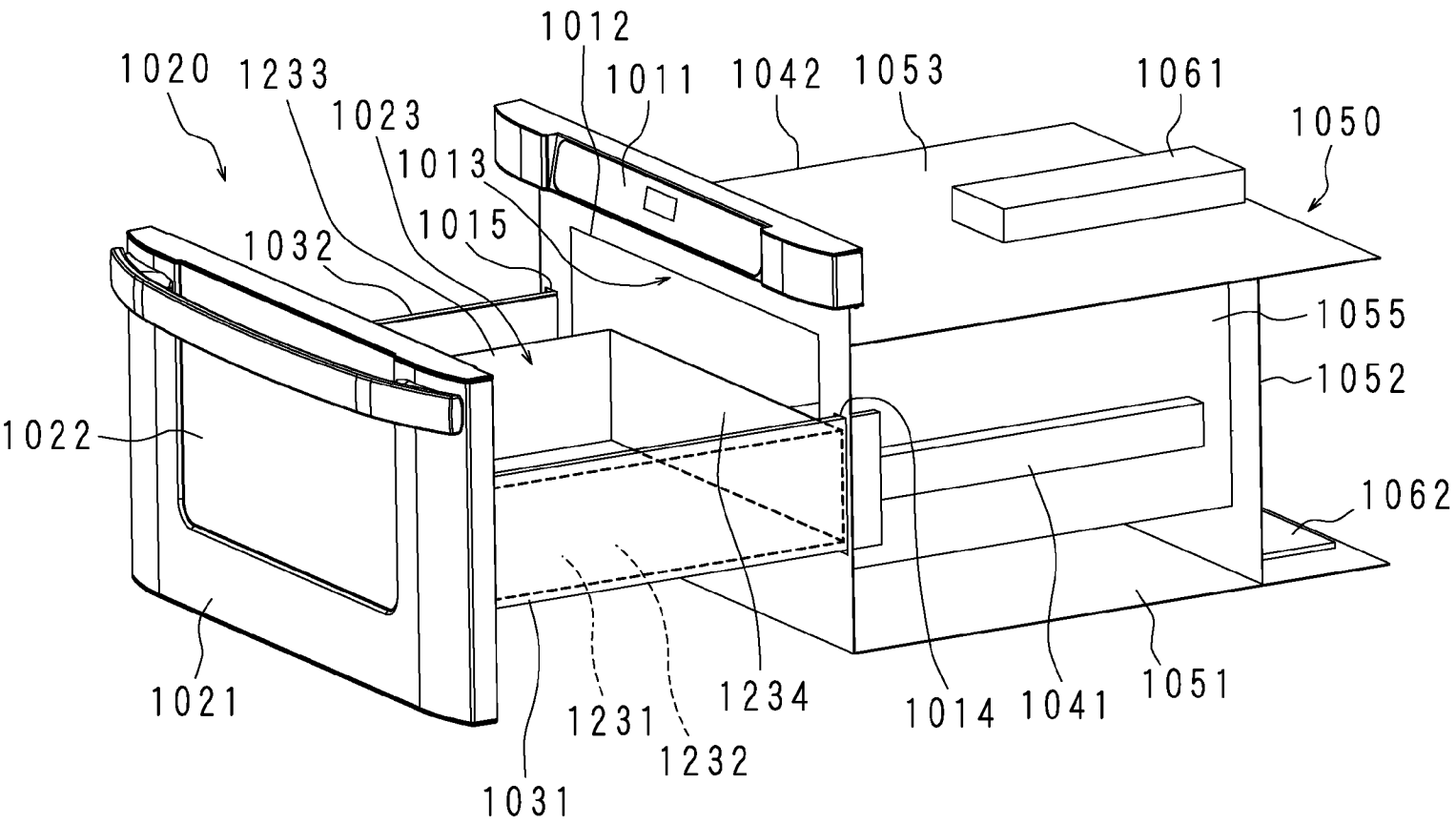
FIG. 11 is a perspective view of main parts illustrating the first example of the heating cooker according to Embodiment 6.
Figure 12:
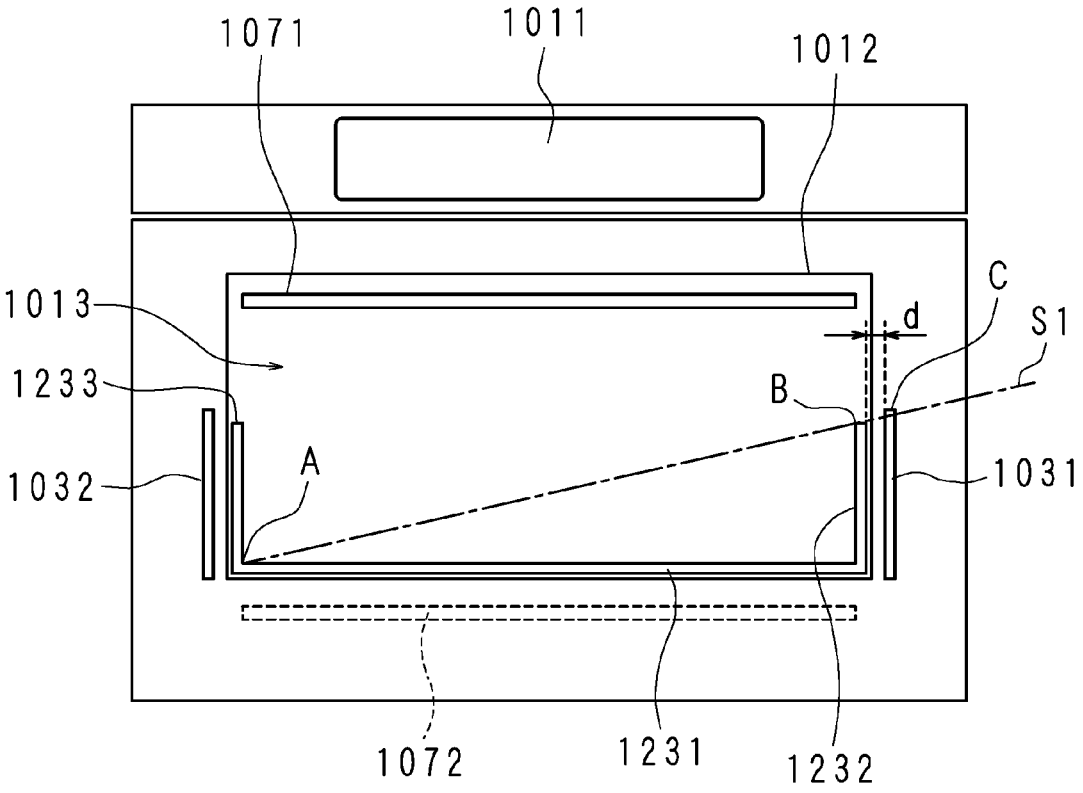
FIG. 12 is a front view of main parts illustrating the first example of the heating cooker according to Embodiment 6.

FIG. 10 is a perspective view of the main parts illustrating the first example of a heating cooker 1100 according to Embodiment 6. FIG. 11 is a perspective view of the main parts illustrating the first example of the heating cooker 1100 according to Embodiment 6. FIG. 12 is a front view of the main parts illustrating the first example of the heating cooker 1100 according to Embodiment 6. The open/close door 1021 is not illustrated in FIGS. 10 and 12 so that the positional relationship between the container 1023 and the movable rail units 1031, 1032 can be seen. The outer casing 1016 is not illustrated in FIG. 11 so that the internal structure of the cooker body 1010 can be seen.

As illustrated in FIG. 11, the cooker body 1010 has an inner casing 1050. That is, the heating cooker 1100 includes a casing with a dual structure having the inner casing 1050 and the outer casing 1016. The inner casing 1050 has a rectangular bottom wall 1051, a rear wall 1052 vertically extending from a midway of the bottom wall 1051, a top wall 1053 opposed to the bottom wall 1051, and a casing 1055 fixed to the top wall 1053 and the rear wall 1052 to cover the heating chamber 1013.

At the top wall 1053, a waveguide 1061 for propagating the microwave generated at a magnetron (1063) described later into the heating chamber 1013 is provided. The long fixed rail units 1041, 1042 are fixed to the respective side walls of the casing 1055. On the bottom wall 1051 at the outer side of the rear wall 1052, a control board 1062 or the like is arranged.

As illustrated in FIG. 12, a top heater 1071 and a bottom heater 1072 for heating an object to be heated which is contained in the container 1023 are located in the heating chamber 1013. That is, the top heater 1071 has dimensions substantially the same as those of the bottom plate 1231, and is arranged above an upper edge B of the side plates 1232, 1233. Moreover, the bottom heater 1072 has dimensions substantially the same as those of the bottom plate 1231, and is arranged below the bottom plate 1231. It is noted that the arrangement of the top heater 1071 and the bottom heater 1072 is not limited to the example in FIG. 12. Furthermore, in the example of FIG. 12, the bottom heater 1072 is arranged to be lower than the lower edge of the opening 1012, while the height of the opening 1012 may slightly be increased so that the bottom heater 1072 is arranged to be higher than the lower edge of the opening 1012. Hereinafter, according to the present embodiment, the top heater 1071 and the bottom heater 1072 are collectively and simply referred to as heaters 1071, 1072.

The heating cooker 1100 is configured to prevent a burn caused by the container 1023 which is heated by the heaters 1071, 1072. In order to prevent the user from inadvertently touching the container 1023 which is heated by the heaters 1071, 1072 to a high temperature and suffering from a heat burn (burn injury) in the case where the open/close door 1021 is pulled out after heat cooking to expose the container 1023 from the heating chamber 1013, it may be configured, for example, that the user cannot easily touch the container 1023 (particularly, side plates 1232, 1233) or the temperature of the container 1023 is lowered so that the user will not get burned even if the user touches the container. Such a configuration can prevent the user from a burn injury. A specific example will be described below.

As illustrated in FIG. 10, the movable rail units 1031, 1032 are arranged, respectively, at the outer sides of the side plates 1232, 1233 of the container 1023, the width (dimension in the same direction as the height direction of the side plates 1232, 1233) of the movable rail units 1031, 1032 is larger than the side plates 1232, 1233, and the upper edge C of the movable rail units 1031, 1032 are located at the position of the upper edge B of the side plates 1232, 1233 or higher than that position.

Movable rail units 1031, 1032 are arranged at the outer sides of the opposing side plates 1232, 1233, respectively, of the container 1023, and the outer sides of the side plates 1232, 1233 are covered by the movable rail units 1031, 1032, which prevent the user from easily touching the side plates 1232, 1233 of the container 1023 and from getting burned. Moreover, by positioning the upper edge C of the movable rail units 1031, 1302 higher than the upper edge C of the side plates 1232, 1233, an enhanced structure may be obtained which is even harder for the user to touch the side plates 1232, 1233 of the container 1023, further preventing the user from getting burned.

Furthermore, as illustrated in FIG. 12, the upper edge C of the movable rail unit 1031 opposed to one side plate 1232 of the opposing side plates 1232, 1233 of the container 1023 is located higher than a plane S1 defined by the upper edge B of one side plate 1232 and the side edge A of the bottom plate 1231 from which the other side plate 1233 extends.

Likewise, the upper edge of the movable rail unit 1032 opposed to the other side plate 1233 is located higher than a plane defined by the upper edge of the other side plate 1233 and the side edge of the bottom plate 1231 from which the one side plate 1232 extends.

To take out a dish such as a plate placed inside the container 1023 after heat cooking, the user inserts a hand from the upper side of the container 1023 and grips the dish. A hand or an arm is more likely to touch the side plates 1232, 1233 of the container 1023 in the case where the hand is inserted in a diagonal direction compared to the case where the hand is inserted in a substantially vertical direction with respect to the bottom plate 1231. Thus, the upper edge C of the movable rail units 1031, 1032 is made higher than the plane S1, which can prevent the user from touching the side plates 1232, 1233 due to a hand or an arm touching the movable rail units 1031, 1032 when the user inserts a hand in a diagonal direction, thereby preventing the user from getting burned.

Moreover, as illustrated in FIG. 12, a separation distance d between one side plate 1232 and the movable rail unit 1031 opposed thereto is reduced. For example, the separation distance d may be such a size that does not allow a person's finger to be inserted therein, for example, 5 mm or less. Same applies to the separation distance between the other side plate 1233 and the movable rail unit 1032. This can lower the possibility of the user inadvertently touching the side plates 1232, 1233.

As described above, in the heating cooker 1100 according to the present embodiment, the movable rail units 1031, 1032 are arranged at positions at the outer sides of the side plates 1232, 1233 so as to be able to prevent a burn by the container 1023 heated by the heaters 1071, 1072. Movable rail units 1031, 1032 are arranged at the outer sides of the opposing side plates 1232, 1233, respectively, of the container 1023, and the outer sides of the side plates 1232, 1233 are covered by the movable rail units 1031, 1032, which prevent the user from easily touching the side plates 1232, 1233 of the container 1023 and thereby getting burned.

Figure 13:
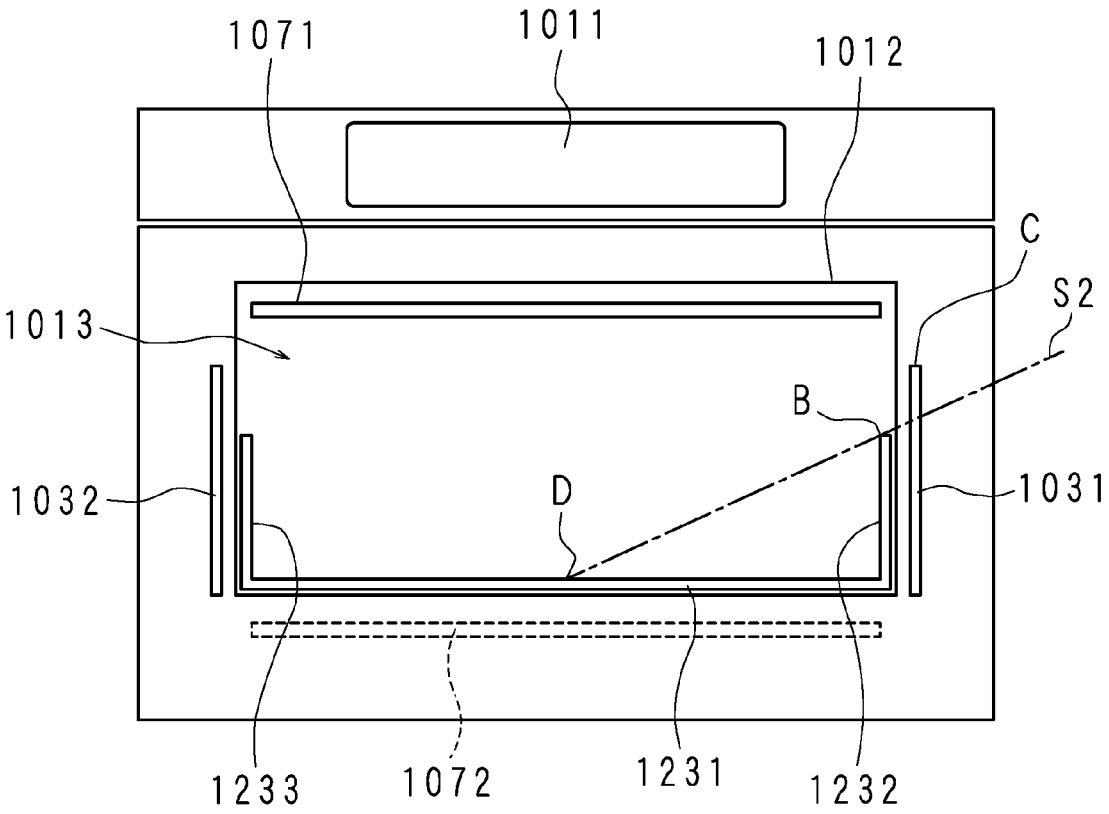
FIG. 13 is a front view of main parts illustrating the second example of the heating cooker according to Embodiment 6.

FIG. 13 is a front view of the main parts illustrating the second example of the heating cooker 1100 according to Embodiment 6. As illustrated in FIG. 13, the upper edge C of the movable rail unit 1031 that is opposed to one side plate 1232 of the opposing side plates 1232, 1233 of the container 1023 is located higher than a plane S2 defined by the upper edge B of one side plate 1232 and a middle part D of the bottom plate 1231.

Likewise, the upper edge of the movable rail unit 1032 opposed to the other side plate 1233 is located higher than a plane defined by the upper edge of the other side plate 1233 and the middle part D of the bottom plate 1231.

To take out a dish such as a plate placed inside the container 1023 after heat cooking, the user inserts a hand from the upper side of the container 1023 and grips the dish. A hand or an arm is more likely to touch the side plates 1232, 1233 of the container 1023 in the case where the hand is inserted in a diagonal direction compared to the case where the hand is inserted in a substantially vertical direction with respect to the bottom plate 1231 of the container 1023. Thus, the upper edge C of the movable rail units 1031, 1032 is made higher than the plane S2, which can further prevent the user's hand or arm from easily touching the side plates 1232, 1233 because of the movable rail units 1031, 1032 when inserting a hand in a diagonal direction, thereby further preventing the user from getting burned.

Figure 14:
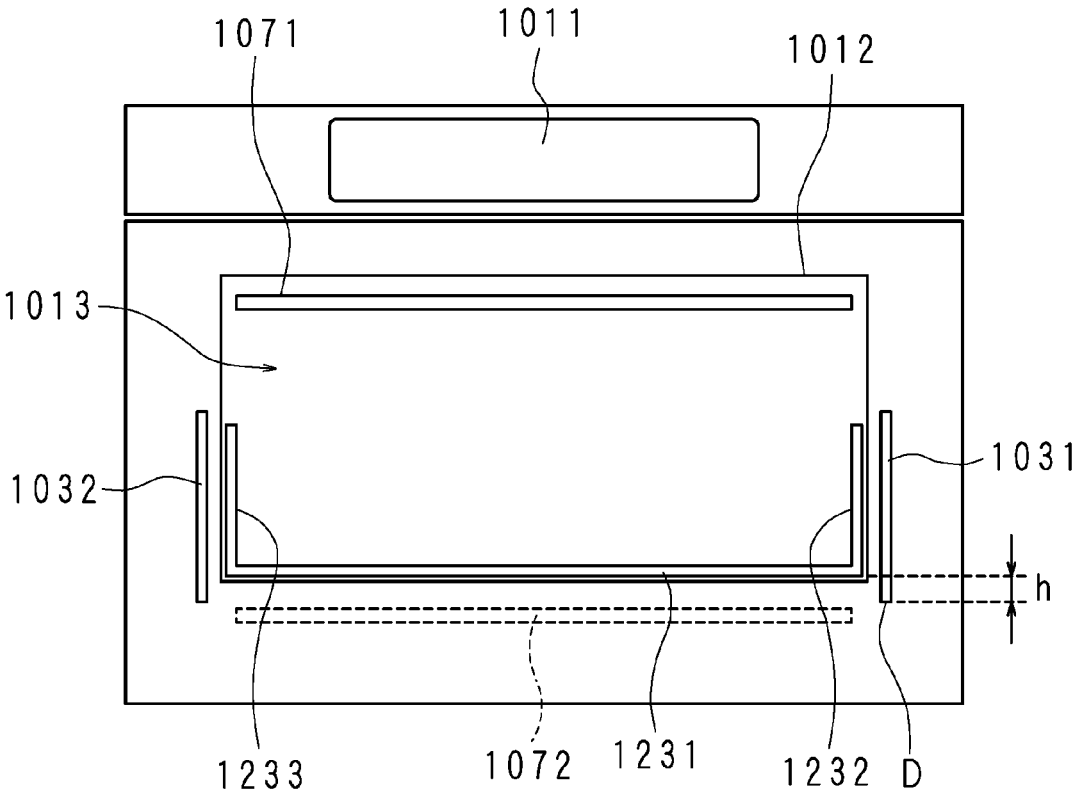
FIG. 14 is a front view of main parts illustrating the third example of the heating cooker according to Embodiment 6.

FIG. 14 is a front view of the main parts illustrating the third example of the heating cooker 1100 according to Embodiment 6. As illustrated in FIG. 14, the lower edge D of the movable rail unit 1031 is located lower than the lower end of the side plate 1232, i.e. the bottom plate 1231, by the height indicated by a character h in FIG. 14. Same applies to the other movable rail unit 1032. That is, the width (dimension in the same direction as the height direction of the side plates) of the movable rail units 1031, 1032 is larger than the height of the side plates 1232, 1233, and the lower edge of the movable rail units 1031, 1032 are located at the position of the lower edge of the side plates 1232, 1233 or lower than that position. By positioning the lower edges of the side plates 1232, 1233 at positions of the lower edges of the movable rail units 1031, 1032, or positioning the lower edges of the movable rail units 1031, 1032 lower than the lower edges of the side plates 1232, 1233, an enhanced structure may be obtained which is even harder for the user to touch the side plates 1232, 1233 and the bottom plate 1232 of the container 1023, further preventing the user from getting burned.

This can prevent a user who is short in height (small child in particular) from inadvertently touching the bottom plate 1231 of the container 1023.

As described above, according to the first to third examples, the movable rail units 1031, 1032 are arranged such that the upper edge of the moving mechanism (more specifically, movable rail units 1031, 1032) arranged outside the heating chamber 1013 is located at a position corresponding to or higher than the side plates 1232, 1233 of the container 1023, and the height of the moving mechanism (more specifically, movable rail units 1031, 1032) is made higher than the height of the side plates 1232, 1233, thereby providing such a structure that the user cannot easily touch the side plates 1232, 1233 of the container 1023.

Figure 15:
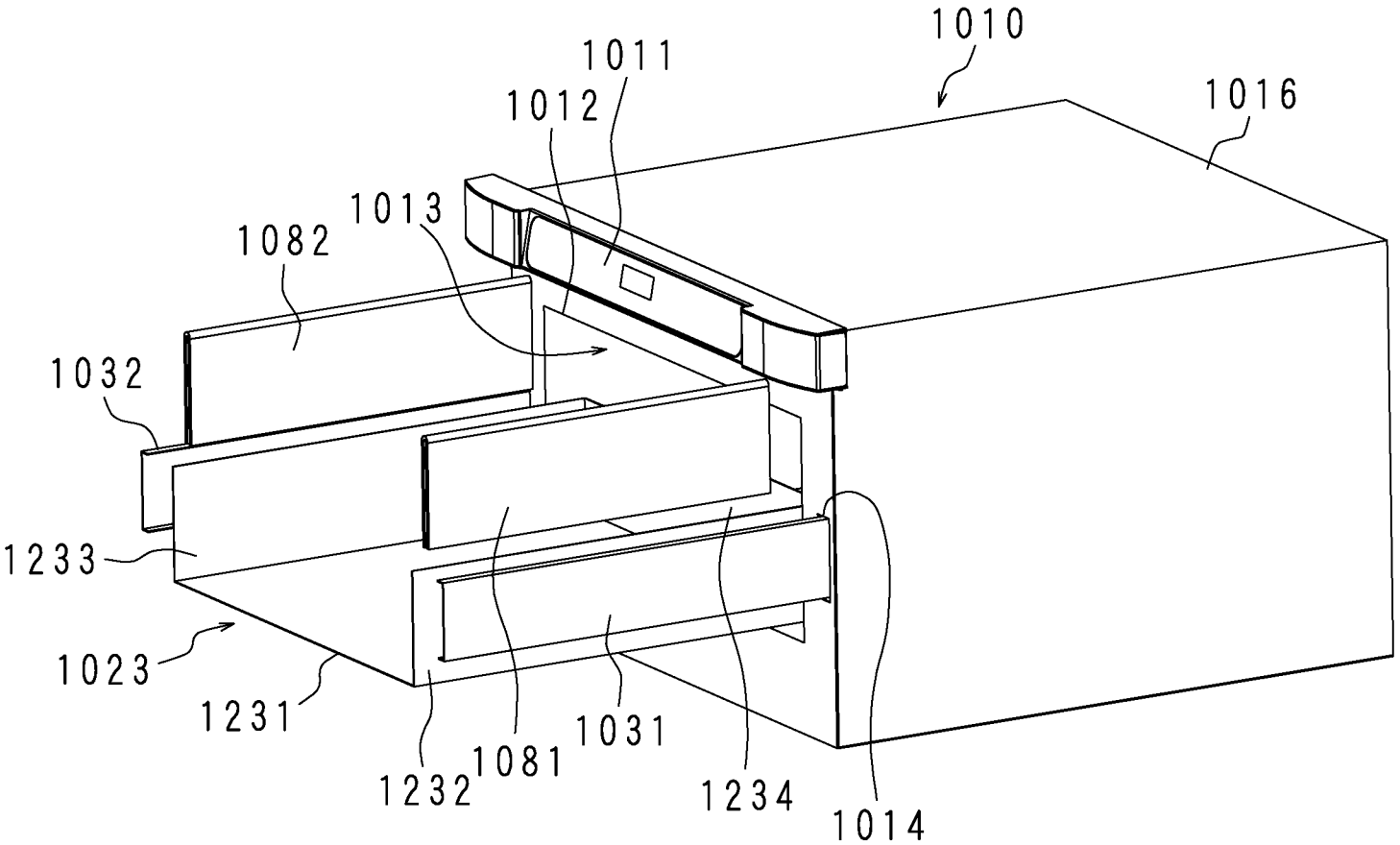
FIG. 15 is an exploded perspective view of main parts illustrating the fourth example of the heating cooker according to Embodiment 6.
Figure 16:
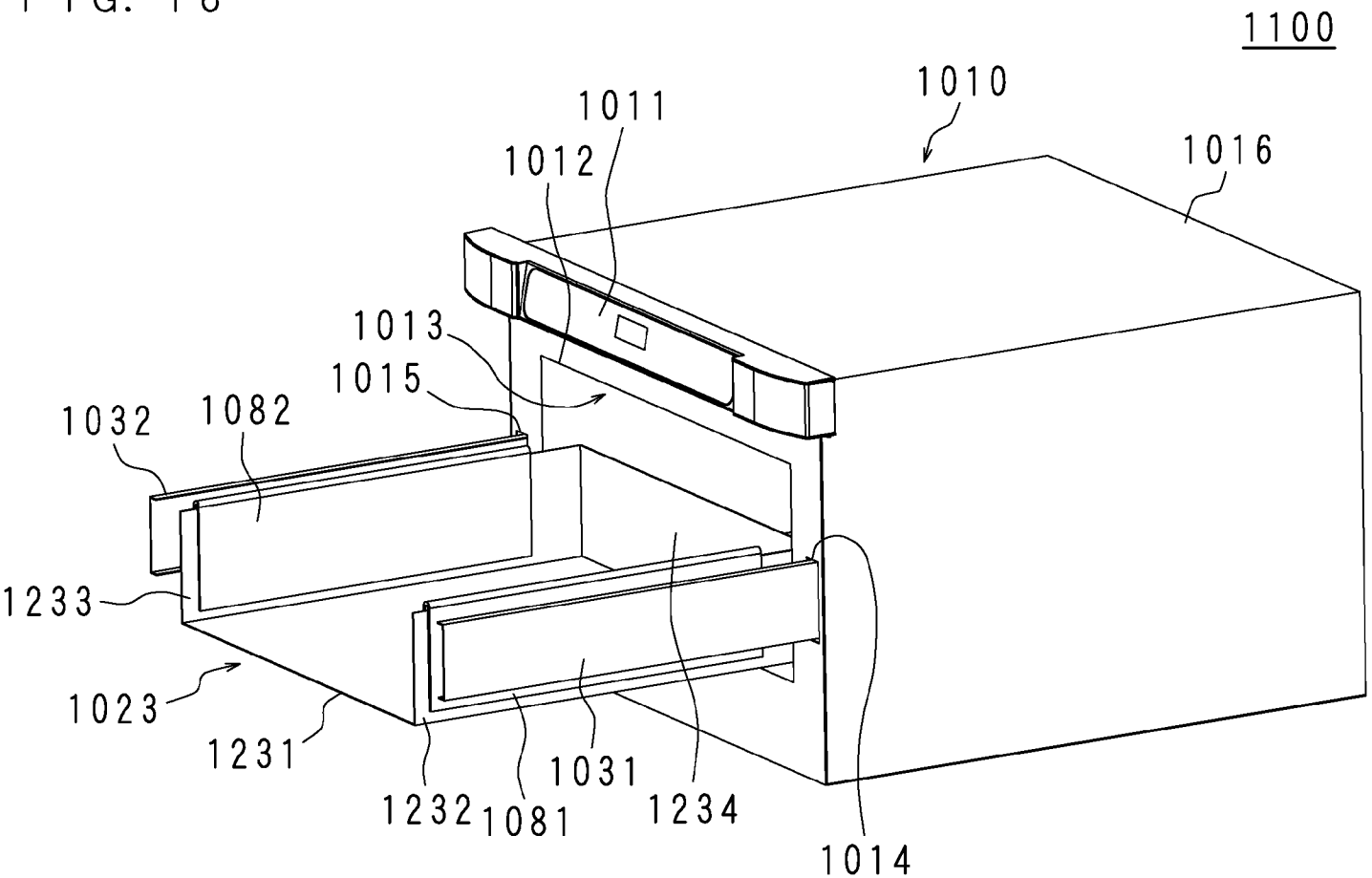
FIG. 16 is a perspective view of main parts illustrating the fourth example of the heating cooker according to Embodiment 6.

FIG. 15 is an exploded perspective view of the main parts illustrating the fourth example of the heating cooker 1100 according to Embodiment 6. FIG. 16 is a perspective view of the main parts illustrating the fourth example of the heating cooker 1100 according to Embodiment 6. FIG. 15 illustrates the state before the side plate covers 1081, 1082 are attached, whereas FIG. 16 illustrates the state where the side plate covers 1081, 1082 are attached. The side plate covers 1081, 1082 serve as covering members that cover the side plates 1232, 1233. The side plate covers 1081, 1082 have substantially the same length as that of the side plates 1232, 1233, while, for example, each of the covers 1081, 1082 has a U-shaped section with a gap of substantially the same dimension as the thickness of each side plate 1232, 1233, and is attached by sandwiching the side plate 1232, 1233 from the upper side to the lower side. The side plate covers 1081, 1082 have resistance to heat, while having a thermal conductivity smaller than the thermal conductivity of the side plates 1232, 1233. It is noted that the side plate covers 1081, 1082 may be made detachable.

The container 1023 is made of metal so as to efficiently conduct heat to a portion to be heated. The side plate covers 1081, 1082 is made of a material having a thermal conductivity lower than metal, such as synthetic resin, for example. This suppresses a raise in temperature of the side plate covers 1081, 1082, thereby preventing the user from getting burned even if the user touches the side plate covers 1081, 1082.

In the fourth example, as for the relationship between the side plates 1232, 1233 and the movable rail units 1031, 1032, any one of the structures in the first to third examples described earlier may be employed instead of the structure illustrated in FIGS. 15 and 16. Furthermore, in the fourth example, in place of the side plate covers 1081, 1082, the side plates 1232, 1233 of the container 1023 may be made of heat-resistant synthetic resin instead of metal.

As described above, according to the fourth example, the side plates 1232, 1233 may be covered with the side plate covers 1081, 1082 made of heat-resistant resin so as to have a structure which is unlikely to cause a burn injury.

Figure 17:
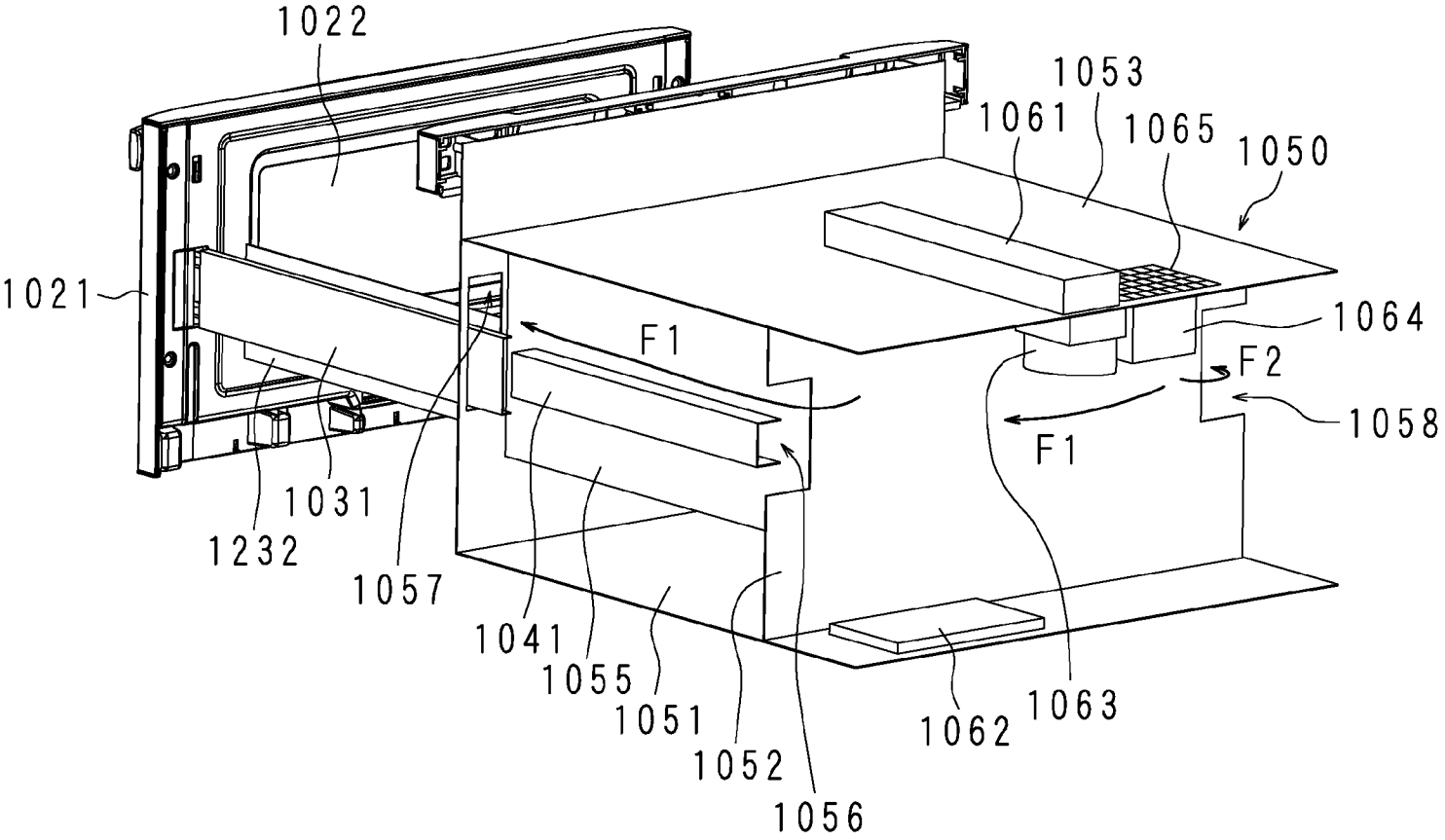
FIG. 17 is a perspective view of main parts on the back side illustrating the fifth example of the heating cooker according to Embodiment 6.
Figure 18:
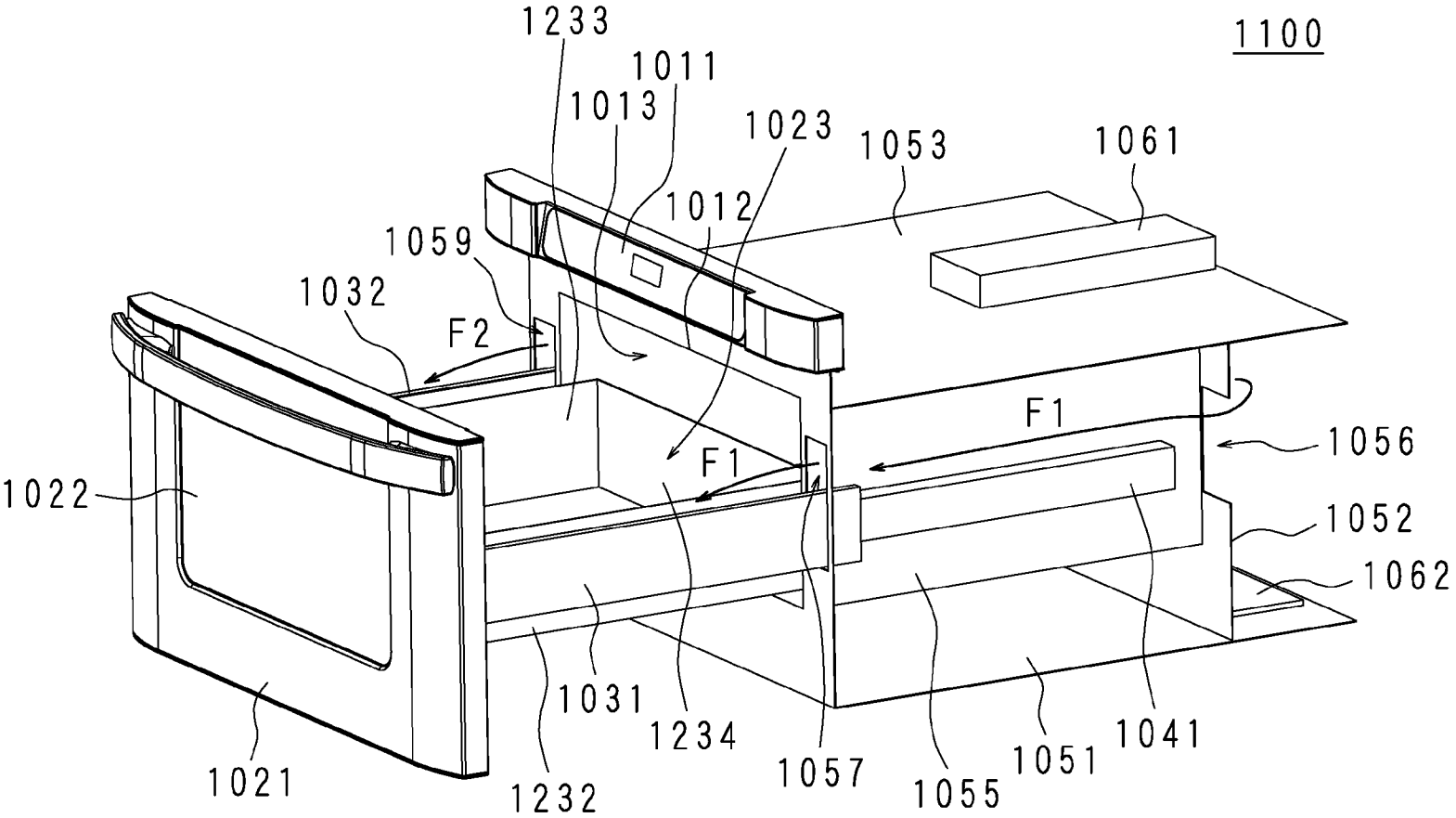
FIG. 18 is a perspective view of main parts illustrating the fifth example of the heating cooker according to Embodiment 6.

FIG. 17 is a perspective view of main parts on the back side illustrating the fifth example of the heating cooker 1100 according to Embodiment 6. FIG. 18 is a perspective view of the main parts illustrating the fifth example of the heating cooker 1100 according to Embodiment 6. As illustrated in FIG. 17, at a rear wall 1052, a magnetron 1063 which generates microwave, and a fan 1064 which cools the magnetron 1063 and the control board 1062 are provided. Moreover, at the top wall 1053, an intake port 1065 is formed which takes in the air when the fan 1064 feeds out the air.

At both sides of the rear wall 1052, rectangular cutouts 1056, 1058 are formed. Moreover, at both sides of the front face of the cooker body 1010, openings 1057, 1059 with substantially the same dimensions as those of the cutouts 1056, 1058 are formed, through which the movable rail units 1031, 1032 are inserted. By attaching the outer casing 1016, an air inlet is formed which is defined by the cutouts 1056, 1058 and the outer casing 1016, and the air fed out by the fan 1064 flows in the directions indicated by F1 and F2 in the drawings. More specifically, the air fed out by the fan 1064 passes through the air inlet defined by the cutouts 1056, 1058 and the outer casing 1016, passes further though the openings 1057, 1059, and flows toward the side plates 1232, 1233 in the container 1023.

In the fifth example, the fan 1064 for feeding out the air to the container 1023 is provided. It is noted that the fan 1064 may operate after heat cooking is completed and before the open/close door 1021 is opened, or may operate after heat cooking is completed and when the open/close door 1021 is opened. Since the air is fed out to the container 1023 (side plates 1232, 1233 in particular) by the fan 1064, the temperature of the container 1023 may be lowered, thereby preventing the user from getting burned even if the user touches the container 1023. Moreover, in the fifth example, the fan 1064 for cooling the container 1023 is the same as the fan for cooling the magnetron 1063 or the like, thereby preventing the increase in the number of components.

In the fifth example, as for the relationship between the side plates 1232, 1233 and the movable rail units 1031, 1032, any one of the structures in the first to third examples described earlier may be employed instead of the structure illustrated in FIGS. 17 and 18.

Figure 19:
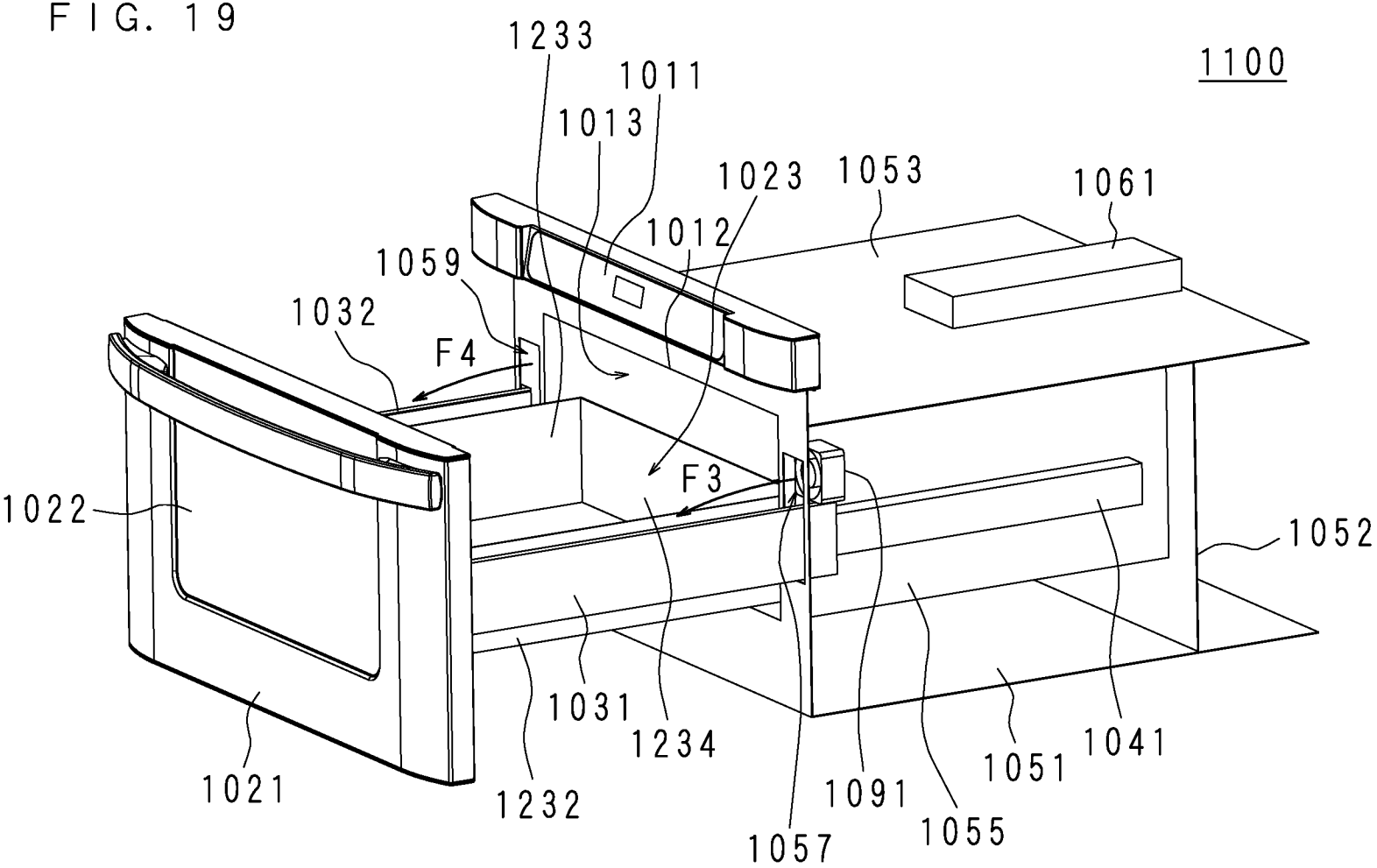
FIG. 19 is a perspective view of main parts illustrating the sixth example of the heating cooker according to Embodiment 6.

FIG. 19 is a perspective view of the main parts illustrating the sixth example of the heating cooker 1100 according to the present embodiment. As illustrated in FIG. 19, fans 1091, 1091 are attached on the respective side surfaces of the casing 1055 near the openings 1057, 1059. The air fed out by the fans 1091, 1091 passes through the openings 1057, 1059, as indicated by the characters F3, F4, and flows toward the side plates 1232, 1233 in the container 1023.

It is noted that the fan 1091 may be configured to operate after heat cooking is completed and when the open/close door 1021 is opened. Since the air is fed out to the container 1023 (particularly side plates 1232, 1233) by the fan 1091, the temperature of the container 1023 may be lowered, thereby preventing the user from getting burned even if the user touches the container 1023.

In the sixth example, as for the relationship between the side plates 1232, 1233 and the movable rail units 1031, 1032, any one of the structures in the first to third examples described earlier may be employed instead of the structure illustrated in FIG. 19.

As described above, according to the fifth and sixth examples, the container 1023 (particularly side plates 1232, 1233) is cooled by the fans 1064, 1091, which allows for a structure not easily causing a burn injury even if the user touches the side plates 1232, 1233.

Figure 20:
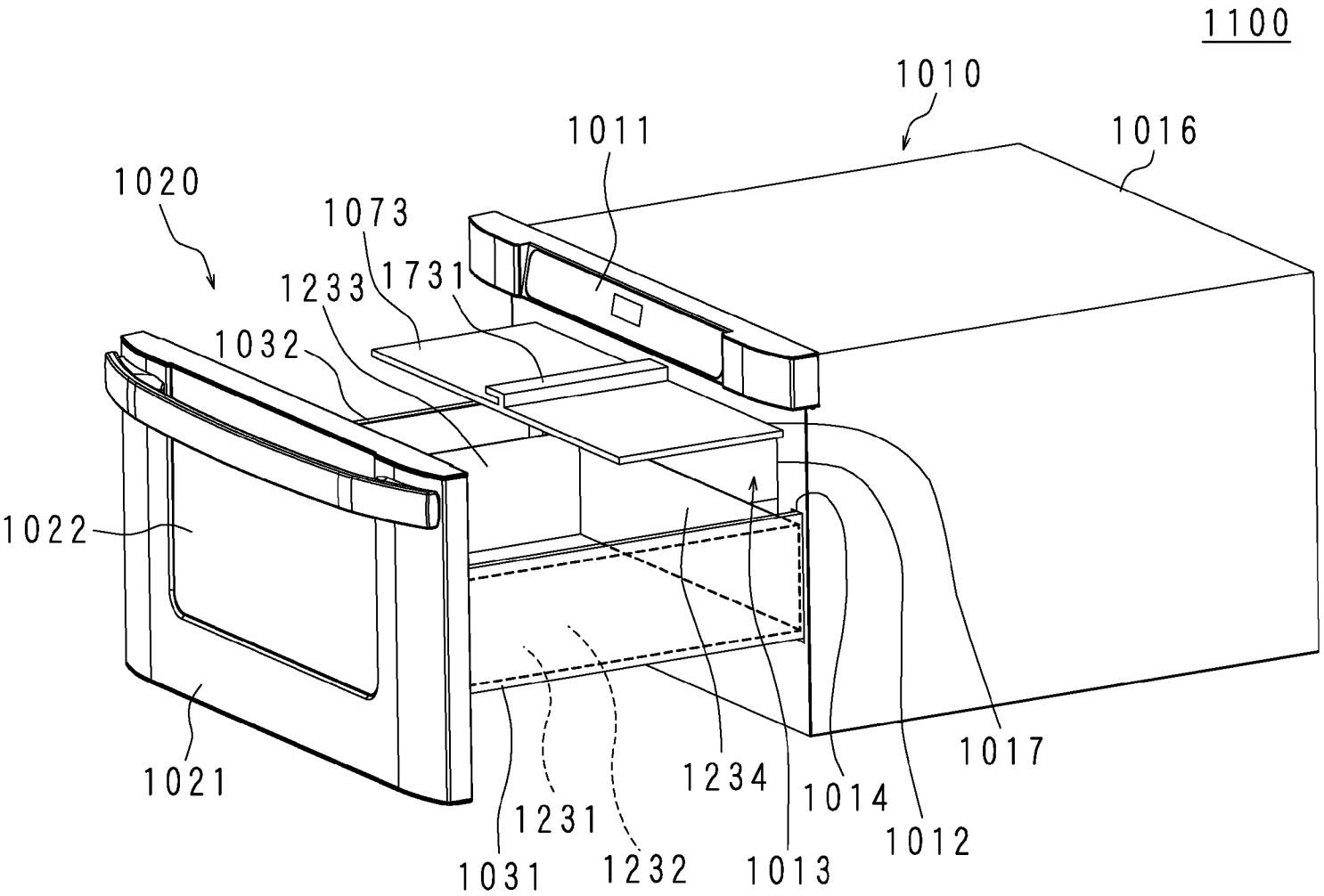
FIG. 20 is an outer perspective view illustrating the seventh example of the heating cooker according to Embodiment 6.
Figure 21:
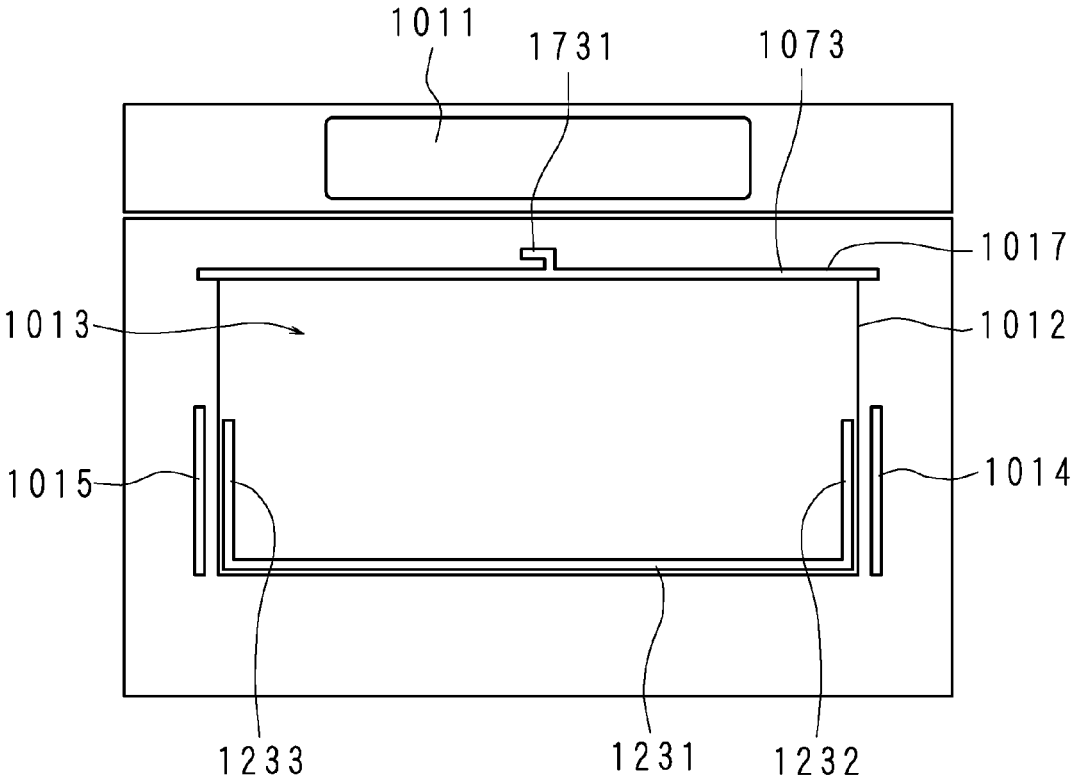
FIG. 21 is a front view of main parts illustrating the seventh example of the heating cooker according to Embodiment 6.

FIG. 20 is an outer appearance perspective view illustrating the seventh example of the heating cooker 1100 according to Embodiment 6. FIG. 21 is a front view of the main parts illustrating the seventh example of the heating cooker 1100 according to Embodiment 6. In the seventh example, a top plate 1073 is provided at the upper side of the heating chamber 1013. The heaters 1071, 1072 are not illustrated here. The top plate 1073 has substantially the same length and width as those of the bottom plate 1231 of the container 1023. Moreover, at the middle part of the top plate 1073, a latch 1731 having a substantially L-shaped cross section is provided along the longitudinal (length) direction. At the upper side of the heating chamber 1013, an opening 1017 is formed which has substantially the same dimensions as those of the sectional shape of the top plate 1073. The top plate 1073 may be pulled out toward the front side to be detached, as in the drawer unit 1020. This can prevent scattered substances that are scattered from a heated object (or cooked object) in the heating chamber 1013 from being adhered to the upper side of the heating chamber 1013. Moreover, even if scattered substances are adhered to the top plate 1073, these substances may easily be cleaned by pulling out the top plate 1073, making the cleaning of the heating cooker 1100 easier.

Figure 22:
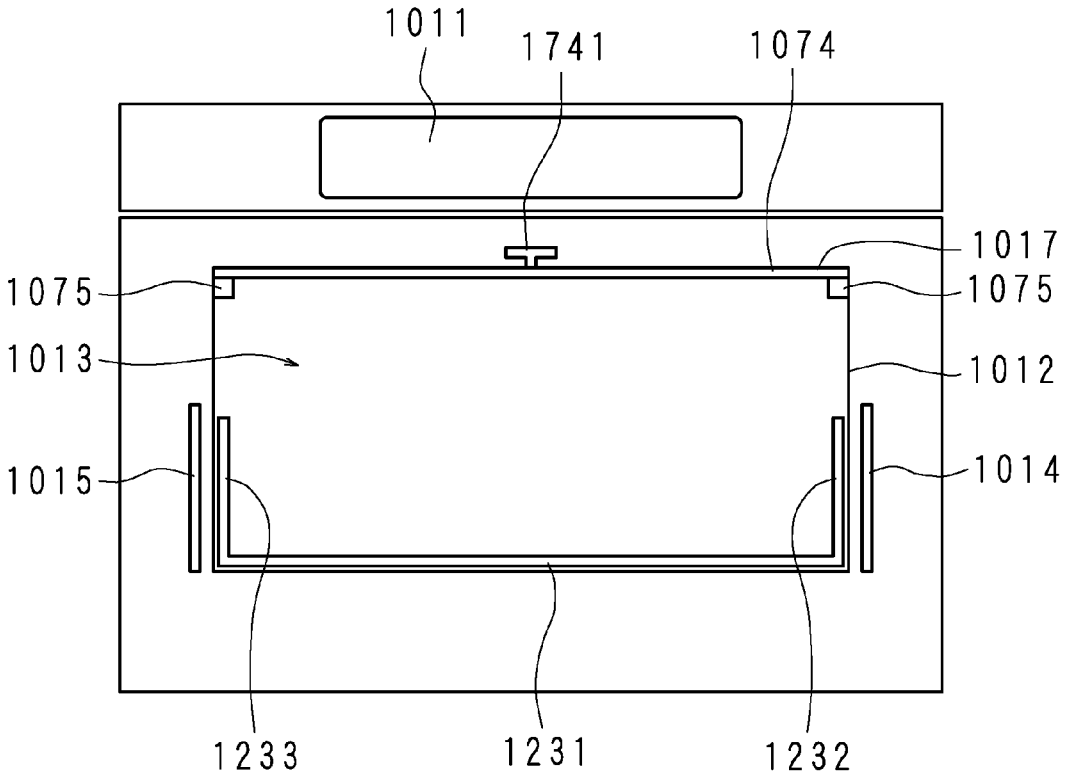
FIG. 22 is a front view of main parts illustrating the eighth example of the heating cooker according to Embodiment 6.

FIG. 22 is a front view of the main parts illustrating the eighth example of the heating cooker 1100 according to Embodiment 6. In the eighth example, the top plate 1074 has substantially the same length and width as those of the bottom plate 1231 of the container 1023. Moreover, at the middle part of the top plate 1074, a latch 1741 having a substantially T-shaped cross section is provided along the longitudinal (length) direction. Furthermore, support members 1075 are provided at the upper corners of the heating chamber 1013 along the longitudinal direction of the top plate 1074.

The top plate 1074 may be pulled out toward the front side to be detached, as in the drawer unit 1020. This can prevent scattered substances that are scattered from a heated object (or cooked object) in the heating chamber 1013 from being adhered to the upper side of the heating chamber 1013. Moreover, even if scattered substances are adhered to the top plate 1074, these substances may easily be cleaned by pulling out the top plate 1074, making the cleaning of the heating cooker 1100 easier.

The technical features described in each example embodiment of the present invention may be combined with one another, and such combinations may form new technical features.

The heating cooker according to the present embodiment includes: a casing (1055) provided with a heating chamber (1013) having an opening (1012) on the front side; a drawer unit (1020) having an open/close door (1021) for the opening and a container (1023) stored in the heating chamber; long fixed rail units (1041, 1042) fixed on the respective side walls of the casing; long movable rail units (1031, 1032) that are fixed to the drawer unit and are slidable with respect to the respective fixed rail units; and a heater (1071, 1072) for heating an object to be heated which is stored in the container. The container is a heating cooker having a rectangular bottom plate (1231) and opposing side plates (1232, 1233), the movable rail units are arranged at the outer sides of the respective side plates, and the upper edge of the movable rail unit is located at or higher than the position of the upper edge of the side plate.

According to the present embodiment, the heating cooker includes: a casing provided with a heating chamber having an opening on the front side; a drawer unit having an open/close door for the opening and a container stored in the heating chamber; long fixed rail units fixed on the respective side walls of the casing; long movable rail units that are fixed to the drawer unit and are slidable with respect to the respective fixed rail units; and a heater for heating an object to be heated which is stored in the container. The container has a rectangular bottom plate and opposing side plates.

The movable rail units are arranged, respectively, at the outer sides of the side plates of the container, and the upper edges of the movable rail units are located at the position of the upper edges of the side plates or higher than those positions. Movable rail units are arranged at the outer sides of the opposing side plates, respectively, of the container, and the outer sides of the side plates are covered by the movable rail units, which can prevent the user from easily touching the side plates of the container and thus from getting burned. Moreover, by positioning the upper edges of the movable rail units higher than the upper edges of the side plates, a structure may be obtained which is even harder for the user to touch the side plates of the container, further preventing the user from getting burned. For example, in the case where the container is exposed from the heating chamber by pulling out the open/close door after heat cooking, the user may be prevented from inadvertently touching the container which is heated by the heater to a high temperature and getting burned.

In the heating cooker according to the present embodiment, the width of the movable rail units (1031, 1032) is larger than the height of the side plates (1232, 1233), and the lower edges of the movable rail units are located at the positions of the lower edges of the side plates or lower than those positions.

According to the present embodiment, the width (dimension in the same direction as the height direction of the side plates) of the movable rail units is larger than the height of the side plates, and the lower edges of the movable rail units are located at the positions of the lower edges of the side plates or lower than those positions. By positioning the lower edges of the side plates at positions of the lower edges of the movable rail units, or positioning the lower edges of the movable rail units lower than the lower edges of the side plates, an enhanced structure may be obtained which is even harder for the user to touch the side plates and the bottom plate of the container, further preventing the user from getting burned. This can also prevent a user who is short in height (small child in particular) from inadvertently touching the bottom plate of the container.

In the heating cooker according to the present embodiment, the upper edge of the movable rail unit (1031, 1032) opposed to one side plate (1232, 1233) is located higher than a plane defined by the upper edge of the one side plate and the side edge of the bottom plate (1231) from which the other side plate (1233, 1232) extends.

According to the present embodiment, the upper edge of the movable rail unit opposed to one side plate of the opposing side plates of the container is located higher than a plane defined by the upper edge of one side plate and the side edge of the bottom plate from which the other side plate extends. To take out a dish such as a plate placed inside the container after heat cooking, the user inserts a hand from the upper side of the container and grips the dish. A hand or an arm is more likely to touch the side plates of the container in the case where the hand is inserted in a diagonal direction compared to the case where the hand is inserted in a substantially vertical direction with respect to the bottom plate. Thus, the upper edges of the movable rail units are located higher than the plane, which can prevent the user from touching the side plates due to a hand or an arm touching the movable rail units when inserting the hand in a diagonal direction, thereby preventing the user from getting burned.

The heating cooker according to the present embodiment has a thermal conductivity smaller than that of the side plate, and includes a covering member (1081, 1082) which covers the side plate.

According to the present embodiment, a thermal conductivity smaller than that of the side plate is employed, and a covering member which covers the side plate is provided.

The container is made of metal so as to efficiently conduct heat to a portion to be heated. The covering member is made of a material with a thermal conductivity lower than metal, such as synthetic resin, for example. This suppresses a raise in temperature of the covering member, thereby preventing the user from getting burned even if the user touches the covering members.

The heating cooker according to the present embodiment includes a fan (1064, 1091) which feeds out the air toward the container.

According to the present embodiment, the fan for feeding out the air to the container is provided. It is noted that the fan may be configured to operate after heat cooking is completed or when the open/close door is opened. Since the air is fed out to the container (particularly side plates) by the fan, the temperature of the container may be lowered, thereby preventing the user from getting burned even if the user touches the container.

The heating cooker according to the present embodiment includes: a casing (1055) provided with a heating chamber (1013) having an opening (1012) on the front side; a drawer unit (1020) having an open/close door (1021) for the opening and a container (1023) stored in the heating chamber; long fixed rail units (1041, 1042) fixed on the respective side walls of the casing; long movable rail units (1031, 1032) that are fixed to the drawer unit and are slidable with respect to the respective fixed rail units; and a heater (1071, 1072) for heating an object to be heated which is stored in the container. The container is a heating cooker having a rectangular bottom plate (1231) and opposing side plates (1232, 1233), in which the movable rail units are arranged at positions on the outer sides of the respective side plates and where a burn injury caused by the container which is heated by the heater may be prevented.

According to the present embodiment, the heating cooker includes: a casing provided with a heating chamber having an opening on the front side; a drawer unit having an open/close door for the opening and a container stored in the heating chamber; long fixed rail units fixed on the respective side walls of the casing; long movable rail units that are fixed to the drawer unit and are slidable with respect to the respective fixed rail units; and a heater for heating an object to be heated which is stored in the container. The container has a rectangular bottom plate and opposing side plates.

In the heating cooker, the movable rail units are arranged at positions on the outer sides of the side plates so as to be able to prevent a burn injury caused by the container which is heated by the heaters. Movable rail units are arranged on the outer sides of the opposing side plates, respectively, of the container, and the outer sides of the side plates are covered by the movable rail units, which can prevent the user from easily touching the side plates of the container and thus from getting burned. For example, in the case where the open/close door is pulled out after heat cooking to expose the container from the heating chamber, the user may be prevented from inadvertently touching the container which is heated by the heater to a high temperature and thereby getting burned.

According to Embodiment 6, the following effects are produced. The conventional heating cooker is able to heat-cook an object to be heated by storing in a heating chamber a placement table on which a plate or the like having the object to be heat-cooked thereon is placed and propagating microwave generated at a magnetron into the heating chamber through a waveguide. In some heating cookers, the placement table can be connected with the open/close door of the heating chamber so that the heating chamber may be pulled out (see Japanese Patent Application Nos. 1103-45820 and 1106-109257). Furthermore, some conventional heating cookers comprise a container having side plates and a rear plate around the placement table in order to prevent an object to be heated from scattering, falling off the placement table or a liquid substance from spilling over during heat cooking (see Japanese Patent Application Nos. 2005-221081 and 2006-38296). Moreover, some conventional heating cookers comprise a heating source such as a halogen lamp or an infrared heater within the heating chamber (see Japanese Patent Application No. 11-237053).

In the conventional heating cooker, however, the container accommodated in the heating chamber is made of metal, which will have a high temperature when an object to be heated is heated by a heating source such as a halogen lamp or an infrared heater. When the user opens the open/close door to pull out the container and take out a plate or the like from the container, the user's hand may touch a side plate of the container and get a burn injury.

According to Embodiment 6 described above, a heating cooker may be provided which can prevent the user from getting burned.

Embodiments 7 to 10

In the following description, upper, lower, front, back, left and right are used as indicated by the arrows in the drawings.

Embodiment 7

Figure 23:
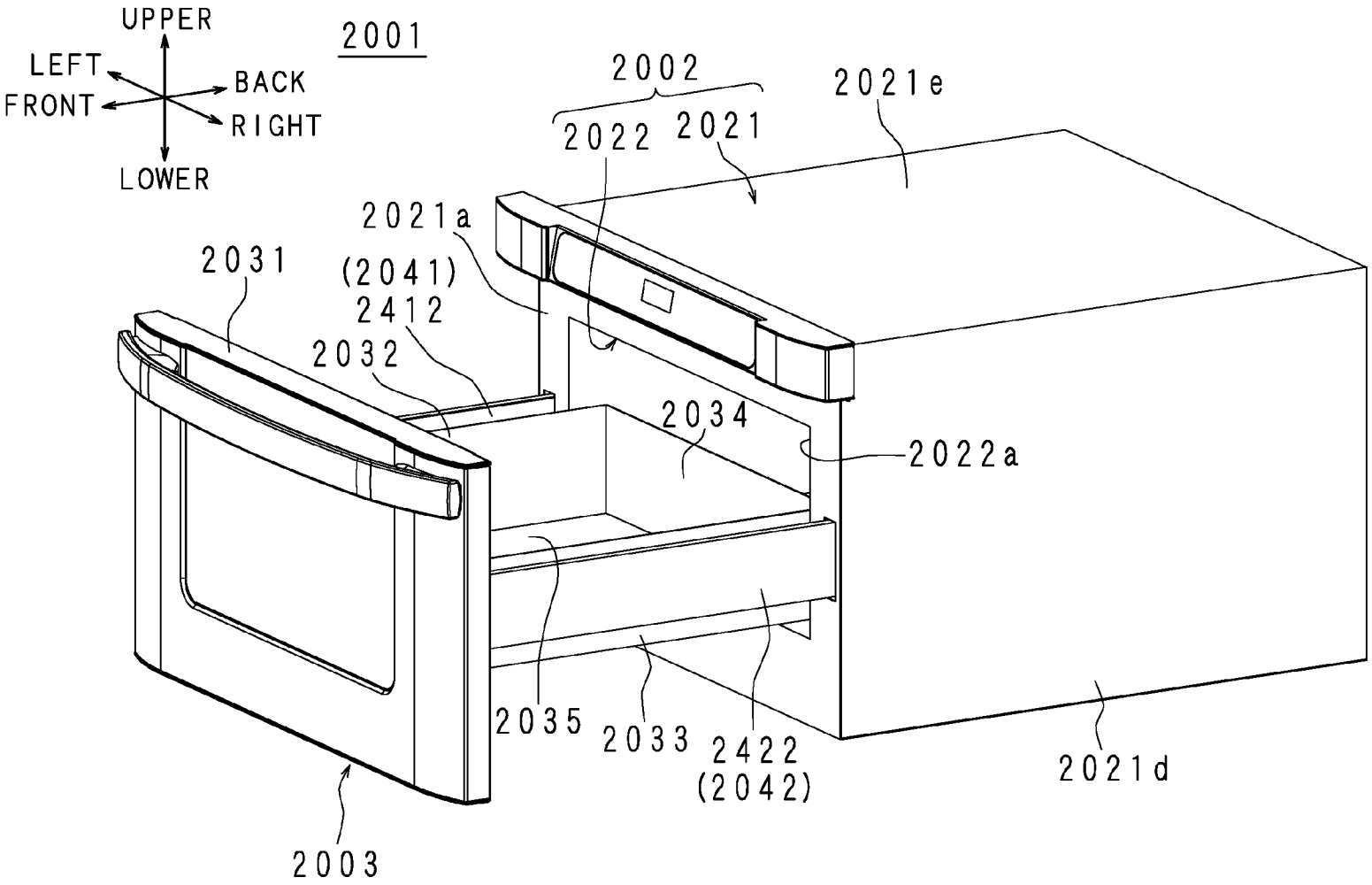
FIG. 23 is a perspective view schematically illustrating the outer structure of the heating cooker according to Embodiment 7 of the present invention.
Figure 24:
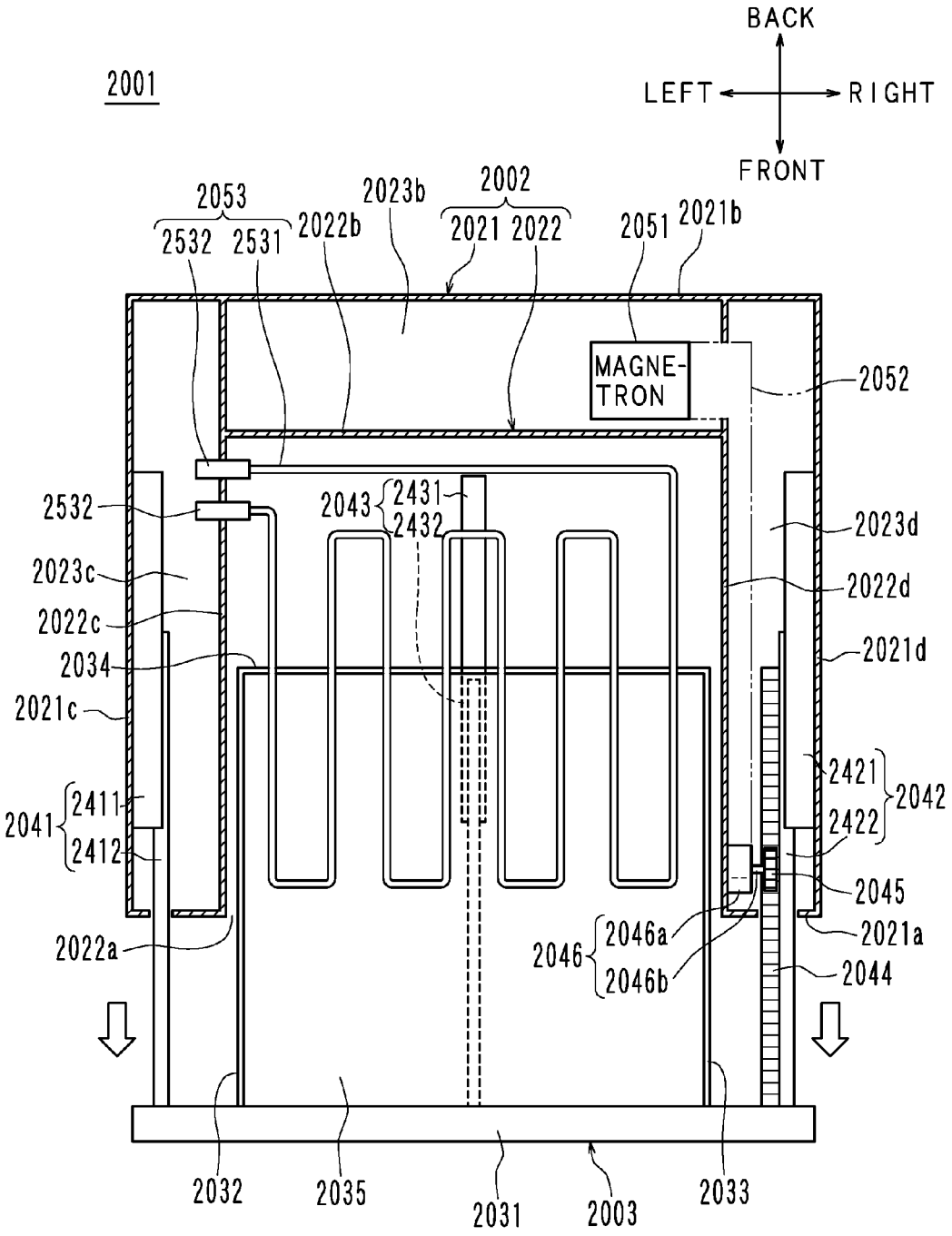
FIG. 24 is a plan view schematically illustrating the internal structure of the heating cooker.
Figure 25:
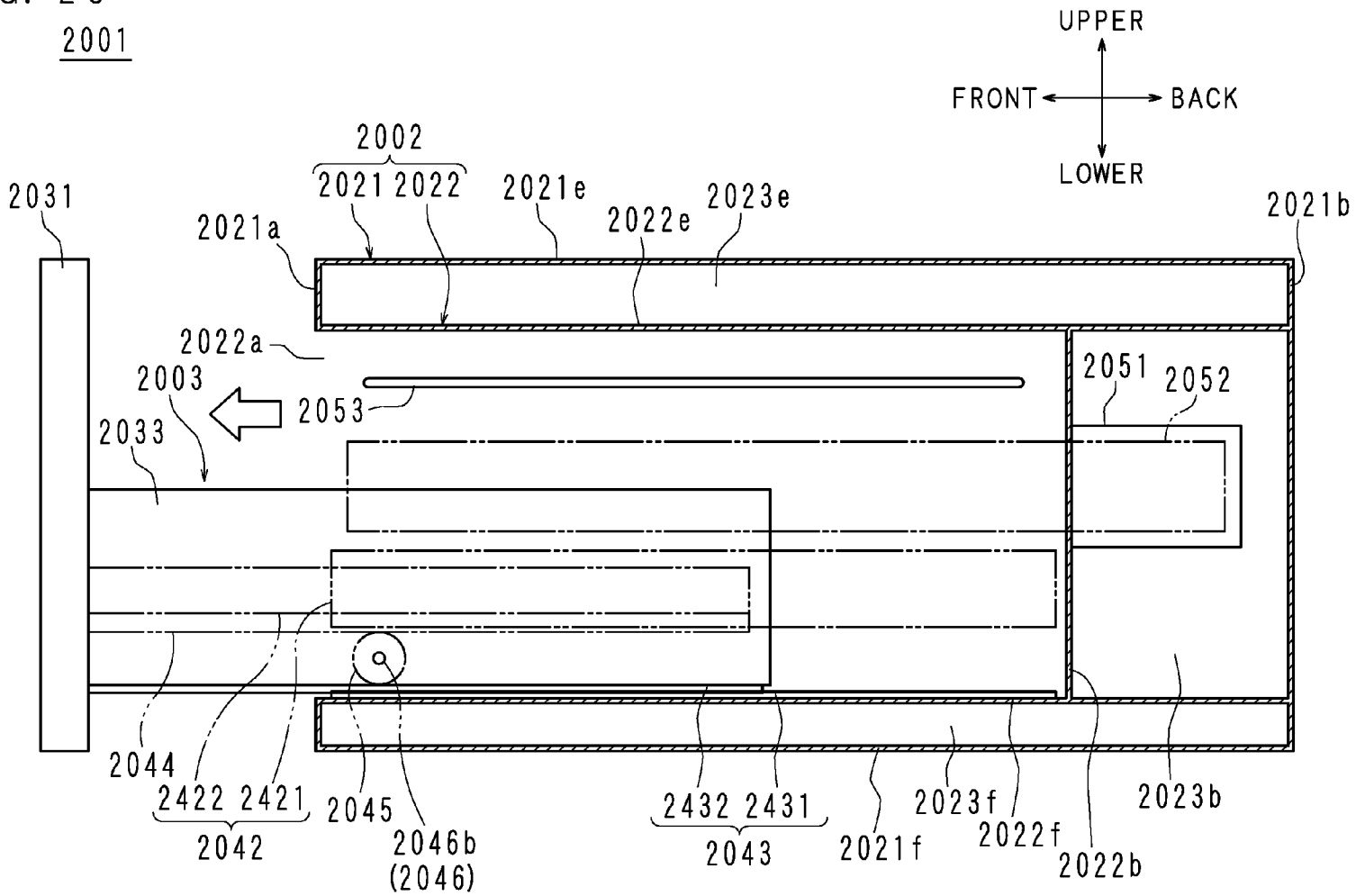
FIG. 25 is a side view schematically illustrating the internal structure of the heating cooker.

FIG. 23 is a perspective view schematically illustrating the outer structure of the heating cooker 2001 according to Embodiment 7 of the present invention. FIGS. 24 and 25 are a plan view and a side view schematically illustrating the internal structure of the heating cooker 2001. The heating cooker 2001 constitutes a part of a built-in kitchen. The heating cooker 2001 comprises a cooker body 2002, a storage 2003, slide rails 2041-2043, a rack gear 2044, a pinion gear 2045, a motor 2046, a magnetron 2051, a waveguide 2052 and a heater 2053.

The cooker body 2002 has a casing 2021 in the shape of a rectangular parallelepiped and a heating chamber 2022 in the shape of a horizontally-arranged bottomed rectangular tube which is formed inside the casing 2021.

The casing 2021 integrally includes a front wall 2021*a*, a rear wall 2021*b*, a left side wall 2021*c*, a right side wall 2021*d*, a top wall 2021*e* and a bottom wall 2021*f*, each of which is in a rectangular shape and is made of metal.

The heating chamber 2022 has a rectangular opening 2022*a*, and integrally includes a rear wall 2022*b*, a left side wall 2022*c*, a right side wall 2022*d*, a top wall 2022*e* and a bottom wall 2022*f*, each of which is in a rectangular shape and is made of metal. The opening 2022*a* of the heating chamber 2022 is formed at a middle part in the upper-lower and left-right directions on the front wall 2021*a* of the casing 2021. A waveguide opening (not illustrated) is formed at the right side wall 2022*d*.

The regions which are inside the casing 2021 and outside the heating chamber 2022 and which correspond to the rear wall 2022*b* to the right side wall 2022*d* will be referred to as low temperature regions 2023*b* to 2023*d* in the description below.

The regions which are inside the casing 2021 and outside the heating chamber 2022 and which correspond to the top wall 2022*e* and the bottom wall 2022*f* will hereinafter be referred to as high temperature regions 2023*e*, 2023*f* in the description below.

The storage 2003 has the shape of a drawer capable of storing an object to be cooked (food, for example), and integrally includes a door 2031 corresponding to the front board of the drawer, side plates 2032, 2033 corresponding to right and left end boards, a rear plate 2034 corresponding to a back board, and a bottom plate 2035 corresponding to a bottom board.

The upper surface of the bottom plate 2035 is a surface on which an object to be cooked is placed.

The length in the front-back direction of each of the side plates 2032, 2033 and the bottom plate 2035 is shorter than the depth of the heating chamber 2022. The length in the left-right direction of each of the rear plate 2034 and the bottom plate 2035 is shorter than the length in the left-right direction of the opening 2022*a* of the heating chamber 2022. The length in the upper-lower direction of each of the side plate 2032 to the rear plate 2034 is shorter than the length in the upper-lower direction of the opening 2022*a*. The length in the upper-lower and left-right directions of the door 2031 is longer than the length in the upper-lower and left-right directions of the opening 2022*a*.

In the case where the door 2031 closes the opening 2022*a* of the heating chamber 2022, the side plates 2032, 2033, rear plate 2034 and bottom plate 2035 are accommodated in the heating chamber 2022. No microwave leaks from the heating chamber 2022 with the opening 2022*a* closed by the door 2031.

The storage 2003 is supported by the slide rails 2041-2043 so as to be pulled in/out with respect to the inside of the heating chamber 2022. The protruding/retracting directions with respect to the heating chamber 2022 of the storage 2003 correspond to the frontward direction (outlined arrows in FIGS. 24 and 25)/backward direction.

The slide rails 2041, 2042 are arranged in the low temperature regions 2023*c*, 2023*d*. The slide rail 2043 is arranged on the inner surface of the bottom wall 2022*f* of the heating chamber 2022.

The slide rail 2041 includes a fixed rail 2411 and a movable rail 2412. The fixed rail 2411 is attached to the inner surface of the left side wall 2021*c* of the casing 2021 in a horizontal arrangement in the front-back direction. The movable rail 2412 is attached to the right side of the fixed rail 2411 so as to be slidable in the front-back direction, and penetrates the opening formed at the front wall 2021*a* of the casing 2021.

The slide rail 2042 includes a fixed rail 2421 and a movable rail 2422. The fixed rail 2421 is attached to the inner surface of the right side wall 2021*c* of the casing 2021 in a horizontal arrangement in the front-back direction. The movable rail 2422 is attached to the left side of the fixed rail 2411 so as to be slidable in the front-back direction, and penetrates the opening formed at the front wall 2021*a* of the casing 2021.

The front ends of the respective movable rails 2412, 2422 of the slide rails 2041, 2042 are attached to the door 2031 of the storage 2003.

The slide rail 2043 includes a fixed rail 2431 and a movable rail 2432. The fixed rail 2431 is attached to the inner surface of the bottom wall 2022*f* of the heating chamber 2022 in a horizontal arrangement in the front-back direction. The movable rail 2432 is attached to the upper side of the fixed rail 2411 so as to be slidable in the front-back direction, and penetrates the opening (not illustrated) formed at the front wall 2021*a* of the casing 2021.

The movable rail 2432 of the slide rail 2043 is attached to the outer surface of the bottom plate 2035 of the storage 2003.

Since the slide rail 2043 is located inside the heating chamber 2022, it is made of a material with a thermal resistance higher than that of the slide rails 2041, 2042 located outside the heating chamber. For example, the slide rails 2041, 2042 are made of synthetic resin, whereas the slide rail 2043 is made of metal.

The rack gear 2044 and the pinion gear 2045 are made of synthetic resin, and are located in the low temperature region 2023*d*.

The rack gear 2044 is attached to the movable rail 2422 of the slide rail 2042 in a horizontal arrangement in the front-back direction. The rack gear 2044 has teeth facing downward.

The pinion gear 2045 is engaged with the rack gear 2044 from the lower side in the vertical arrangement in the front-back direction.

However, FIG. 24 illustrates, for the sake of clarity, the state where the teeth of the rack gear 2044 face upward, and the pinion gear 2045 is engaged with the rack gear 2044 from the upper side.

The motor 2046 is an actuator for moving in/out the storage 2003, and is located in the low temperature region 2023*d* in such an arrangement that an output shaft 2046*b* protrudes from a housing 2046*a* toward right. The housing 2046*a* may be placed at the inside of the bottom wall 2021*f* of the casing 2021, or may be attached to the outer surface of the right side wall 2022*d* of the heating chamber 2022. A heat insulating unit (not illustrated) may also be arranged so as to suppress the transfer of heat from the casing 2021 or heating chamber 2022 to the housing 2046*a*.

The pinion gear 2045 is attached to the output shaft 2046*b* of the motor 2046. As the output shaft 2046*b* of the motor 2046 rotates, the pinion gear 2045 also rotates along therewith.

The rotation movement of the pinion gear 2045 corresponds to linear movement in the front-back direction of the rack gear 2044. Here, the movable rail 2422 of the slide rail 2042 slides along the fixed rail 2421. The sliding of the movable rail 2422 is transmitted to the slide rails 2041, 2043 through the storage 2003, and the movable rails 2412, 2432 slide along the fixed rails 2411, 2431. As the movable rails 2412-2432 slide along the fixed rails 2411-2431, the storage 2003 protrudes from the inside of the heating chamber 2022 and is retracted into heating chamber 2022. As the storage 2003 moves in and out, the rack gear 2044 also moves in and out with respect to the low temperature region 2023*d*.

The slide rails 2041, 2042 correspond to two side slide rails included in the conventional heating cooker of the drawer type, whereas the slide rail 2043 corresponds to the downside slide rail included in the conventional heating cooker of the drawer type. In the conventional heating cooker of the drawer type, components corresponding to the rack gear 2044, pinion gear 2045 and motor 2046 are arranged with respect to the downside slide rail, while the rack gear 2044, pinion gear 2045 and motor 2046 are arranged with respect to one of two side slide rails in the heating cooker 2001.

The fixed rails 2411, 2421 of the slide rails 2041, 2042 may be attached to the outer surfaces of the left side wall 2022*c* and the right side wall 2022*d* of the heating chamber 2022 via a heat insulating unit (not illustrated). Here, the motor 2046 is attached to the inner surface of the left side wall 2021*c* of the casing 2021, for example.

Moreover, in place of the slide rails 2041-2043, two left and right slide rails corresponding to the slide rails 2041, 2042 may support the storage 2003. Here, it is not necessary to include the slide rail 2043 with a high thermal resistance.

The magnetron 2051 is an electromagnetic wave generating unit which generates microwave. The magnetron 2051 is located in the low temperature region 2023*b*. It is noted that the magnetron 2051 may also be located in the low temperature region 2023*d*.

The waveguide 2052 extends in the low temperature regions 2023*b*, 2023*d* from the magnetron 2051 to the waveguide opening formed at the right side wall 2022*d* of the heating chamber 2022. The microwave generated by the magnetron 2051 is guided by the waveguide 2052, and propagates through the waveguide opening to the inside of the heating chamber 2022.

It is noted that the waveguide 2052 may alternatively extend from the magnetron 2051 to an antenna chamber (not illustrated) located in the low temperature region 2023*b*. With the waveguide 2052, the microwave guided to the antenna chamber from the magnetron 2051 is scattered into the heating chamber 2022 by the movable antenna (not illustrated) stored in the antenna chamber.

The heater 2053 integrally includes a heater body 2531 constituted by one metal tube which is appropriately bent, and tubular non-heat generating units 2532, 2532 in a horizontal arrangement attached to one end and the other end of the heater body 2531.

The non-heat generating units 2532, 2532 penetrate through the left side wall 2022*c* of the heating chamber 2022 and are supported by the left side wall 2022*c*. The feed line (not illustrated) feeding power to the heater body 2531 is arranged outside the heating chamber 2022, and is electrically connected to the heater body 2531 through the inside of the non-heat generating parts 2532, 2532.

The heater body 2531 has such a shape that one of the four sides of a rectangle meanders inside the rectangle.

The heater 2053 is located near the top wall 2022*e* of the heating chamber 2022 (at least closer to the top wall 2022*e* than the middle part in the upper-lower direction of the heating chamber 2022). The heater body 2531 is so arranged as to be in parallel with the placement surface of the storage 2003 and higher than the height of an object to be cooked which is placed on the placement surface of the storage 2003.

At a position inside the heating chamber 2022 that is closer to the top wall 2022*e* than the heater 2053, a heat reflecting unit (not illustrated) which reflects heat generated by the heater 2053 downward.

The heater body 2531 may also be configured using a glass tube.

Unlike the conventional drawer-type heating cooker, the heating cooker 2001 as described above also comprises the heater 2053 in addition to the magnetron 2051, waveguide 2052 and the like, and is therefore configured as a multi-functional type having, for example, functions of grilling and/or baking, not only the function of microwaving.

It is noted that the heating cooker 2001 may also have a function of a convection oven. Here, the heating cooker 2001 further comprises an air blower, and an air circulation path for suctioning out the air inside the heating chamber heated by the heater 2053 and blowing the suctioned air into the heating chamber by the air fed by the air blower.

Since the heat generated by the heater 2053 is easily transmitted downward in particular, a high temperature region 2023*f* has the highest temperature and a high temperature region 2023*e* near the heater 2053 has the next highest temperature while the heater 2053 is generating heat. Compared to the high temperature regions 2023*e* and 2023*f*, low temperature regions 2023*b* to 2023*d* have lower temperatures.

The rack gear 2044, pinion gear 2045, motor 2046 and magnetron 2051 have low thermal resistance and are inexpensive. If these components are arranged in the high temperature regions 2023*e*, 2023*f*, inconveniences (melting of the rack gear 2044 or pinion gear 2045, damage in the motor 2046 or the like) due to high temperature may occur. However, these are arranged in the low temperature regions 2023*b*-2023*d*, causing no particular problem.

The waveguide 2052 is arranged in the low temperature regions 2023*b*, 2023*d*. This is because inconveniences due to high temperature may occur on the magnetron 2051 by the heat transmitted to the magnetron 2051 through the waveguide 2052 if the waveguide 2052 is arranged in the high temperature region 2023*e*.

It is noted that the waveguide opening of the heating chamber 2022 may be formed at the rear wall 2022*b* or bottom wall 2022*f*. Here, the waveguide 2052 is arranged in the low temperature regions 2023*b* or the high temperature region 2023*f*, extending from the magnetron 2051 to the waveguide opening formed at the heating chamber 2022.

It is also possible to provide multiple waveguides 2052. For example, a waveguide opening is formed at each of the left side wall 2022*c* and the right side wall 2022*d* of the heating chamber 2022, and two waveguides 2052, 2052 are arranged in the low temperature regions 2023*b*, 2023*d* from the magnetron 2051 to the waveguide opening of the left side wall 2022*c* and the right side wall 2022*d*.

It is not necessary for the heating cooker 2001 to comprise the rack gear 2044, pinion gear 2045, motor 2046 and magnetron 2051 that have high thermal resistance and are expensive, as well as the waveguide 2052 which has low thermal conductivity, so that the heating cooker 2001 may be manufactured at low cost. If the rack gear 2044, pinion gear 2045, motor 2046, magnetron 2051 and waveguide 2052 are common to those included in the conventional drawer-type heating cooker, the manufacturing cost of the heating cooker 2001 may further be reduced.

Embodiment 8

Figure 26:
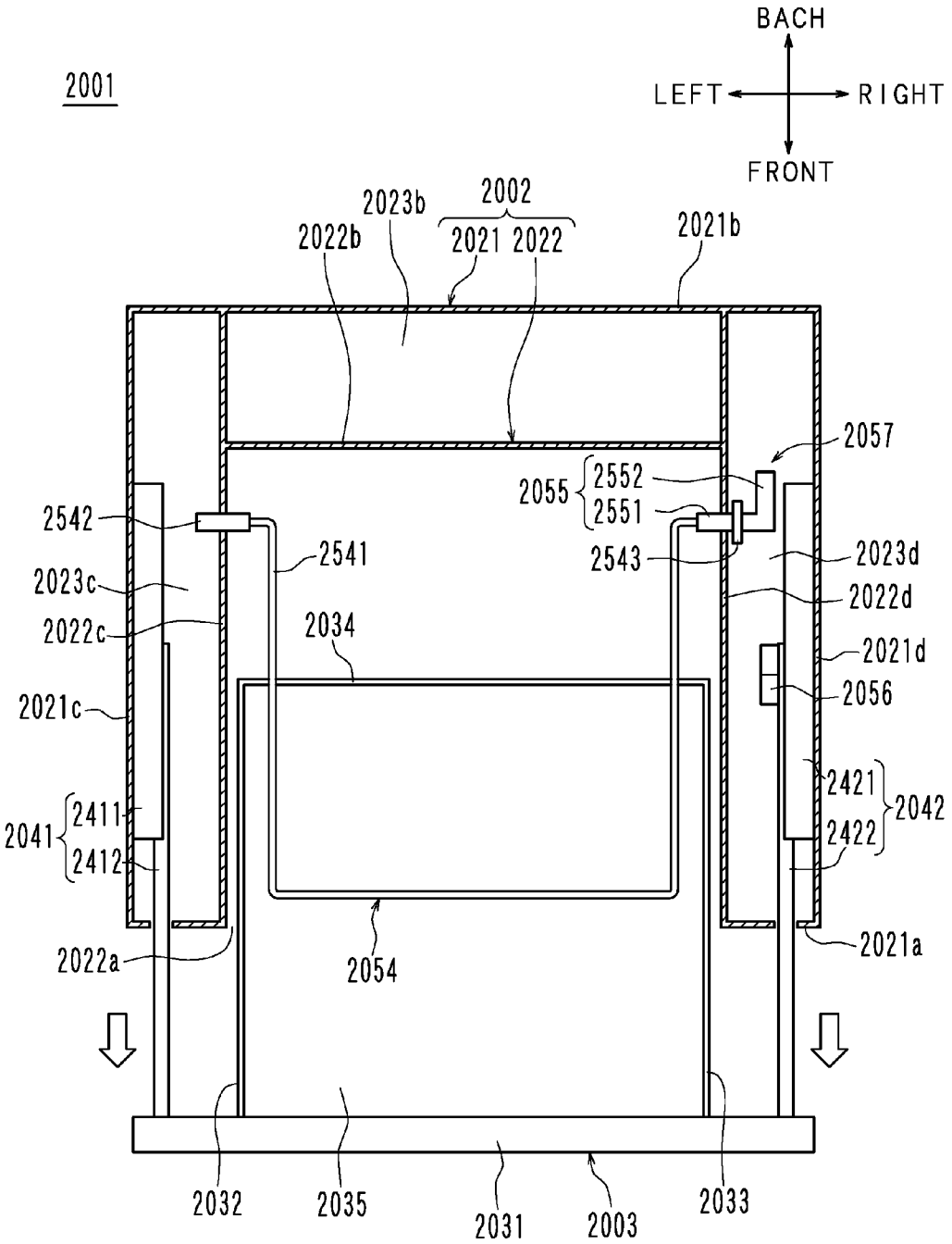
FIG. 26 is a plan view schematically illustrating the internal structure of the heating cooker according to Embodiment 8 of the present invention.

FIG. 26 is a plan view schematically illustrating the internal structure of the heating cooker 2001 according to Embodiment 8 of the present invention.

Figure 27:
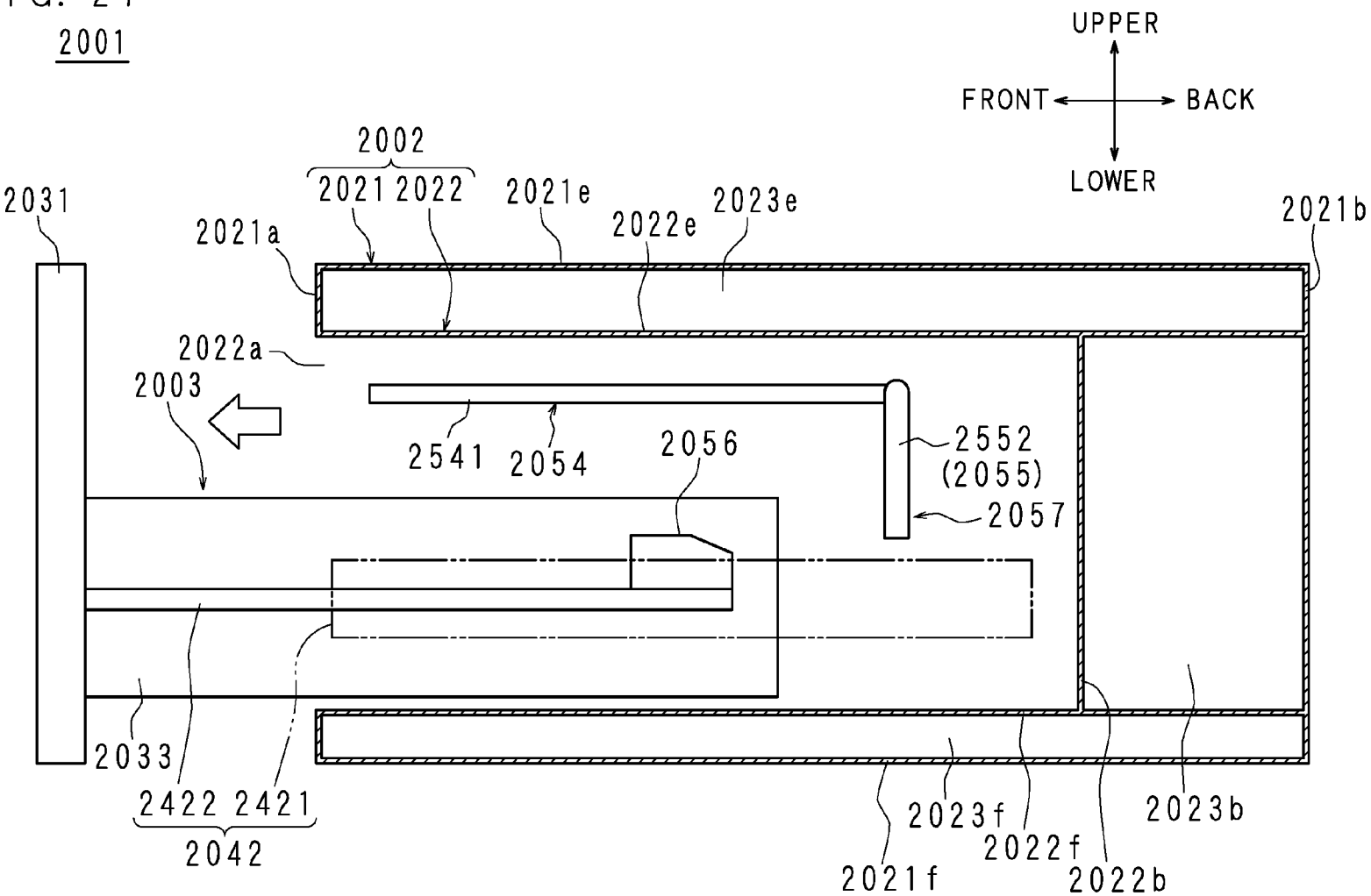
FIG. 27 is a side view schematically illustrating the internal structure (with the storage pulled out) of the heating cooker.
Figure 28:
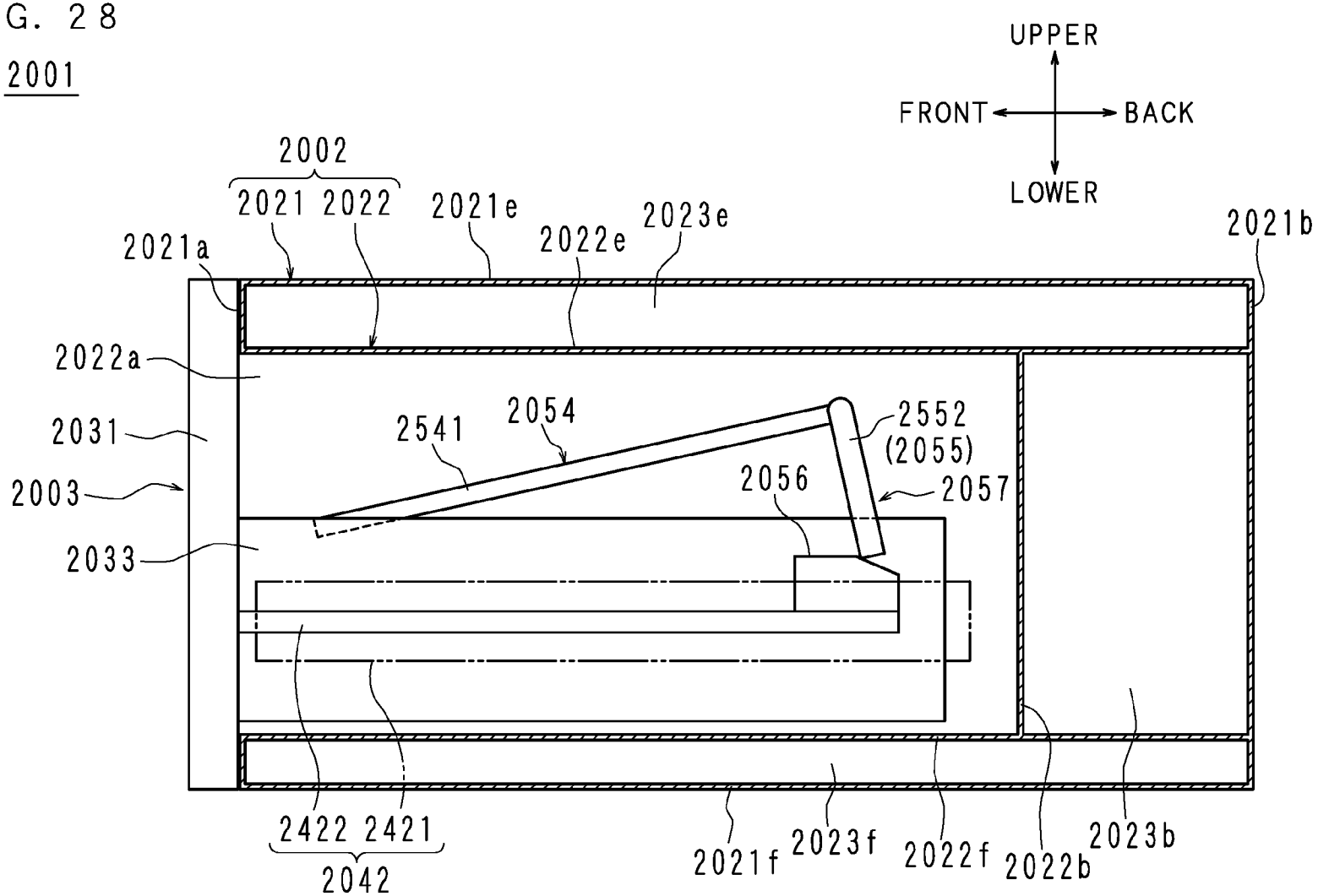
FIG. 28 is a side view schematically illustrating the internal structure (with the storage retracted) of the heating cooker.

FIGS. 27 and 28 are side views schematically illustrating the internal structure of the heating cooker 2001. FIG. 27 illustrates the case where the storage 2003 protrudes from the inner side of the heating chamber 2022, whereas FIG. 28 illustrates the case where the storage 2003 is retracted into the heating chamber 2022.

FIG. 26 as well as FIGS. 27 and 28 correspond to FIG. 22 and FIG. 25 in Embodiment 1. In FIGS. 26-28, however, the slide rail 2043, rack gear 2044, pinion gear 2045, motor 2046, magnetron 2051 and waveguide 2052 are not illustrated.

The heating cooker 2001 according to the present embodiment has a structure substantially similar to the heating cooker 2001 according to Embodiment 7. In the description below, the difference between the present embodiment and Embodiment 7 will be described, while the parts corresponding to Embodiment 7 will be denoted by the same reference codes and will not be described here.

The heating cooker 2001 comprises a heater 2054 instead of the heater 2053 according to Embodiment 7. The heater 2053 is a fixed type, whereas the heater 2054 is a movable type.

The heater 2054 integrally includes a heater body 2541 constituted by one metal tube which is appropriately bent, non-heat generating units 2542, 2055 attached to one end and the other end of the heater body 2541, and a biasing unit 2543.

The heater body 2541 corresponds to the heater body 2531 in Embodiment 7, while having a U-shape. The heater body 2541 is movably supported by the left side wall 2022*c* and the right side wall 2022*d* of the heating chamber 2022 via the non-heat generating units 2542, 2055.

The heater body 2541 oscillates as the storage 2003 moves in and out. The heater body 2541 oscillates within an area between a position near the top wall 2022*e* of the heating chamber 2022 (at least closer to the top wall 2022*e* than the middle part in the upper-lower direction of the heating chamber 2022, e.g., the arrangement position of the heater body 2531 in Embodiment 7) and the placement surface (upper surface of the bottom plate 2035) side of the object to be cooked in the storage 2003.

The heater body 2541 when on the top wall 2022*e* side is so arranged as to be in parallel with the placement surface of the storage 2003 and higher than the height of an object to be cooked which is placed on the placement surface of the storage 2003.

The heater body 2541 when on the placement surface side is inclined backward with the front side lower than that in the case where the heater body 2541 is on the top wall 2022*e* side. The heater body 2541 on the placement surface side surrounds the front as well as the left and right sides of the object to be cooked which is placed on the placement surface of the storage 2003.

The non-heat generating part 2542 has a tubular shape in the horizontal arrangement. The non-heat generating part 2542 penetrates through the left side wall 2022*c* of the heating chamber 2022 and is supported by the left side wall 2022*c* so as to be rotatable around its own axis.

The non-heat generating part 2055 integrally includes a rotating part 2551 and an oscillating part 2552.

The rotating part 2551 has a tubular shape in the horizontal arrangement. The rotating part 2551 penetrates through the right side wall 2022*d* of the heating chamber 2022 and is supported by the right side wall 2022*d* so as to be rotatable around its own axis. As the non-heat generating part 2542 and rotating part 2551 rotate, the heater body 2541 oscillates.

The oscillating part 2552 protrudes from the right end of the rotating part 2551 (i.e., the end on the outer side of the heating chamber 2022 in the rotating part 2551) in the low temperature region 2023*d*. The protruding direction of the oscillating part 2552 is orthogonal to the axial direction of the rotating part 2551, and is directed substantially downward. As the rotating part 2551 rotates, the oscillating part 2552 oscillates between the first position at which the oscillating part 2552 is in the vertical arrangement (see FIG. 27) and the second position at which it is inclined forward (see FIG. 28).

The biasing part 2543 is constituted by, for example, a spiral coil, and is attached to the rotating part 2551 in the low temperature region 2023*d*. The biasing part 2543 biases the rotating part 2551 such that the rotating part 2551 rotates in one predetermined direction. As the rotating part 2551 rotates in one predetermined direction, the heater body 2541 oscillates to the top wall 2022*e* side of the heating chamber 2022, while the oscillating part 2552 oscillates to the first position side.

The feed line (not illustrated) feeding power to the heater body 2541 is arranged outside the heating chamber 2022, and is electrically connected to the heater body 2541 through the inside of the non-heat generating parts 2542, 2055.

A contact/separation part 2056 is provided at the movable rail 2422 of the slide rail 2042.

The contact/separation part 2056 has the shape of a vertically-arranged plate along the front-back direction, and protrudes upward from the back end of the movable rail 2422. At the upper part of the contact/separation part 2056, a flat surface is formed from the front side to the middle part in the front-back direction, and an inclined surface which is inclined toward the back side is formed from the middle part in the front-back direction to the rear part.

The contact/separation part 2056 moves away from/toward the oscillating part 2552 of the non-heat generating part 2055 along with the frontward/backward movement of the movable rail 2422 (i.e., moving out/in of the storage 2003). When the door 2031 is closed by the storage 2003 being retracted, the back end of the inclined surface of the contact/separation part 2056 makes contact with the lower end of the oscillating part 2552, and an external force is gradually added from the separation/contact part 2056 to the oscillating part 2552 by the movable rail 2422 further moving backward. The external force prevails against the biasing force of the bias part 2543, oscillates the oscillating part 2552 to the second position side, and rotates the rotating part 2551 through the oscillating part 2552 in a direction opposite to one predetermined direction. As a result, the heater body 2541 oscillates to the placement surface side of the storage 2003 which is retracted into the heating chamber 2022.

The biasing part 2543, oscillating part 2552 and contact/separation part 2056 serve as an oscillating mechanism 2057 which oscillates the heater 2054, in coordination with the storage 2003 moving in/out, to the top wall 2022*e* side of the heating chamber 2022 or to the stored position side of the object to be cooked.

The heating cooker 2001 as described above produces a functional effect similar to that for the heating cooker 2001 in Embodiment 7, and moreover, appropriately heats an object to be cooked by the movable heater 2054.

Since the heater 2054 automatically oscillates as the storage 2003 moves in/out, it is not necessary for the user to manually oscillate the heater 2054. That is, the convenience for the user is enhanced. According to the present embodiment, the storage 2003 is driven by the motor 2046 to be moved in/out. This eliminates the need for a separate actuator for oscillating the heater 2054.

Such a configuration that a separate actuator for oscillating the heater 2054 may also be provided.

In the case where the storage 2003 is retracted into the heating chamber 2022, the contact/separation unit 2056 makes contact with the oscillating part 2552 to oscillate the heater 2054 to the placement surface side of the heating chamber 2022 through the oscillating part 2552. Here, as the separation distance between the heater 2054 and the object to be cooked placed on the placement surface of the heating chamber 2022 is shortened, the object to be cooked may efficiently be heated.

If, on the other hand, the storage 2003 protrudes from the inside of the heating chamber 2022, the contact/separation part 2056 is separated from the oscillating part 2552, and thus the biasing part 2543 oscillates the heater 2054 to the top wall 2022*e* side of the heating chamber 2022. Here, the separation distance between the heater 2054 and the object to be cooked placed on the placement surface of the heating chamber 2022 is increased, thereby suppressing the interference by the heater 2054 on the object to be cooked which is moved in/out with respect to the inside of the heating chamber 2022 together with the storage 2003.

Embodiment 9

Figure 29:
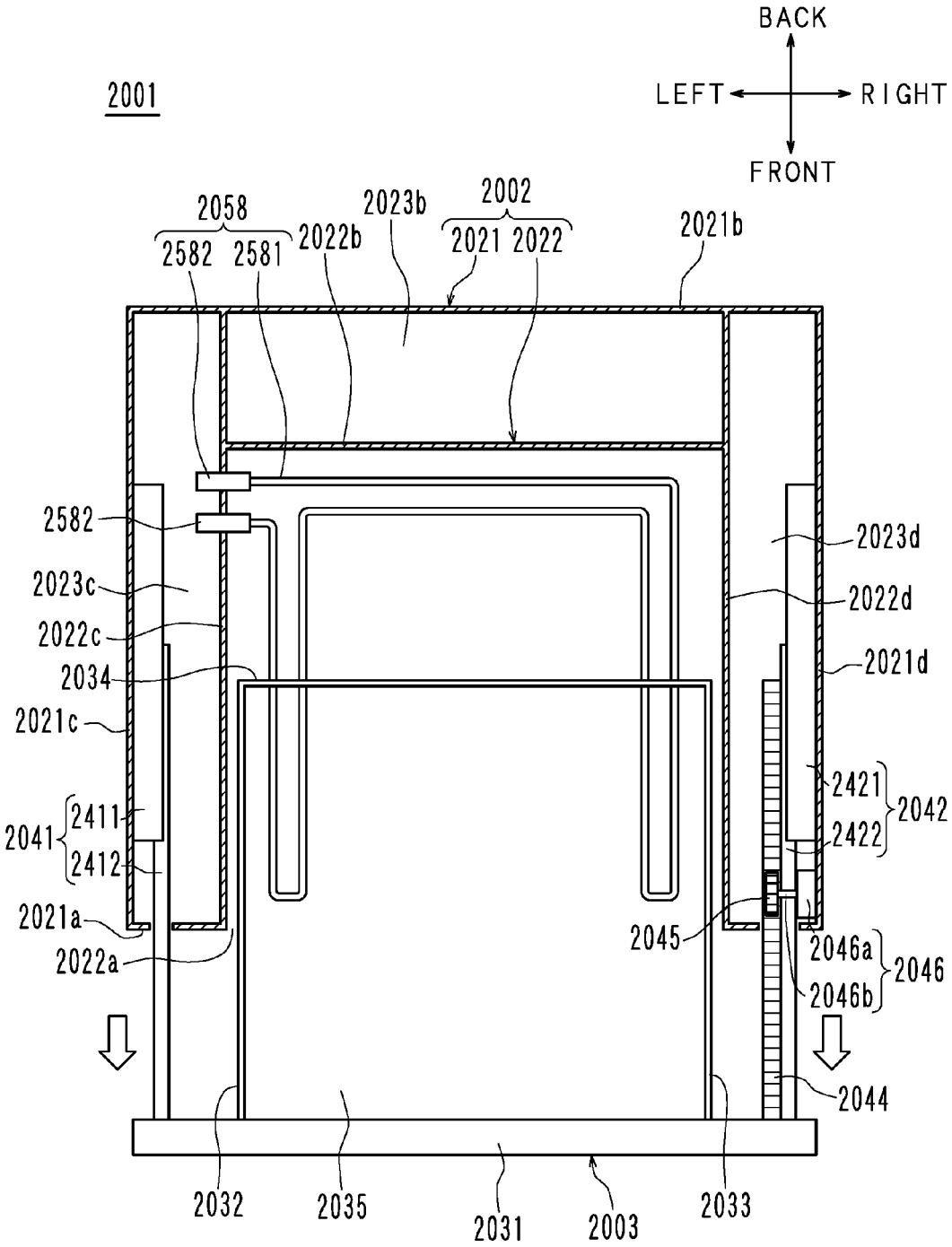
FIG. 29 is a plan view schematically illustrating the internal structure of the heating cooker according to Embodiment 9 of the present invention.
Figure 30:
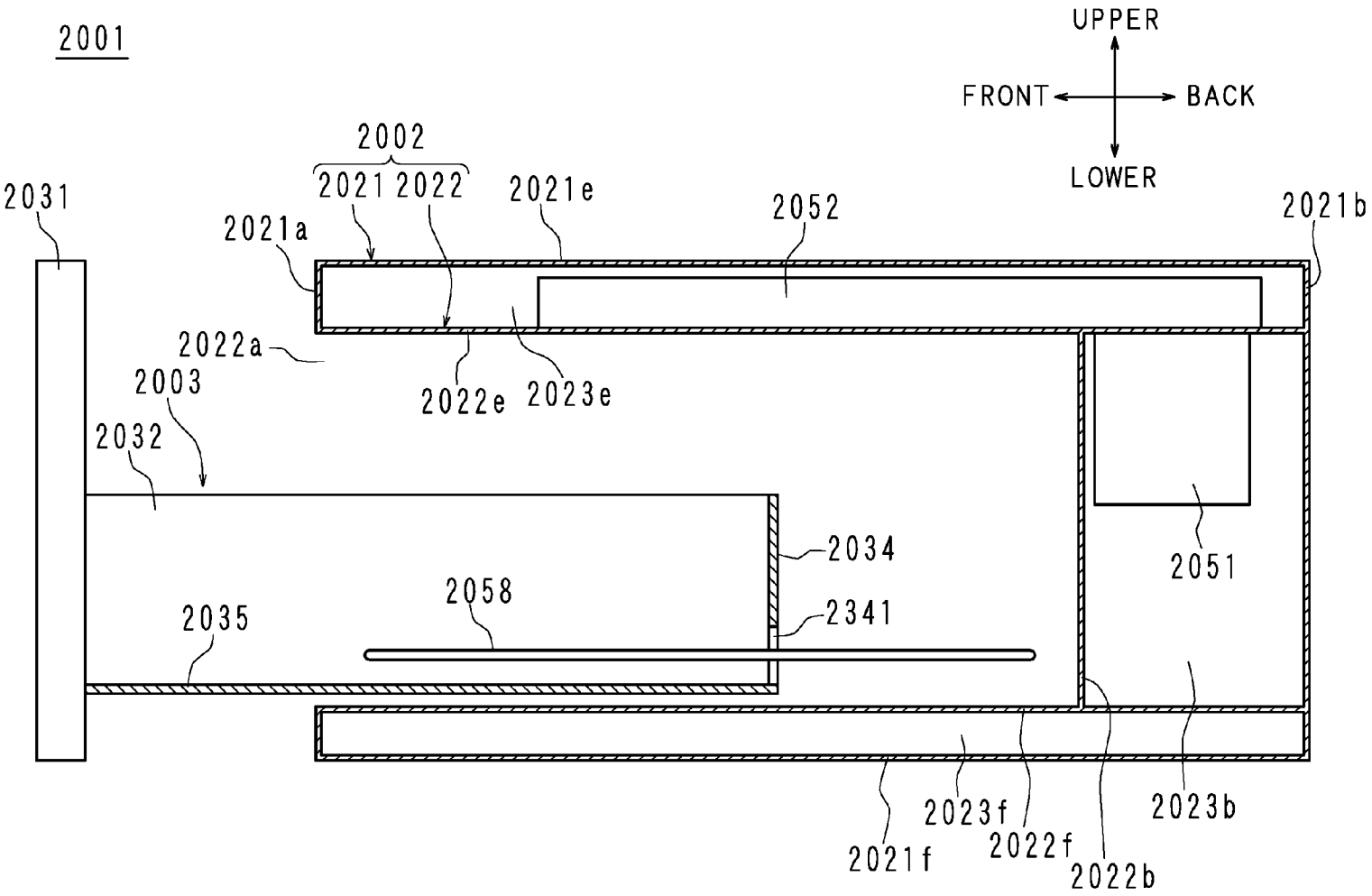
FIG. 30 is a side view schematically illustrating the internal structure of the heating cooker.

FIGS. 29 and 30 are a plan view and a side view schematically illustrating the internal structure of the heating cooker 2001 according to Embodiment 9 of the present invention.

FIGS. 29 and 30 correspond to FIG. 25 in Embodiment 1. In FIGS. 29 and 30, however, the slide rail 2043 is not illustrated. Moreover, FIG. 29 illustrates, for the sake of clarity, the state where the teeth of the rack gear 2044 face upward, and the pinion gear 2045 is engaged with the rack gear 2044 from the upper side. Furthermore, the magnetron 2051 is not illustrated in FIG. 29, while the slide rail 2042, rack gear 2044, pinion gear 2045 and motor 2046 are not illustrated in FIG. 30.

The heating cooker 2001 according to the present embodiment has a structure substantially similar to the heating cooker 2001 according to Embodiment 7. In the description below, the difference between the present embodiment and Embodiment 7 will be described, while the parts corresponding to Embodiment 7 will be denoted by the same reference codes and will not be described here.

The waveguide opening of the heating chamber 2022 is formed at the top wall 2022*e*.

The back plate 2034 of the storage 2003 has an opening 2341 at a lower part thereof.

The motor 2046 is located in the low temperature region 2023*d* in such an arrangement that an output shaft 2046*b* protrudes from a housing 2046*a* toward left. The housing 2046*a* is attached to the inner surface of the right side wall 2021*d* of the casing 2021.

The waveguide 2052 is arranged in the low temperature region 2023*b* and the high temperature region 2023*e* from the magnetron 2051 to the waveguide opening formed at the top wall 2022*e* of the heating chamber 2022.

The heating cooker 2001 comprises a heater 2058 instead of the heater 2053 according to Embodiment 7.

The heater 2058 integrally includes a heater body 2581 and non-heat generating parts 2582, 2582. These components correspond to the heater body 2531 and the non-heat generating parts 2532, 2532 in Embodiment 7.

The heater body 2581 has a traversable double U-shape.

The heater 2058 is located closer to the bottom wall 2022*f* than the middle part in the upper-lower direction of the heating chamber 2022. The heater body 2581 penetrates through the opening 3341 of the back plate 2034 of the storage 2003, and is arranged in parallel with and close to the placement surface of the storage 2003. If the storage 2003 is retracted into the heating chamber 2022, the heater body 2581 surrounds the back as well as the left and right sides of the object to be cooked which is placed on the placement surface of the storage 2003.

The heating cooker 2001 as described above produces a functional effect similar to that in Embodiment 7.

Meanwhile, the waveguide 2052 according to the present embodiment is located in the high temperature region 2023*e*. However, the waveguide 2052 has a higher thermal resistance compared to, for example, the rack gear 2044, pinion gear 2045 and motor 2046. Moreover, since the heater 2058 is separated from the high temperature region 2023*e*, the temperature of the high temperature region 2023*e* is lower than that in Embodiment 7 even when the heater 2058 is generating heat. Hence, inconveniences due to high temperature will not occur on the magnetron 2051 even if the heat is transmitted to the magnetron 2051 through the waveguide 2052.

It is noted that the arrangement of the waveguide 2052 may be the same as the arrangement in Embodiment 7.

Embodiment 10

Figure 31:
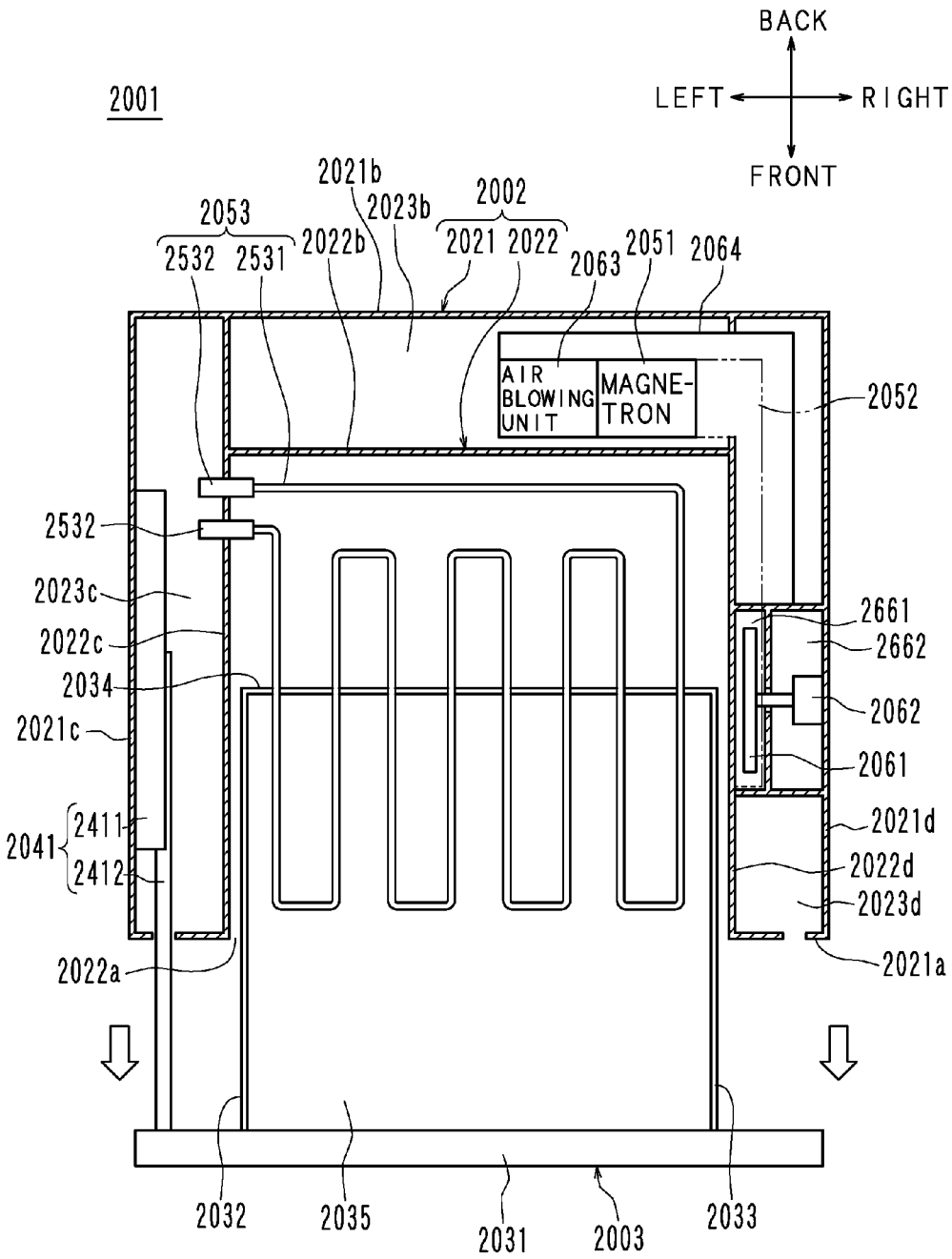
FIG. 31 is a plan view schematically illustrating the internal structure of the heating cooker according to Embodiment 10 of the present invention.

FIG. 31 is a plan view schematically illustrating the internal structure of a heating cooker 2001 according to Embodiment 10 of the present invention.

FIG. 31 corresponds to FIG. 24 in Embodiment 7. However, the slide rails 2042, 2043, rack gear 2044, pinion gear 2045 and motor 2046 are not illustrated.

The heating cooker 2001 according to the present embodiment has a structure substantially similar to the heating cooker 2001 according to Embodiment 7. In the description below, the difference between the present embodiment and Embodiment 7 will be described, while the parts corresponding to Embodiment 7 will be denoted by the same reference codes and will not be described here.

The heating cooker 2001 comprises a movable antenna 2061, a drive unit 2062, an air blowing unit 2063, a ventilation path 2064, an antenna chamber 2661 and a drive chamber 2662.

The antenna chamber 2661 and the drive chamber 2662 are arranged adjacent to each other in the left-right direction and are located in the low temperature region 2023*d*.

In the antenna chamber 2661, the movable antenna 2061 having the shape of a disc in the vertical arrangement is opposed to the right side wall 2022*d* of the heating chamber 2022.

The drive unit 2062 is arranged in the drive chamber 2662. The drive unit 2062 according to the present embodiment is configured by a motor. The output shaft of the drive unit 2062 penetrates a partition wall which partitions the antenna chamber 2661 from the drive chamber 2662, and is connected to the central position of the movable antenna 2061 inside the antenna chamber 2661. The drive unit 2062 drives the movable antenna 2061. That is, when the output shaft of the drive unit 2062 rotates, the movable antenna 2061 rotates.

The waveguide 2052 is arranged in the low temperature regions 2023*b*, 2023*d* from the magnetron 2051 to the antenna chamber 2661. The microwave generated by the magnetron 2051 is guided by the waveguide 2052, and is scattered into the heating chamber 2022 by the movable antenna 2061 which rotates in the antenna chamber 2661.

An air blowing unit 2063 blows the air for cooling.

The ventilation path 2064 is arranged over the air blowing unit 2063 as well as the magnetron 2051 and drive chamber 2662.

The air blown by the air blowing unit 2063 passes through the air ventilation path 2064 and is blown onto the magnetron 2051 and the drive unit 2062, to cool these parts. This suppresses abnormal heat generation of the magnetron 2051 or the drive unit 2062 and inconveniences concerning the magnetron 2051 or the drive unit 2062 due to abnormal heat generation.

It may also be so configured that the air fed by the air blowing unit 2063 is blown onto the motor 2046 not only to the magnetron 2051 and the drive unit 2062.

The heating cooker 2001 as described above produces a functional effect similar to that in Embodiment 7.

At last, embodiments of the present invention will be summarized.

The heating cooker 2001 according to an embodiment of the present disclosure comprises: a cooker body 2002 having a heating chamber 2022 with an opening 2022*a* at the front side; a storage 2003 supported to be movable toward/away from the inner side of the heating chamber 2022 through the opening 2022*a* and in which an object to be cooked is stored; a motor 2046 for moving in/out the storage 2003; a magnetron 2051; and a waveguide 2052 for guiding microwave generated by the magnetron 2051 to the inside of the heating chamber 2022; the motor 2046, the magnetron 2051 and the waveguide 2052 being arranged outside the heating chamber 2022, and further comprises heaters 2053, 2054 and 2058 arranged at the top wall 2022*e* side or the bottom wall 2022*f* side of the inner side of the heating chamber 2022, the motor 2046 being arranged in low temperature regions 2023*b*, 2023*c* and 2023*d* other than high temperature regions 2023*e* and 2023*f* opposed to any one of the top wall 2022*e* and the bottom wall 2022*f* of the heating chamber 2022.

In the heating cooker 2001 according to an embodiment of the present disclosure, the heaters 2053, 2054 and 2058 are arranged at the top wall 2022*e* side within the heating chamber 2022, the magnetron 2051 is arranged in the low temperature regions 2023*b*, 2023*c* and 2023*d* that are opposed to the rear wall 2022*b* or left side wall 2022*c* (right side wall 2022*d*) of the heating chamber 2022, and the waveguide 2052 is arranged in the low temperature regions 2023*b*, 2023*c* and 2023*d* that are opposed to the rear wall 2022*b* or left side wall 2022*c* (right side wall 2022*d*) of the heating chamber 2022, or in the high temperature regions 2023*e* and 2023*f* that are opposed to the bottom wall 2022*f*.

In the heating cooker 2001 according to an embodiment of the present disclosure, the heater 2054 is supported to be oscillatable between the top wall 2022*e* side within the heating chamber 2022 and the stored position side of the object to be cooked which is lower than the top wall 2022*e* side. The heating cooker 2001 comprises an oscillation mechanism 2057 which oscillates the heater 2054 to the top wall 2022*e* side/stored position side in coordination with the storage 2003 moving in/out.

In the heating cooker 2001 according to an embodiment of the present disclosure, the storage 2003 integrally has a door 2031 which opens/closes the opening 2022*a*, and the oscillation mechanism 2057 includes an oscillation unit 2552 which oscillates together with the heater 2054, a biasing part 2543 which biases the heater 2054 such that the heater 2054 oscillates to the top wall 2022*e* side, and a contact/separation part 2056 which moves away from/moves toward the oscillating part 2552 as the storage 2003 moves in/out and makes contact with the oscillating part 2552 when the door 2031 is closed to apply an external force to the oscillating part 2552 in a direction of oscillating the heater 2054 to the stored position side.

In the heating cooker 2001 according to an embodiment of the present disclosure, the heaters 2053, 2054 are arranged at the top wall 2022*e* side within the heating chamber 2022, and comprises a movable antenna 2061 which scatters microwave guided by the waveguide 2052 to the inner side of the heating chamber 2022, a drive unit 2626 which drives the movable antenna 2061, an air blowing unit 2063, and a ventilation path 2064 for guiding the air blown by the air blowing unit 2063 to each of the magnetron 2051 and the drive unit 2626 sides. The movable antenna 2061, drive unit 2626, air blowing unit 2063 and ventilation path 2064 are arranged in the low temperature regions 2023*b*, 2023*c* and 2023*d* that are opposed to the rear wall 2022*b* or the left side wall 2022*c* (right side wall 2022*d*) of the heating chamber 2022 located outside the heating chamber 2022.

The heating cooker 2001 according to an embodiment of the present disclosure further comprises a slide rail 2042 which movably supports the storage 2003 so as to be pulled out/in, a rack gear 2044 which moves out/in together with the storage 2003, a pinion gear 2045 which is engaged with the rack gear 2044, and the low temperature regions 2023*c*, 2023*d* opposed to the left side wall 2022*c* (right side wall 2022*d*) of the heating chamber 2022 located outside the heating chamber 2022. The motor 2046 is a motor which rotatably drives the pinion gear 2045, and is arranged in the low temperature regions 2023*c*, 2023*d* opposed to the left side wall 2022*c* (right side wall 2022*d*).

According to an aspect of the present disclosure, the heater is arranged at the top wall side or the bottom wall side within the heating chamber. Thus, heat generated by the heater is easily transferred to the region outside the heating chamber that is opposed to any one of the top wall and the bottom wall of the heating chamber (that is, this region is the high temperature region). The components arranged in the high temperature region need to have high thermal resistance.

On the other hand, heat generated by the heater is not easily transferred to the region other than the high temperature region (that is, this region is the low temperature region). An actuator arranged in the low temperature region does not require high thermal resistance.

According to the present disclosure, the electromagnetic wave generating unit is arranged in the low temperature region opposed to the rear wall or side wall of the heating chamber. It is not necessary for the electromagnetic wave generating unit arranged in the low temperature region to have high thermal resistance.

On the other hand, the waveguide is arranged in the low temperature region opposed to the rear wall or side wall of the heating chamber, or the high temperature region opposed to the bottom wall of the heating chamber. This corresponds to a structure where the waveguide arranged above the heating chamber in the conventional heating cooker is evacuated from the high temperature region opposed to the top wall of the heating chamber.

In general, compared to the rack gear, pinion gear, motor, electromagnetic wave generating unit included in the conventional heating cooker, the waveguide is not easily affected by high temperature. Moreover, because the temperature in the high temperature region opposed to the bottom wall of the heating chamber is not as high as that in the high temperature region opposed to the top wall of the heating chamber, the electromagnetic wave generating unit is not easily affected by high temperature. Therefore, no particular problem occurs even if the waveguide is located in the high temperature region opposed to the bottom wall of the heating chamber.

As a result, a heating cooker may be manufactured at low cost using an electromagnetic wave generating unit and a waveguide with low thermal resistance as in the conventional case.

According to an aspect of the present disclosure, the heater included in the heating cooker is a movable heater.

The heater oscillates in coordination with the storage moving in/out. It is therefore unnecessary for the user to manually oscillate the heater.

According to an aspect of the present disclosure, in the case where the storage is retracted into the heating chamber, the contact/separation unit makes contact with the oscillating part to oscillate the heater to the stored position side of an object to be cooked within the heating chamber through the oscillating part. That is, in the case where the storage is retracted into the heating chamber, the heater is at the stored position side of an object to be cooked within the heating chamber. Hence, the separation distance between the heater and the object to be cooked is short, so that the object to be cooked may efficiently be heated.

If, on the other hand, the storage protrudes from the inside of the heating chamber, the contact/separation part is separated from the oscillating part, and thus the biasing part oscillates the heater to the top wall side within the heating chamber. That is, in the case where the storage protrudes from the heating chamber, the heater is at the top wall side of the heating chamber. Thus, the separation distance between the heater and the object to be cooked is long, thereby suppressing the interference by the heater on the object to be cooked which is moved in/out with respect to the heating chamber together with the storage.

With the structure as described above, an actuator for automatically oscillating the heater is not required.

According to an aspect of the present disclosure, the air-blowing unit blows air to the electromagnetic wave generating unit as well as the drive unit, thereby suppressing raise in the temperature in these components.

According to an aspect of the present disclosure, the slide rail, the rack gear, the pinion gear and the motor serving as an actuator are arranged in the low temperature region opposed to the side wall of the heating chamber. This corresponds to a structure where the rack gear, pinion gear and motor that are arranged at the slide rails on the lower side in the conventional heating cooker are moved to at least one of the slide rails.

The slide rails, rack gear, pinion gear and motor arranged in the low temperature region do not necessarily have high heat resistance, which causes no particular problem even if these components are inexpensive ones with low thermal resistance. As a result, the heating cooker may be manufactured at low cost.

It should be understood that the embodiments disclosed herein are illustrative and non-restrictive in every respect. Since the scope of the present invention is defined by the appended claims rather than by the description preceding them, and all changes that fall within metes and bounds of the claims, or equivalence of such metes and bounds thereof are therefore intended to be embraced by the claims.

Moreover, as long as the effect of the present invention can be produced, the heating cooker 2001 may also include components that are not disclosed in Embodiments 7-10.

The technical features (components) disclosed in each example embodiment may be combined with one another, and such combinations may form new technical features.

According to Embodiments 7-10 as described above, the following effects are produced. Conventionally, the heating cooker of the drawer type is proposed (see Japanese Patent No. 4027325, Japanese Patent No. 4528640, Japanese Patent No. 4296190 and Japanese Patent No. 4404918). The drawer-type heating cooker includes a cooker body having a heating chamber, an electromagnetic wave generating unit, and a waveguide for guiding electromagnetic wave generated by the electromagnetic wave generating unit into the heating chamber. The electromagnetic wave generating unit is arranged behind the heating chamber, whereas the waveguide extends from the electromagnetic wave generating unit to the upper side of the heating chamber. Furthermore, the drawer-type heating cooker comprises a storage in which an object to be cooked is stored. The storage is supported by two slide rails arranged at left and right sides of the heating chamber and one downside slide rail arranged below the heating chamber, so as to move in/out with respect to the inside of the heating chamber. A rack gear is attached to the downside slide rail. By the motor rotatably driving the pinion gear engaged with the rack gear, the storage is pulled out from the inside of the heating chamber or is pushed into the heating chamber (i.e., moves in and out). The motor and pinion gear are arranged below the bottom wall of the heating chamber. Meanwhile, a general heating cooker not of the drawer type may include a movable heater (see Japanese Patent Application Laid-Open No. 113-144218, Japanese Patent Application Laid-Open No. 2011-158184). The movable heater automatically oscillates while being driven by the motor, or the user manually oscillates the movable heater. The movable heater appropriately heats an object to be cooked by moving toward/away from an object to be cooked or by moving around the object to be cooked along the surface thereof. As described above, the conventional heating cooker of the drawer type is a single function type only having the microwave function. If a heater is added to the conventional drawer-type heating cooker, a multi-functional heating cooker having the microwaving and grilling functions as in the heating cooker described in Japanese Patent Application Laid-Open No. 113-144218 or Japanese Patent Application Laid-Open No. 2011-158184 may be obtained. Thus, the heating cooker is so configured that heat is transmitted from the heater arranged at the top wall side within the heating chamber toward the object to be cooked located below the heater. Here, the heat generated by the heater is transmitted both to the upper and lower parts in the heating chamber. This therefore increases the temperature in the downside slide rail, rack gear, pinion gear and motor that are located below the heating chamber. However, the rack gear, pinion gear and motor generally have low heat resistance. If these components are made to have high resistance to heat, on the other hand, the manufacturing cost of the heating cooker increases.

According to Embodiments 7 to 10 described above, a drawer-type heating cooker may be provided which has multiple functions including the microwave function and can be manufactured at low cost. That is, according to Embodiments 7 to 10 described above, an actuator for moving in/out the storage is arranged in the low temperature region where the heat generated by the heater is not easily transmitted. Hence, as an actuator to be included in the heating cooker, an inexpensive actuator with low thermal resistance as in the conventional case may be employed. As a result, a drawer-type heating cooker with multiple functions including the microwave function may be manufactured at low cost.

Embodiments 11 to 13

Figure 32:
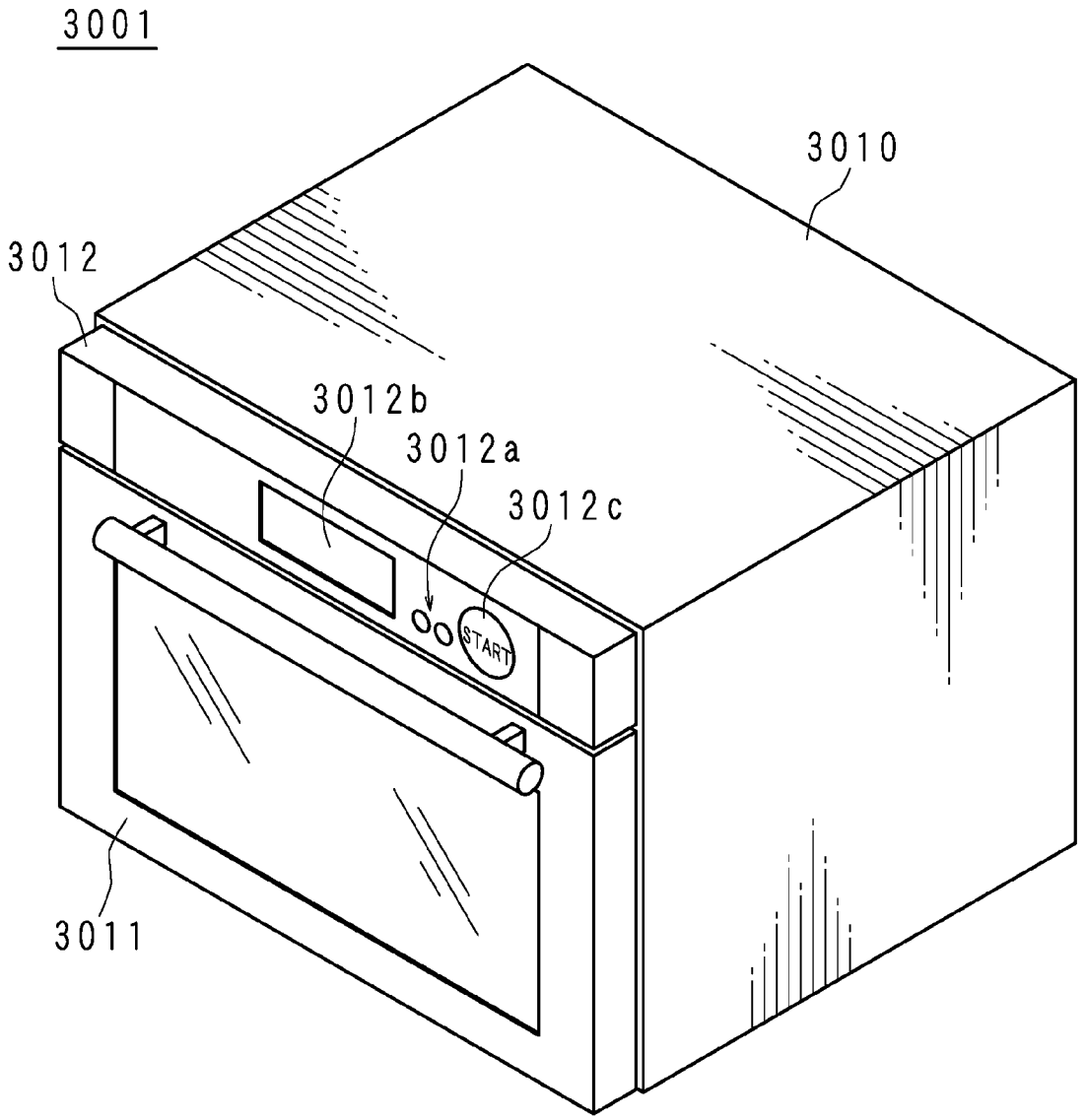
FIG. 32 is a perspective view of the outer appearance of the heating cooker according to Embodiment 11.

FIG. 32 is a perspective view of the outer appearance of a heating cooker 3001 according to Embodiment 11. The heating cooker 3001 includes a box-like cooker body 3010, one surface of the cooker body 3010 being provided with a door 3011 at the installation surface (not illustrated) side of the heating cooker 3001, and with an operation panel 3012 at the side opposite from the installation surface, i.e. the top surface side.

On the operation panel 3012, an operation unit 3012*a* having various types of keys for the user to operate the heating cooker 3001, a display unit 3012*b* on which various kinds of information the user is to be notified of, and a start switch 3012*c* for starting cooking by the heating cooker 3001.

Figure 33:
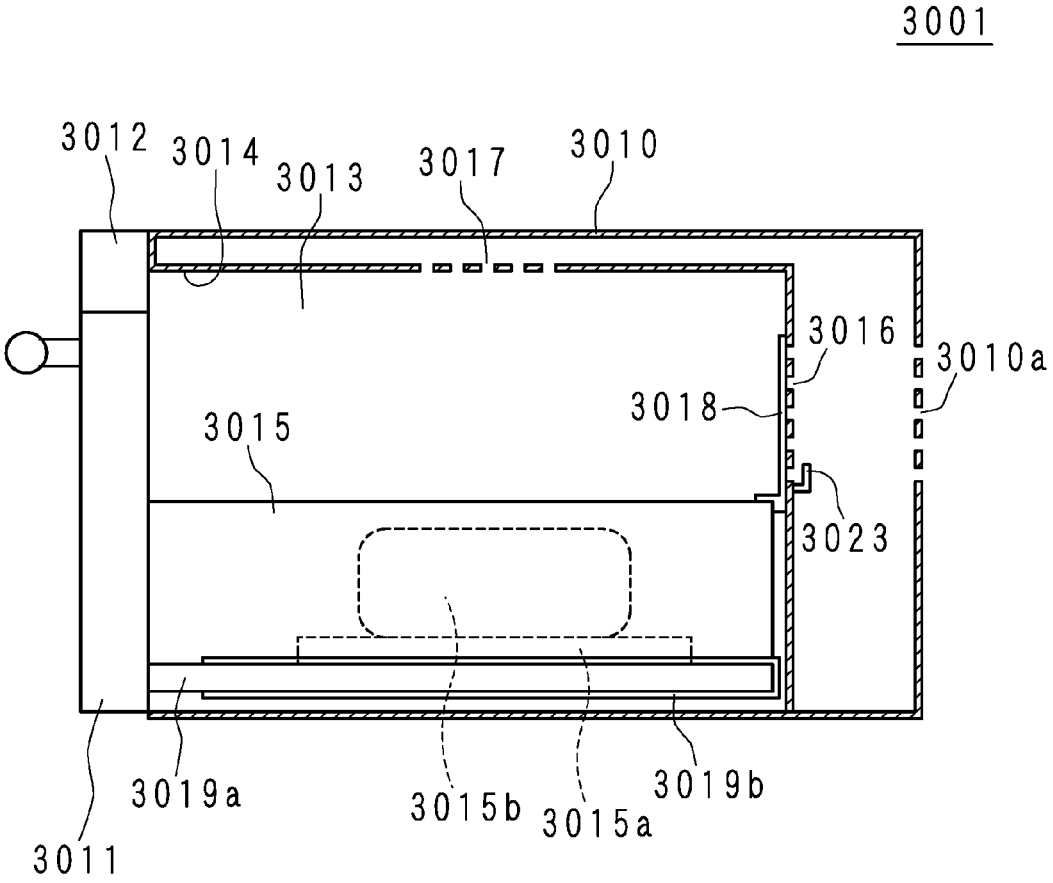
FIG. 33 is a side section view of the heating cooker according to Embodiment 11.
Figure 34:
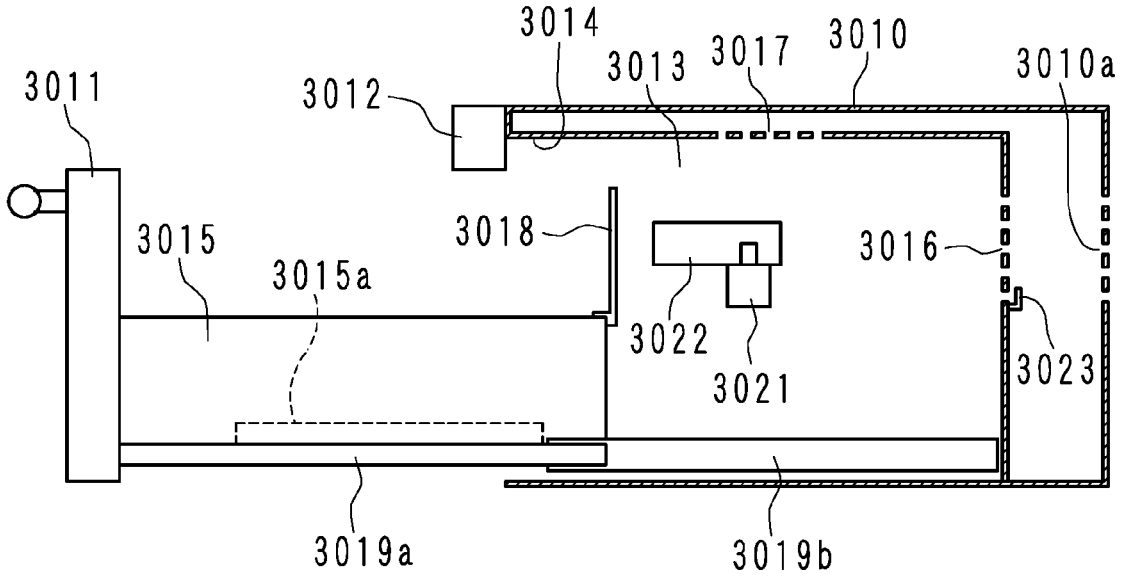
FIG. 34 is a side section view of the heating cooker according to Embodiment 11.

FIGS. 33 and 34 are side section views of the heating cooker 3001 according to Embodiment 11. The cooker body 3010 has a heating chamber 3013 in which an object to be cooked is heated. In FIG. 33, the right side surface of the heating chamber 3013 is not illustrated.

The heating chamber 3013 has an opening 3014, which is opened or closed by the door 3011, at the side of the one surface of the cooker body 3010. In the middle of the inner surface of the door 3011, a placement table 3015 on which an object to be cooked 3015*a* is placed is arranged to protrude therefrom. The placement table 3015 is in a box-like shape with one face at the top surface side of the heating cooker 3001 being open, and has a tray 3015*a* on which the object to be cooked 3015*b* is placed.

On the inner surface of the door 3011, two movable rails 3019*a* protrude so that the placement table 3015 is positioned in between at the placement surface side of the heating cooker 3001. The fixed rails 3019*b* slidable with respect to the movable rails 3019*a* are arranged to the side surfaces inside the heating cooker 3001.

The movable rails 3019*a* and the fixed rails 3019*b* are arranged to be positioned outside the heating chamber 3013 so as not to be affected by, for example, microwave or a residue of the object to be cooked 3015*b*.

As the movable rails 3019*a* and fixed rails 3019*b* slide, the door 3011 moves to the front and inner back directions of the heating chamber, and opens/closes the opening 3014. FIG. 33 corresponds to the case where the opening 3014 is closed, whereas FIG. 34 corresponds to the case where it is opened.

In the case where the opening 3014 is opened from the closed state, the placement table 3015 moves to the outside of the heating chamber 3013 along with the movement of the door 3011. In the opened state of the opening 3014, the user may place the object to be cooked 3015*b* on the placement table 3015 via the tray 3015*a*. Furthermore, by closing the opening 3014, the placement table 3015 is moved into the heating chamber 3013 and the object to be cooked 3015*b* may be introduced into the heating chamber 3013.

As illustrated in FIG. 33, in the state where the opening 3014 is closed, the inner back surface of the heating chamber 3013 has an air inlet 3016 at a position closer to the top surface side of the heating cooker 3001 than the placement table 3015. The air inlet 3016 is connected to an intake duct (not illustrated), and the intake duct is connected to an air inlet 3010*a* formed at the inner back surface of the cooker body 3010.

Furthermore, at the top surface of the heating chamber 3013, an air outlet 3017 is provided. The air outlet 3017 is connected to an air outlet (not illustrated) formed at the cooker body 3010 through an exhaust duct (not illustrated). The heating chamber 3013 is ventilated through the air inlet 3016 and air outlet 3017.

Figure 35:
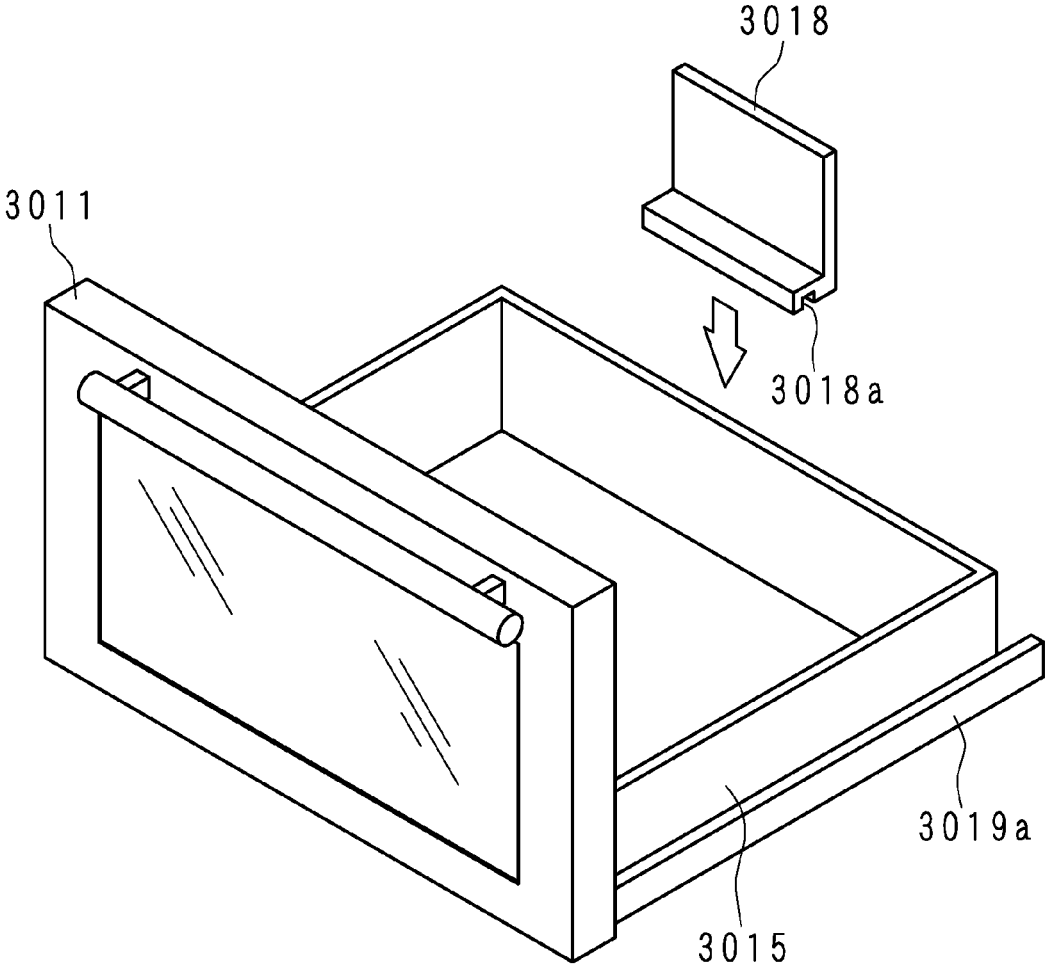
FIG. 35 illustrates the attachment of a lid.

At the placement table 3015, a lid 3018 as an example of a closing part which closes the air inlet 3016 is detachably attached at the inner back side of the heating chamber 3013. FIG. 35 illustrates the attachment of a lid 3018. The lid 3018 has the shape of a rectangular plate and has a hook 3018*a* at one end in the longitudinal direction. The hook 3018*a* is engaged with a circumferential part of the opening of the placement table 3015 at the inner back side of the heating chamber 3013.

The lid 3018 is attached to the placement table 3015 by the hook 3018*a* being engaged with the circumferential part of the placement table 3015. The lid 3018 protrudes from the placement table 3015 to the top surface side of the heating cooker 3001. The lid 3018 moves in the heating chamber 3013 along with the movement of the door 3011, and closes the air inlet 3016 in the case where the opening 3014 is closed.

As illustrated in FIG. 34, the heating cooker 3001 is provided with a magnetron 3021 and a waveguide 3022 connected to the magnetron 3021 on the side surface inside the cooker body 3010 between the side surface and the heating chamber 3013. The magnetron 3021 and the waveguide 3022 constitute a heating unit. Furthermore, a contact sensor 3023 is provided near the air inlet 3016 at the outside of the heating chamber 3013.

Heating and cooking by the heating cooker 3001 configured as described above is started by installing the object to be cooked 3015*b* placed on the placement table 3015 into the heating chamber 3013, closing the opening 3014 and operating the operation panel 3012 to set information required for cooking, and thereafter turning on the start switch 3012*c*. Accordingly, microwave generated by the magnetron 3021 is introduced into the heating chamber 3013 through the waveguide 3022, to irradiate the object to be cooked 3015*b* and to progress the heating and cooking.

Figure 36:
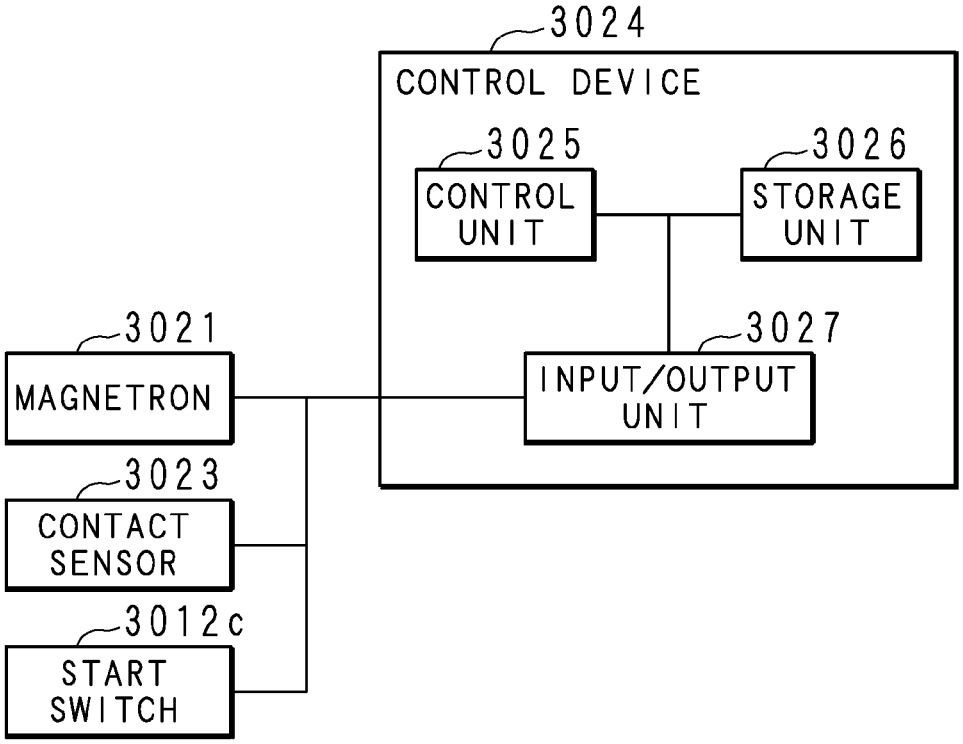
FIG. 36 is a block diagram illustrating a configuration of a control system of the heating cooker according to Embodiment 11.

FIG. 36 is a block diagram illustrating a configuration of a control system of the heating cooker 3001 according to Embodiment 11. The heating cooker 3001 comprises a control device 3024. The control device 3024 has a control unit 3025, a storage unit 3026 and an input/output unit 3027 that are connected with one another.

The heating cooker 3001 has a heating function which heats the object to be cooked 3015*b* and a heat retention function which retains heat by suppressing heating. The storage unit 3026 stores therein heating manners corresponding thereto. The magnetron 3021, contact sensor 3023 and start switch 3012*c* are connected to the input/output unit 3027.

In the case where the heating cooker 3001 starts operating and the opening 3014 is closed, the contact sensor 3023 detects whether or not the lid 3018 is attached to the placement table 3015. If the contact sensor 3023 does not detect the lid 3018, such information is input through the input/output unit 3027. Here, the control unit 3025 selects the heating function of heating the object to be cooked 3015*b*.

In such a case, when the user presses the start switch 3012*c*, the control unit 3025 reads out a heating manner specified by the user on the operation panel 3012 from the storage unit 3026, and outputs a drive command for the magnetron 3021 through the input/output unit 3027. The magnetron 3021 generates microwave based on the drive command.

If the contact sensor 3023 detects that the lid 3018 is attached to the placement table 3015, such information is input through the input/output unit 3027. At that time, the control unit 3025 selects the heat retention function of keeping warm the object to be cooked 3015*b*.

In such a case, when the start switch 3012*c* is turned on, the control unit 3025 reads out a heating manner corresponding to the heat retention function from the storage unit 3026, and outputs a drive command for the magnetron 3026 through the input/output unit 3027. The magnetron 3021 intermittently generates microwave so as to keep warm the object to be cooked 3015*b* in accordance with the drive command.

According to the configuration described above, the heating function and the heat retention function may be switched with each other based on whether or not the lid 3018 is attached. Since the lid 3018 is attached/detached by the user him/herself, an erroneous operation may be reduced. Moreover, as the lid 3018 is attached/detached manually, requiring no complicated mechanism, the failure rate of the entire device is lowered and also the cost may be reduced.

It is noted that heating may also be conducted, not by the magnetron 3021, but by another heating device such as a heater. Moreover, the configuration of continuously heating the object to be cooked 3015*b* at a predetermined temperature for keeping it warm may be employed, instead of the configuration of intermittently heating the object to be cooked 3015*b* for keeping it warm.

Furthermore, while opening/closing by the lid 3018 is detected by the contact sensor 3023, another sensor, switch or the like may alternatively be used to detect opening/closing of the lid 3018.

The heating cooker 3003 according to Embodiment 12 will be described below in detail with reference to the drawings illustrating the embodiments thereof. Components in the heating cooker 3003 according to Embodiment 12 that are similar to those of the heating cooker 3001 according to Embodiment 11 are denoted by the same reference codes and will not be described in detail.

Figure 37:
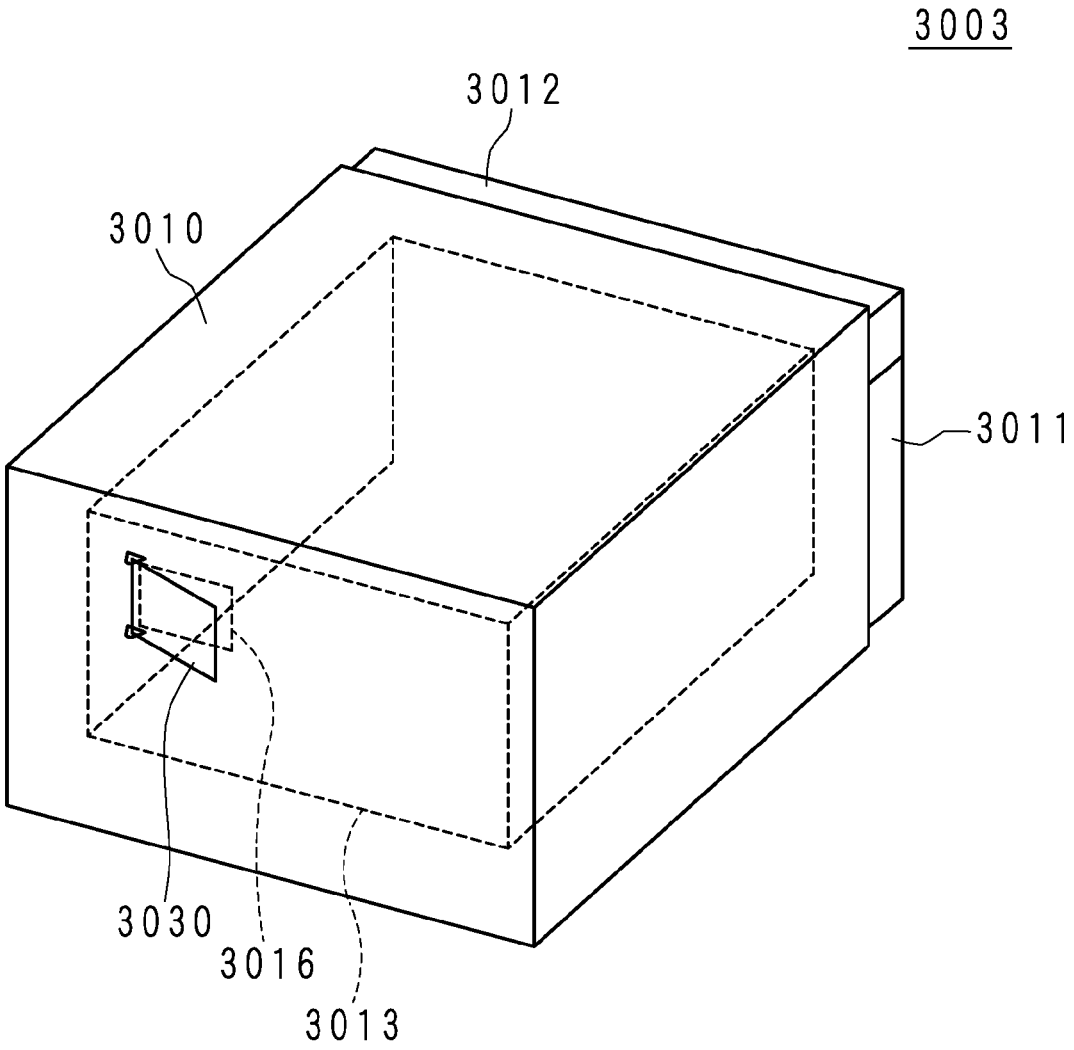
FIG. 37 is a schematic view illustrating the arrangement of a damper.
Figure 38:
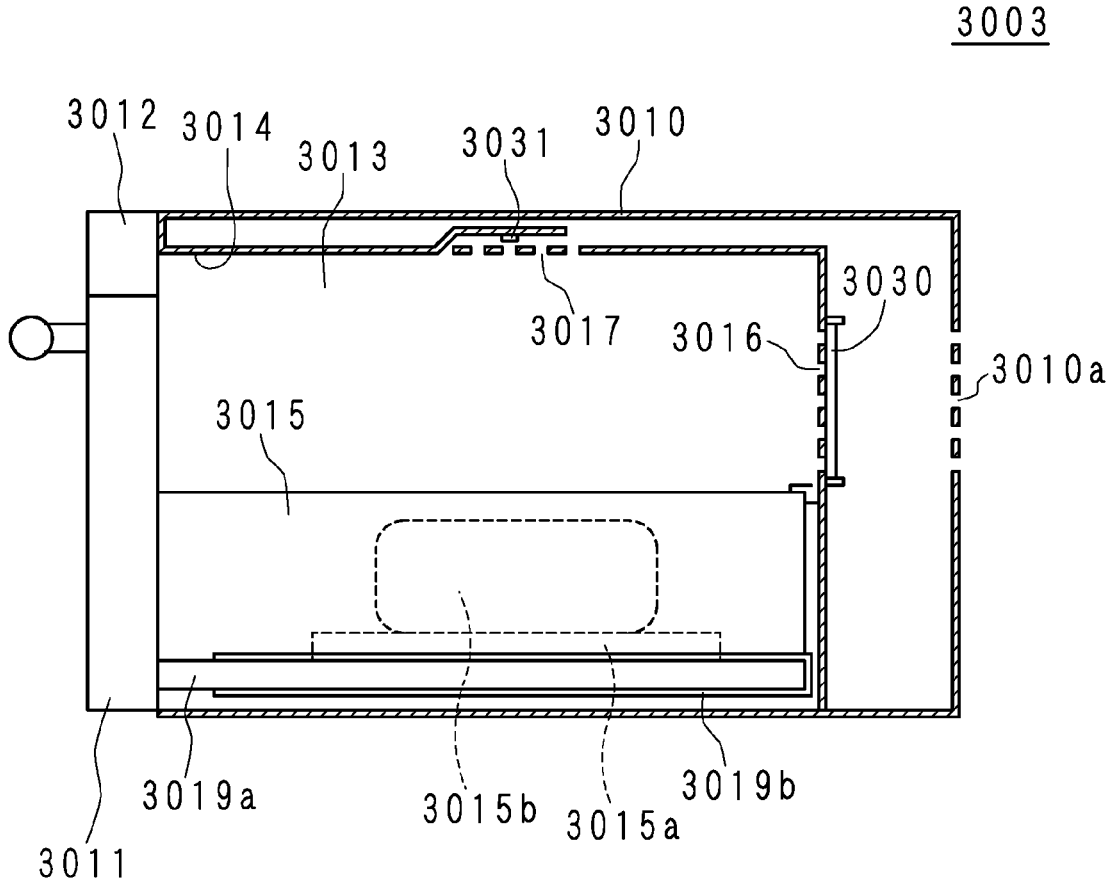
FIG. 38 is a side section view of the heating cooker according to Embodiment 12.

The heating cooker 3003 includes, instead of the lid 3018, a damper 3030 serving as a closing part which closes the air inlet 3016 in such a manner of being opened/closed. FIG. 37 is a schematic view illustrating the arrangement of the damper 3030. FIG. 38 is a side section view of the heating cooker 3003 according to Embodiment 12.

The damper 3030 has a rectangular shape with one side thereof fixed to the back surface of the heating chamber 3013, and rotates by a motor and a gear (not illustrated) while the one side serving as an axis. The control unit 3025 outputs a drive command for the damper 3030 through the input/output unit 3027 and opens/closes the air inlet 3016 by the motor and gear, to control the degree of opening.

Moreover, the heating cooker 3003 comprises a humidity sensor 3031 near the air outlet 3017 at the top surface of the heating chamber 3013. The humidity sensor 3031 detects humidity in the heating chamber 3013 based on the air flowing from the air inlet 3016 to the air outlet 3017.

Figure 39:
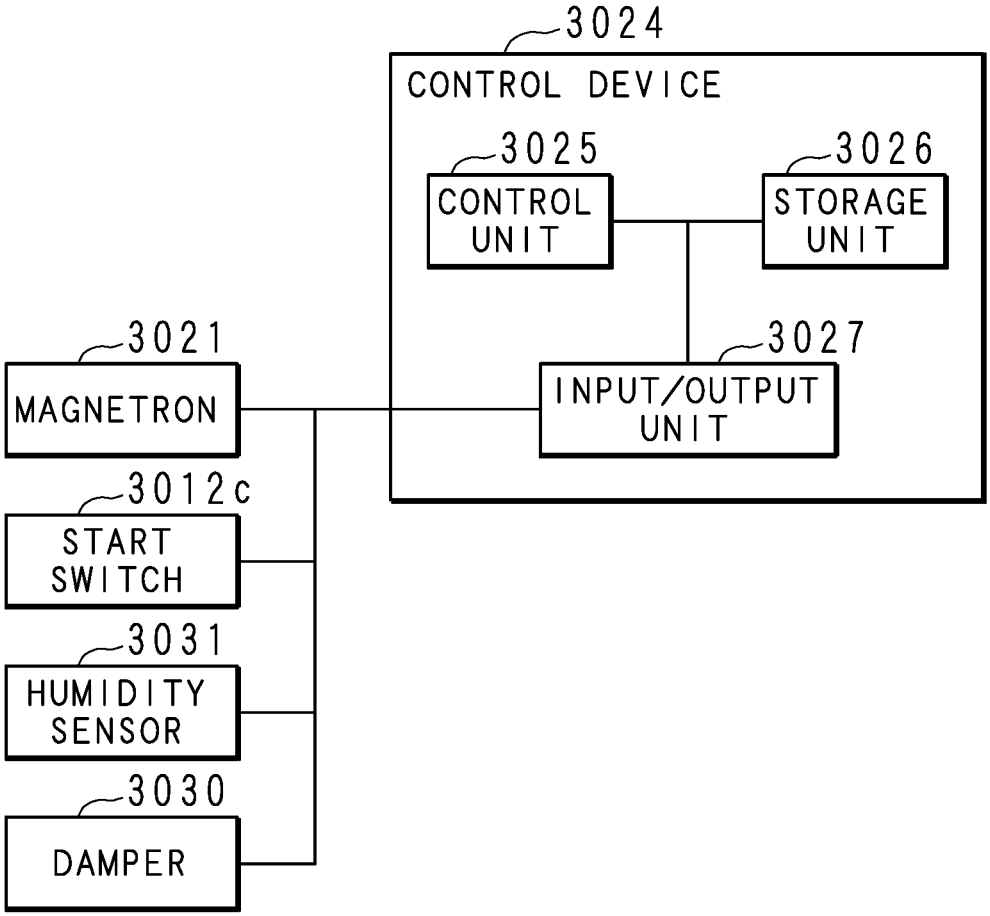
FIG. 39 is a block diagram illustrating a configuration of a control system of the heating cooker according to Embodiment 12.

FIG. 39 is a block diagram illustrating a configuration of a control system of the heating cooker 3003 according to Embodiment 12. The damper 3030 and humidity sensor 3031 are connected to the input/output unit 3027. The user selects the heating function on the operation panel 3012, and if the start switch 3012*c* is turned on, such information is input to the control unit 3025 through the input/output unit 3027.

The control unit 3025 reads out the heating manner specified by the user on the operation panel 3012 from the storage unit 3026, and outputs a drive command for the magnetron 3026 through the input/output unit 3027. The magnetron 3021 generates microwave based on the drive command. The magnetron 3021 is driven. Here, the motor of the damper 3030 is driven to open the air inlet 3016 to the maximum limit.

If the user selects the heat retention function on the operation panel 3012, and if the start switch 3012*c* is turned on, such information is input to the control unit 3025 through the input/output unit 3027. The control unit 3025 reads out a heating manner corresponding to the heat retention function from the storage unit 3026.

The control unit 3025 outputs a drive command for the magnetron 3021 through the input/output unit 3027. The magnetron 3021 intermittently generates microwave based on the drive command to keep the temperature of the object to be cooked 3015*b* at constant. Meanwhile, the control unit 3025 makes the humidity sensor 3031 detect humidity in the heating chamber 3013. The humidity detected by the humidity sensor 3031 is input to the control unit 3025 through the input/output unit 3027.

The storage unit 3026 stores therein a threshold A, B and C for the humidity. The relationship among the values of the threshold A, B and C is represented by A<B<C. Moreover, the storage unit 3026 stores therein the degree of opening/closing of the damper 3030 according to the threshold A, B and C for the humidity.

The control unit 3025 compares the values for the humidity to be input through the input/output unit 3027 from the humidity sensor 3031 with the threshold values A, B and C for the humidity stored in the storage unit 3026. If the control unit 3025 determines that the humidity in the heating chamber 3013 is A or lower, it outputs a drive command for the damper 3030 through the input/output unit 3027, drives the motor and closes the air inlet 3016.

If the control unit 3025 determines that the humidity in the heating chamber 3013 is higher than A and equal to or lower than B, it outputs a drive command for the damper 3030 through the input/output unit 3027, drives the motor and opens the air inlet 3016 such that the angle formed by the damper 3030 and the back surface of the heating chamber 3013 is 30 degrees.

If the control unit 3025 determines that the humidity in the heating chamber 3013 is higher than B and equal to or lower than C, it outputs a drive command for the damper 3030 through the input/output unit 3027, drives the motor and opens the air inlet 3016 such that the angle formed by the damper 3030 and the back surface of the heating chamber 3013 is 60 degrees.

If the control unit 3025 determines that the humidity in the heating chamber 3013 is higher than C, it outputs a drive command for the damper 3030 through the input/output unit 3027, drives the motor and opens the air inlet 3016 such that the angle formed by the damper 3030 and the back surface of the heating chamber 3013 is 90 degrees, i.e., to the maximum limit.

According to the configuration described above, in the case of using the heat retention function of the heating cooker 3003, the damper 3030 may be driven in association with the humidity in the heating chamber 3013. This allows for fine adjustment of the humidity in the heating chamber 3013.

It is noted that the threshold is not limited to the three values of A, B and C, but may have four or more threshold values. By increasing the number of threshold values, the heating cooker 3003 may be able to conduct even finer adjustment of humidity. Furthermore, the degree of opening/closing of the damper 3030 is not limited to 30, 60 or 90 degrees but may also be another angle.

The heating cooker 3001 according to Embodiment 13 will now be described below in detail. Components in the heating cooker 3001 according to Embodiment 13 that are similar to those in Embodiment 11 are denoted by the same reference codes and will not be described in detail.

The heating cooker 3001 according to Embodiment 13 comprises, in addition to the components in Embodiment 11, a heating device (not illustrated) such as a heater or the like. Moreover, the heating cooker 3001 has heating modes corresponding to the magnetron 3021 and the heater, respectively. Furthermore, the heating cooker 3001 has a reporting unit (not illustrated) which reports to the user that the lid 3018 is attached by blinking light, alarm sound or the like.

If the heating mode using the magnetron 3021 is selected, the control unit 3025 reports to the user, by the reporting unit, that the lid 3018 is to be removed. If, on the other hand, the heating mode using the heater is selected, the control unit 3025 reports to the user that the lid 3018 is to be attached.

The configuration described above allows the user to easily determine as to whether the lid 3018 is attached in accordance with the heating modes respectively corresponding to the magnetron 3021 and the heater.

The heating cooker (3001) according to an embodiment of the present disclosure comprising: a heating chamber (3013) with an opening (3014), in which an object to be cooked (3015*b*) is heated; a placement table (3015) provided to be moved into and away from the heating chamber (3013) through the opening (3014), on which the object to be cooked (3015*b*) is placed; and an air inlet (3016) formed at the heating chamber (3013), further comprises a closing part (3018) which is detachably mounted to the placement table (3015) and closes the air inlet (3016).

According to an embodiment of the present disclosure, as the closing part (3018) is detachable with respect to the placement table (3015), opening/closing of the air inlet (3016) is manually conducted by the user, thereby requiring no complicated mechanism and thus reducing the failure rate as well as cost for the heating cooker (3001).

In the heating cooker (3001) according to an embodiment of the present disclosure, the air inlet (3016) is formed at a position corresponding to the opening (3014), the placement table (3015) is movable in the opposing directions of the opening (3014) and the air inlet (3016), and the closing part (3018) protrudes from the air inlet (3016) side at the edge of the placement table (3015) if attached to the placement table (3015).

According to an embodiment of the present disclosure, as the placement table (3015) is movable in the opposing directions of the opening (3014) and the air inlet (3016), the closing part (3018) attached to the placement table (3015) moves along the movement of the placement table (3015). Moreover, the closing part (3018) protrudes from the air inlet (3016) side at the edge of the placement table (3015), so that the air inlet (3016) may easily be opened or closed along with the movement of the placement table (3015).

The heating cooker (3001) according to an embodiment of the present disclosure comprises a heating unit (3021) which heats the object to be cooked (3015*b*) and a control unit (3025) which controls the heating of the heating unit (3021). The control unit (3025) is configured to suppress the heating by the heating unit (3021) if the air inlet (3016) is closed by the closing part (3018) compared to the case where the air inlet (3016) is opened.

According to an embodiment of the present disclosure, by the air inlet (3016) being closed, heating may be suppressed compared to the case where the air inlet (3016) is opened. Thus, in the case where the heating cooker (3001) has, for example, the heat retention function by suppressing heating, the heating function and the heat retention function may be switched from one another by opening or closing the closing part (3018) of the air inlet (3016). This can prevent the user from erroneously operating the switching between the heating function and the heat retention function.

The heating cooker (3001) according to an embodiment of the present disclosure comprises a sensor (3023) which detects opening/closing of the air inlet (3016).

According to an embodiment of the present disclosure, the heating cooker (3001) comprises a sensor (3023) which detects opening/closing of the air inlet (3016), allowing the user to switch between the heating function and the heat retention function which is obtained by suppressing heating, in accordance with whether or not the closing part (3018) is attached to the placement table (3015).

The heating cooker (3003) according to an embodiment of the present disclosure comprising: a heating chamber (3013) in which an object to be cooked (3015*b*) is heated; a heating unit (3021) which heats the object to be cooked (3015*b*); an air inlet (3016) formed at the heating chamber (3013); and a closing part (3030) which opens/closes the air inlet (3016), further comprises a control unit (3025) which controls the degree of opening for the closing part (3030). The control unit (3025) is configured to control the degree of opening for the closing part (3030) in accordance with the humidity in the heating chamber (3013).

According to the present disclosure, the control unit (3025) can control the degree of opening for the closing part (3030) which opens/closes the air inlet (3016) in accordance with the humidity in the heating chamber (3013). Thus, the object to be cooked (3015*b*) can be kept at an appropriate humidity.

According to Embodiments 11-13 as described above, the following effects are produced. That is, conventionally, the heating cooker comprises a heating chamber in which an air inlet and an air outlet are formed. Moreover, switching between the heating function and the heat retention function is conducted by the operation on an operation button, a switch or the like provided outside the heating chamber. In order to use the heating function of the heating cooker, it is necessary to open the air inlet for ventilating the heating chamber. In order to use the heat retention function, on the other hand, it is necessary to close the air inlet by the lid to prevent the inside of the heating chamber from being dry. Thus, to use both the heating function and the heat retention function, conventionally, a lid for opening/closing the air inlet or the air outlet by the motor is employed (see Japanese Patent Application No. 2011-247485). The lid driven by the motor described above, however, requires a complicated mechanism, which causes problems of increase in the cost and the failure rate of the entire heating cooker due to a failure in the mechanism. Furthermore, in switching between the heating function and the heat retention function such as an operation button, a switch or the like, the user may not be able to operate as intended because of an operation error, misunderstanding or the like. Moreover, the lid operated by the conventional motor has such a problem that it is difficult to conduct fine adjustment of humidity within the heating chamber.

According to Embodiments 11 to 13 as described above, the cost, failure rate and erroneous operation may be reduced, which allows for fine adjustment of the humidity in the heating chamber.

Embodiments 14 to 16

Figure 40:
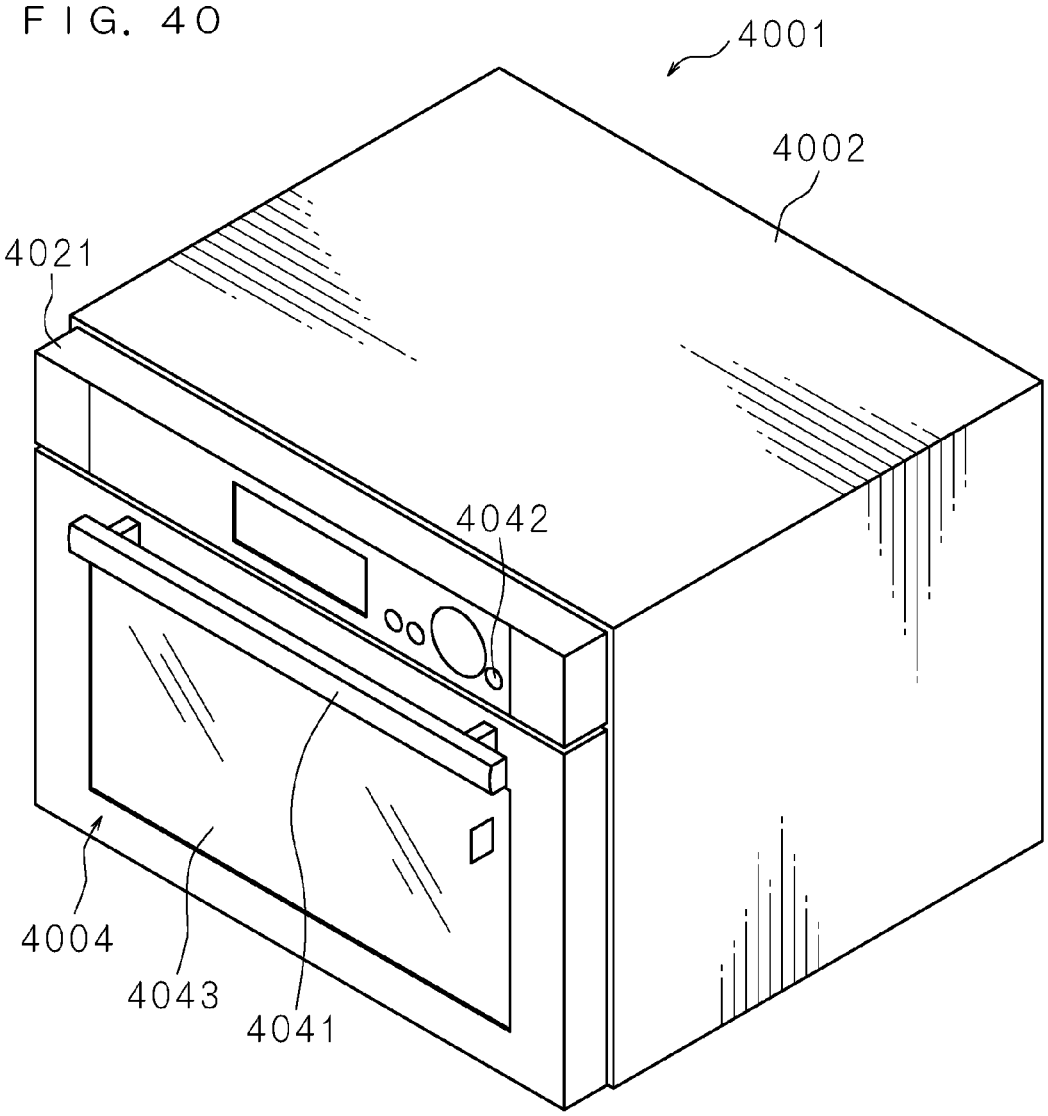
FIG. 40 is a perspective view of the outer appearance of the heating cooker according to Embodiment 14 of the present invention.

FIG. 40 is a perspective view of the outer appearance of the heating cooker according to Embodiment 14 of the present invention.

The heating cooker is a drawer-type microwave 4001, including a cooker body 4002 having a box-like shape which is built into a kitchen counter (counter for cooking).

The cooker body 4002 has an opening at the front side, and a panel unit 4021 is provided at the upper edge of the opening. The panel unit 4021 has an operation unit having various types of keys for the user to operate the microwave 4001, and a display unit on which various types of information for the user to be notified thereof.

A door 4004 is provided at the opening of the cooker body 4002, the door 4004 having the shape of a rectangular plate and being configured to open and close the opening of the cooker body 4002. The operation unit of the panel 4021 is provided with open/close operation keys 4042 for the user to perform opening/closing operation of the door 4004.

The door 4004 includes a handle 4041 and a window 4043, the handle 4041 being provided at the upper part of the body of the door 4004 and having a bar-like grip extending in the lateral direction. The window 4043 is provided at a middle part of the door 4004, and is so formed as to allow the user to look into the cooker body 4002.

Figure 41:
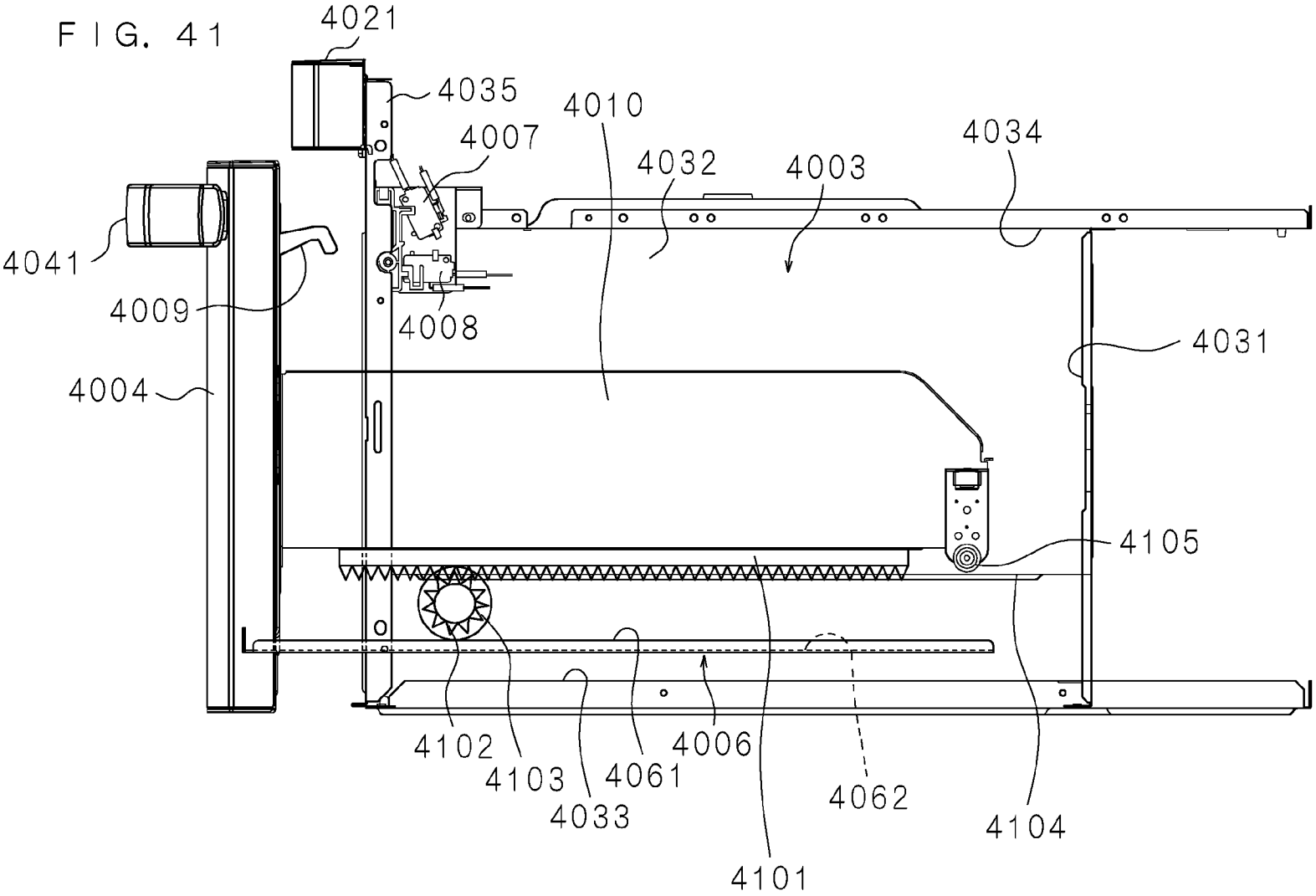
FIG. 41 is a side section view schematically illustrating a side section of a heating chamber formed inside a cooker body.

FIG. 41 is a side section view schematically illustrating a side section of a heating chamber 4003 formed inside the cooker body 4002.

The heating chamber 4003 is formed by a bottom wall 4033, an upper wall 4034, a rear wall 4031 and a pair of side walls 4032, 4032 that are provided while maintaining the appropriate distance from the respective inner walls of the cooker body 4002. A magnetron, a waveguide, a high-pressure transformer, a high-pressure capacitor, a cooling fan and the like (not illustrated) that are used for heat cooking are provided between each wall of the heating chamber 4003 and each inner wall of the cooker body 4002.

Each of slide parts 4006 provided at the lower parts between the side walls 4032, 4032 of the heating chamber 4003 and the inner walls of the cooker body 4002 has a fixed rail 4061 and a movable rail 4062. The movable rails 4062, 4062 have the shape of plates and are attached to the lower parts at the sides on the back surface of the door 4004. The fixed rails 4061, 4061 also have the shape of plates and are attached to the cooker body 4002 side. The movable rail 4062 is fitted into the fixed rail 4061, and is supported by the fixed rail 4061 to be slidable in the front-back direction.

The storage 4010 being in contact with the back side of the door 4004 is formed by two side plates, a back plate and a bottom plate, while a placement table (not illustrated) on which the object to be cooked is placed is arranged on the bottom plate.

At the middle part of the lower surface of the bottom plate of the storage 4010, a rack gear (moving mechanism) 4101 is located with its longitudinal direction aligned with the front-back direction, while a pinion gear (moving mechanism) 4102 is pivotally supported by the cooker body 4002, thereby forming a rack and pinion structure.

The pinion gear 4102 is connected with a motor 4103 fixed to the cooker body 4002 side, and the storage 4010 automatically moves back and forth as the user operates the open/close operation keys 4042. The motor 4103 is, for example, a stepping motor which is capable of controlling the position of rotation. The storage 4010 may be moved back and forth also manually by the handle 4041. In the case where the motor 4103 is a stepping motor capable of controlling the position of rotation, the sensors 4007, 4008 (described later) for detecting whether the door 4004 is closed may be eliminated.

To accommodate the area where the rack gear 4101 moves back and forth, side rails 4104, 4104 are fixed to the side walls 4032, 4032 of the heating chamber 4003, while a pair of caster wheels 4105, 4105 are provided at both sides at the rear end of the storage 4010. The caster wheels 4105, 4105 travel on the respective side rails 4104, 4104 in accordance with the movement of the rack gear 4101, to move the storage 4010 in a substantially horizontal direction.

In the case where the user operates the open/close operation key 4042, or grips the handle 4041 of the door 4004 to pull it toward the user, the movable rails 4062 slide in the fixed rails 4061 to the front side, the rack gear 4101 moves to the front side, and the storage 4010 is pulled out. In the case where the user further operates the open/close operation key 4042, or where the user pushes the handle 4041 away from the user, the movable rails 4062 slide in the fixed rails 4061 to the back side, the rack gear 4101 is moved to the back side, the storage 4010 is put into the heating chamber 4003, and the door 4004 closes the opening of the cooker body 4002.

A control sensor (second detector) 4007 and a close confirmation sensor (detector) 4008 for detecting that the door 4004 is closed is provided at the upper end of a support frame 4035 on the opening side at one side wall 4032 of the heating chamber 4003, while an arm 4009 for turning on the control sensor 4007 and the close confirmation sensor 4008 protrudes from the back surface of the door 4004.

Figure 42:
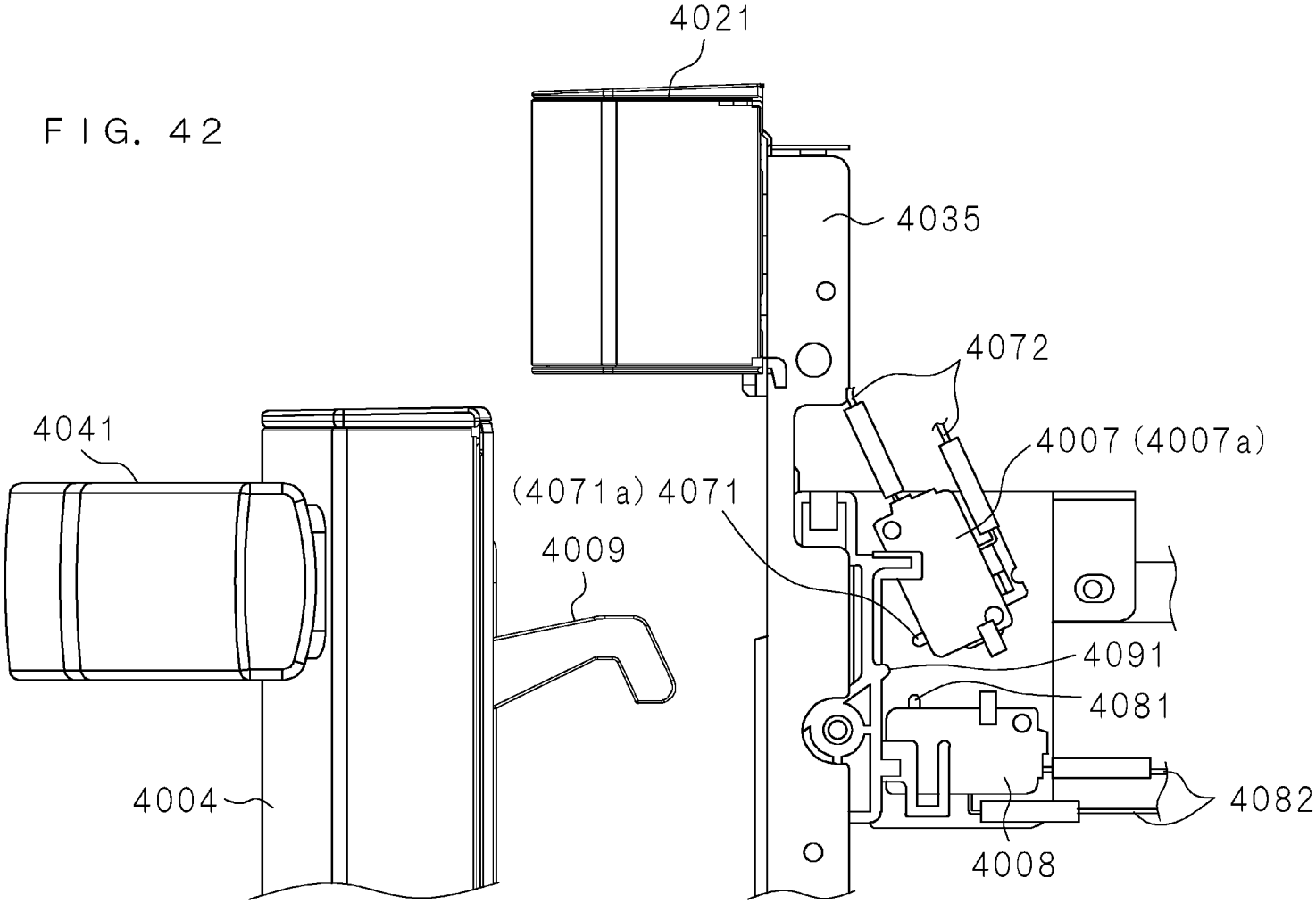
FIG. 42 is a side section view schematically illustrating the enlarged side section of a control sensor, a close confirmation sensor and an arm.

FIG. 42 is a side section view schematically illustrating the enlarged side section of the control sensor 4007, close confirmation sensor 4008 and arm 4009. The control sensor 4007 and the close confirmation sensor 4008 are micro-switches, which transmit ON signals to an open/close control unit 4011, which will be described later, through a pair of lead wires 4072, 4072 and a pair of lead wires 4082, 4082, respectively.

In the arm 4009, a latch part is formed by the leading end bending downward, and a protruding part 4091 is provided at the support frame 4035 for the latch part to be latched thereto.

Figure 43A:
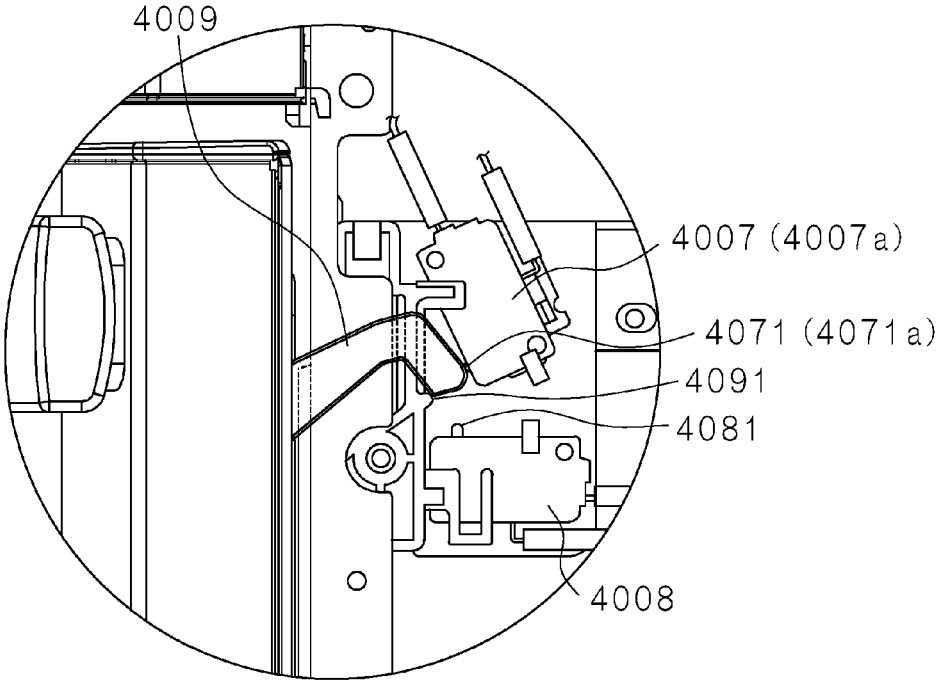
FIG. 43A schematically illustrates the motion of the control sensor, close confirmation sensor and arm.

When the door 4004 is closed and the arm 4009 is flexed so that the latch part goes over the protruding part 4091 as illustrated in FIG. 43A, the latch part of the arm 4009 presses with its back the actuator 4071 of the control sensor 4007 (ON).

Figure 43B:
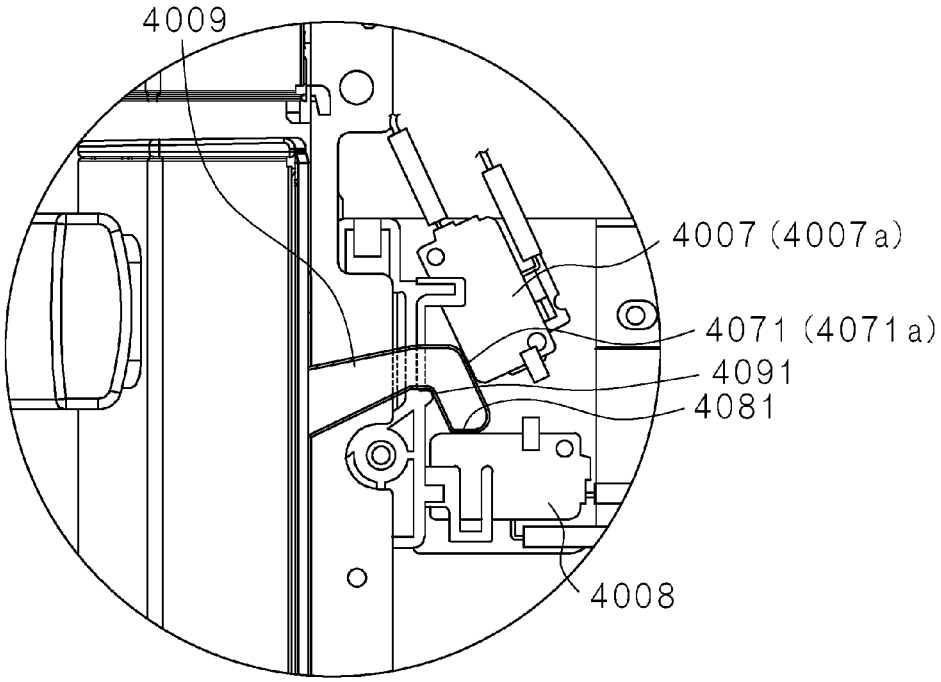
FIG. 43B schematically illustrates the motion of the control sensor, close confirmation sensor and arm.

If the door 4004 further travels in the closing direction, as illustrated in FIG. 43B, the arm 4009 resolves the flexure and the latch part of the arm 4009 presses, with its leading end, the actuator 4081 of the close confirmation sensor 4008 (ON) while keep pressing the actuator 4071.

The close confirmation sensor 4008 detects that the door 4004 is completely closed, whereas the control sensor 4007 is configured to detect the position closer to the user by a predetermined length than the position at which the door 4004 is completely closed.

Figure 44:
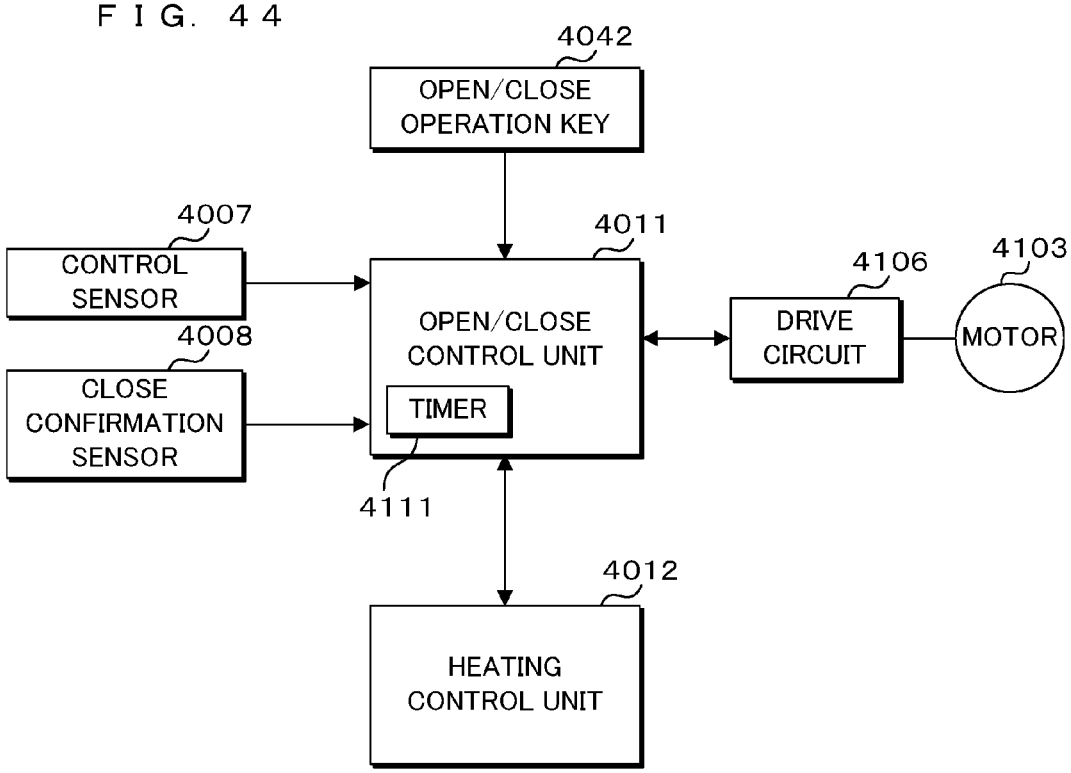
FIG. 44 is a block diagram illustrating an example of a structure for controlling the opening and closing of a door.

FIG. 44 is a block diagram illustrating an example of a structure for controlling the opening and closing of the door 4004.

This microwave 4001 comprises a control sensor 4007, a close confirmation sensor 4008, an open/close control unit 4011, an open/close operation key 4042, a drive circuit 4106 and a motor 4103.

The open/close control unit 4011 has a microcomputer as well as a timer 4111, and is supplied with operation signals from the open/close operation key 4042 and ON signals from the control sensor 4007 and the close confirmation sensor 4008, to drive control the motor 4103 by the drive circuit 4106 based on the supplied signals.

The open/close control unit 4011 transmits the supplied ON signal from the close confirmation sensor 4008 to a heating control unit 4012. The heating control unit 4012 has a microcomputer, and actuates a magnetron only when the ON signal from the close confirmation sensor 4008 is being transmitted.

Figure 45:
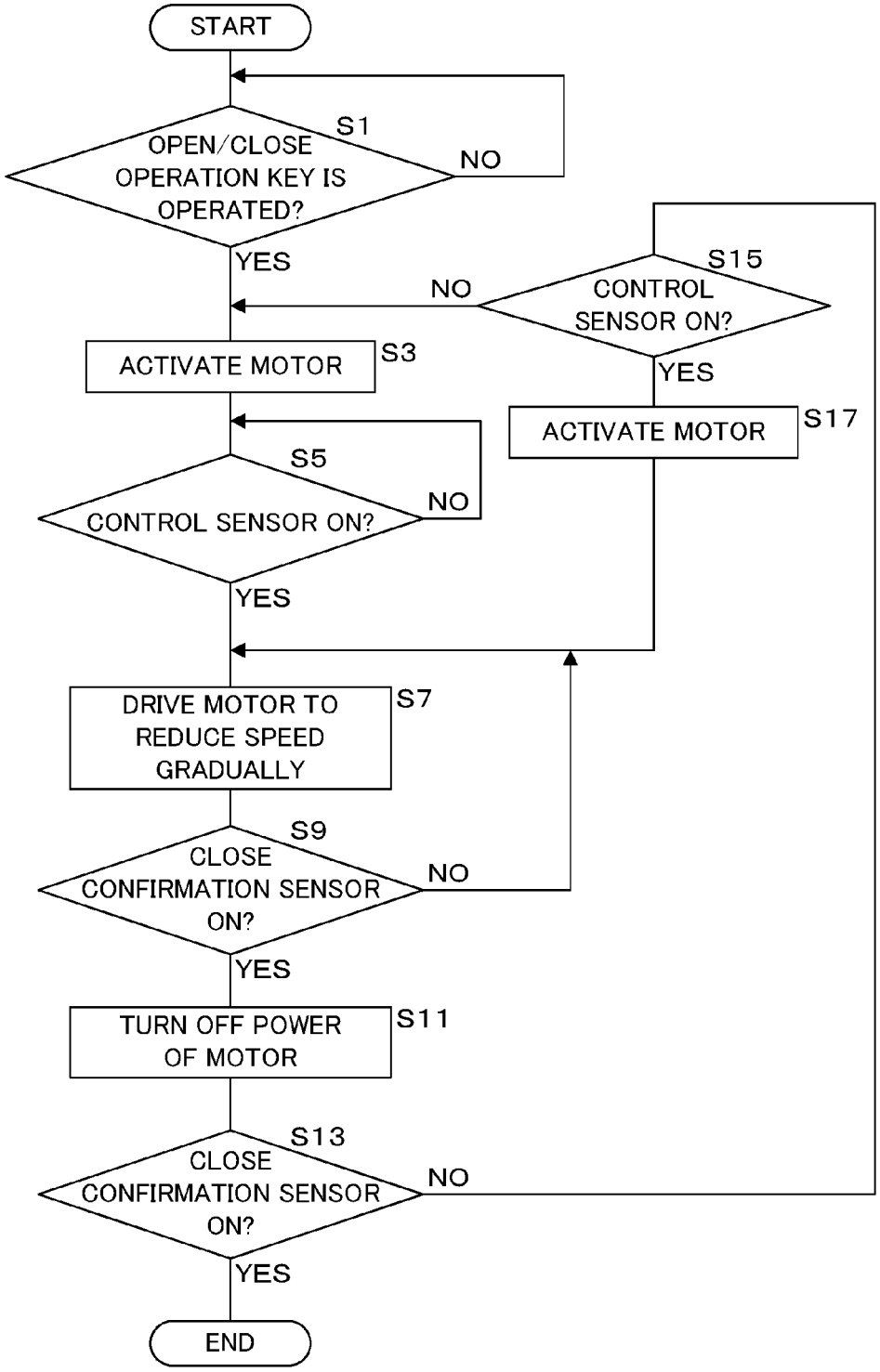
FIG. 45 is a flowchart illustrating the opening/closing operation of the door of a microwave according to an embodiment of the present invention.

The opening/closing operation of the door 4004 of the microwave 4001 configured as described above will be described below with reference to the flowchart in FIG. 45 illustrating the same.

If the open/close operation key 4042 is operated while the door 4004 is in the open state (S1), the open/close control unit 4011 activates the motor 4103 by the drive circuit 4106 in the direction of closing the door 4004 (S3).

If the ON signal is applied from the control sensor 4007 while the motor 4103 is being driven in the direction of closing the door 4004 (S5), the open/close control unit 4011 drives the motor 4103 by the drive circuit 4106 while gradually reducing the speed thereof (S7). Here, for example, the speed of the motor 4103 is gradually reduced at a degree corresponding to the speed of an oil damper being contracted as it absorbs an impact.

If the ON signal is applied from the close confirmation sensor 4008 (S9) while the motor 4103 is being driven as it gradually decreases its speed (S7), the open/close control unit 4011 turns off to stop the power of the motor 4103 (S11). Subsequently, the open/close control unit 4011 checks if an additional ON signal is applied from the close confirmation sensor 4008 (S13), and terminates the processing if the ON signal is applied.

If the ON signal is not applied (S13), the open/close control unit 4011 determines whether or not the ON signal is applied from the control sensor 4007 (S15).

If the ON signal is not applied from the control sensor 4007 (S15), the open/close control unit 4011 activates the motor 4103 by the drive circuit 4106 in the direction of closing the door 4004 (S3).

If the ON signal is applied from the control sensor 4007 (S15), the open/close control unit 4011 activates the motor 4103 by the drive circuit 4106 in the direction of closing the door 4004 (S17), and drives the motor 4103 while gradually reducing the speed thereof (S7).

Embodiment 15

It is noted that the outer appearance of the microwave 4001 according to Embodiment 15 is similar to that in the perspective view (FIG. 40) illustrating the outer appearance according to Embodiment 14. Other configuration parts are also similar to those described in Embodiment 14 (FIG. 44) and will not be described here.

As the ON signal is applied from the control sensor 4007 (S15), the open/close control unit 4011 drives the motor 4103 while gradually reducing the speed thereof, which however may not be able to press the actuator 4081 of the close confirmation sensor 4008 because the latch part of the arm 4009 cannot go over the protruding part 4091. In this case, however, the storage 4010 is substantially in the fully opened state, so that no large impact is caused even if the motor 4103 is driven until the ON signal is applied from the close confirmation sensor 4008.

Thus, if the close confirmation sensor 4008 does not detect that the door 4004 is closed by the time when the timer 4111 measures that a predetermined time has elapsed since the drive circuit 4106 started to drive the motor 4103 while gradually reducing the speed thereof, the open/close control unit 4011 controls to drive the motor 4103 in the direction of closing the door 4004 from that position while not reducing the speed associated with the ON signal by the control sensor 4007.

Embodiment 16

Figure 46:
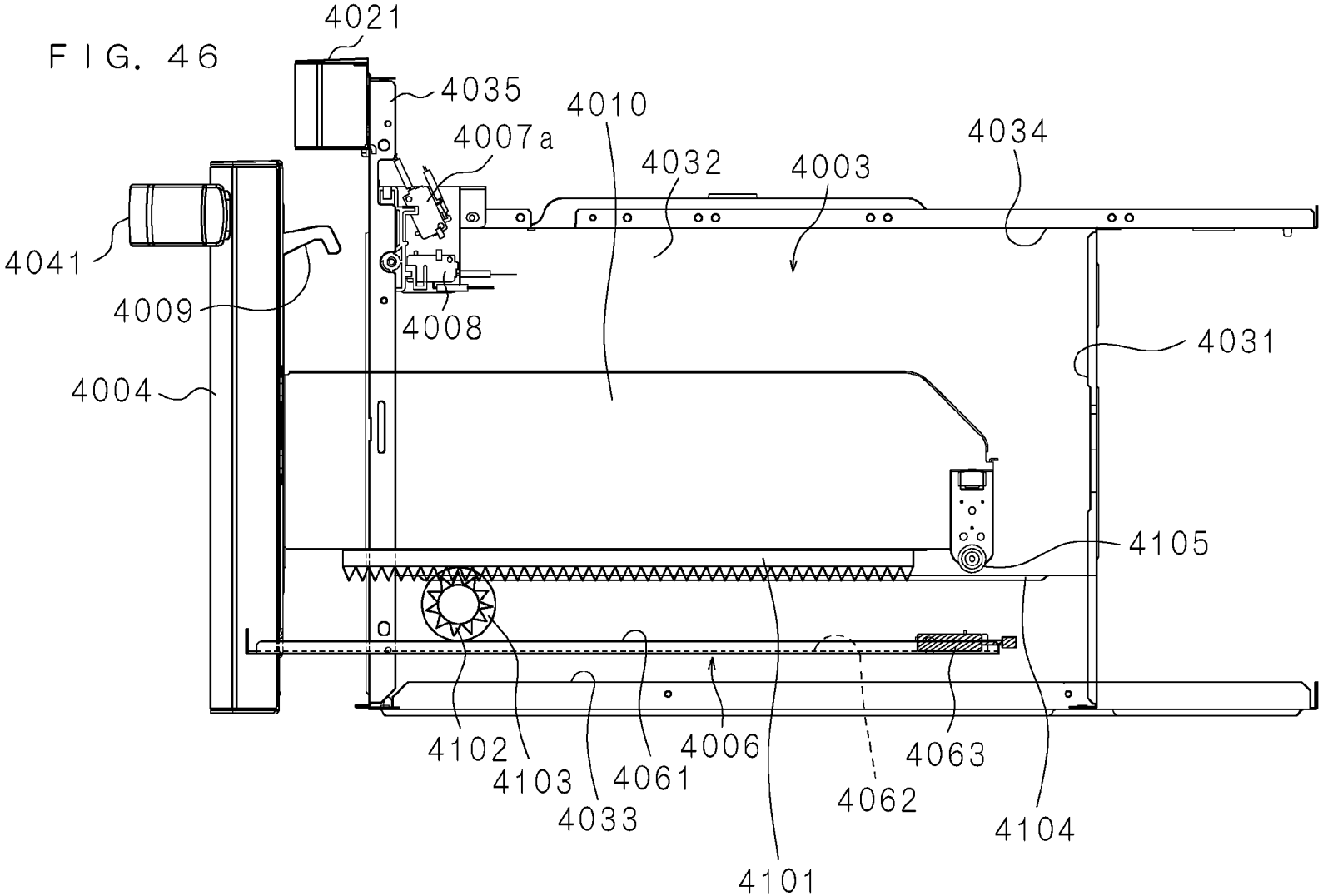
FIG. 46 is a side section view schematically illustrating a side section of a heating chamber formed inside a cooker body of the heating cooker according to Embodiment 16 of the present invention.

FIG. 46 is a side section view schematically illustrating a side section of a heating chamber 4003 formed inside a cooker body of a heating cooker according to Embodiment 16 of the present invention.

In this microwave, each slide part 4006 includes a fixed rail 4061 and a movable rail 4062. The movable rail 4062 is fitted into the fixed rail 4061, and is supported by the fixed rail 4061 to be slidable in the front-back direction. At the leading end of each movable rail 4062, oil dampers (dampers) 4063, 4063 are provided, which are configured to collide against the back wall 4031 of the heating chamber 4003 when the door 4004 is closed.

A close sensor (detector) 4007*a* and a close confirmation sensor 4008 for detecting that the door 4004 is closed is provided at the upper end of a support frame 4035 on the opening side of one side wall 4032 of the heating chamber 4003, while an arm 4009 for turning on the close sensor 4007*a* and the close confirmation sensor 4008 protrudes from the back surface of the door 4004. The other configuration parts are similar to those in the side section view (FIG. 41) of the heating chamber 4003 described in Embodiment 14 and to those in the side section views (FIG. 42) of the control sensor 4007 (close sensor 4007*a*), close confirmation sensor 4008 and arm 4009, and therefore will not be described. Moreover, the close sensor 4007*a*, close confirmation sensor 4008 and arm 4009 operate as similarly to those in the illustration described above (FIG. 43) (the actuator 4071 is however replaced by an actuator 4071*a*), and therefore will not be described.

It is noted that the outer appearance of the microwave 4001 according to Embodiment 16 is similar to that in the perspective view (FIG. 40) illustrating the outer appearance thereof according to Embodiment 14, and therefore will not be described.

Figure 47:
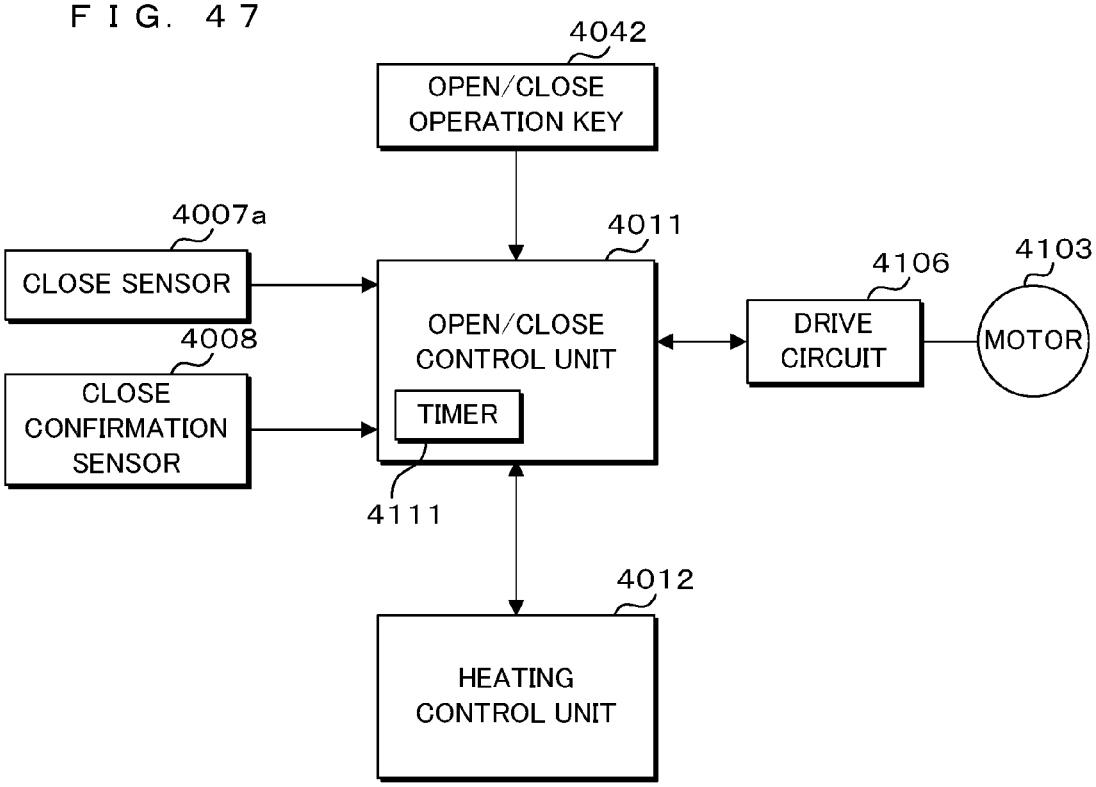
FIG. 47 is a block diagram illustrating an example of a structure for controlling the opening and closing of a door.

FIG. 47 is a block diagram illustrating an example of a structure for controlling the opening and closing of the door 4004.

This microwave 4001 comprises, for controlling the opening/closing of the door 4004, the close sensor 4007*a*, close confirmation sensor 4008, open/close control unit 4011, open/close operation key 4042, drive circuit 4106 and motor 4103. These configuration parts are similar to those described in Embodiment 14 (FIG. 44) (the control sensor 4007 is however replaced by the close sensor 4007*a*) and will not be described here.

Figure 48:
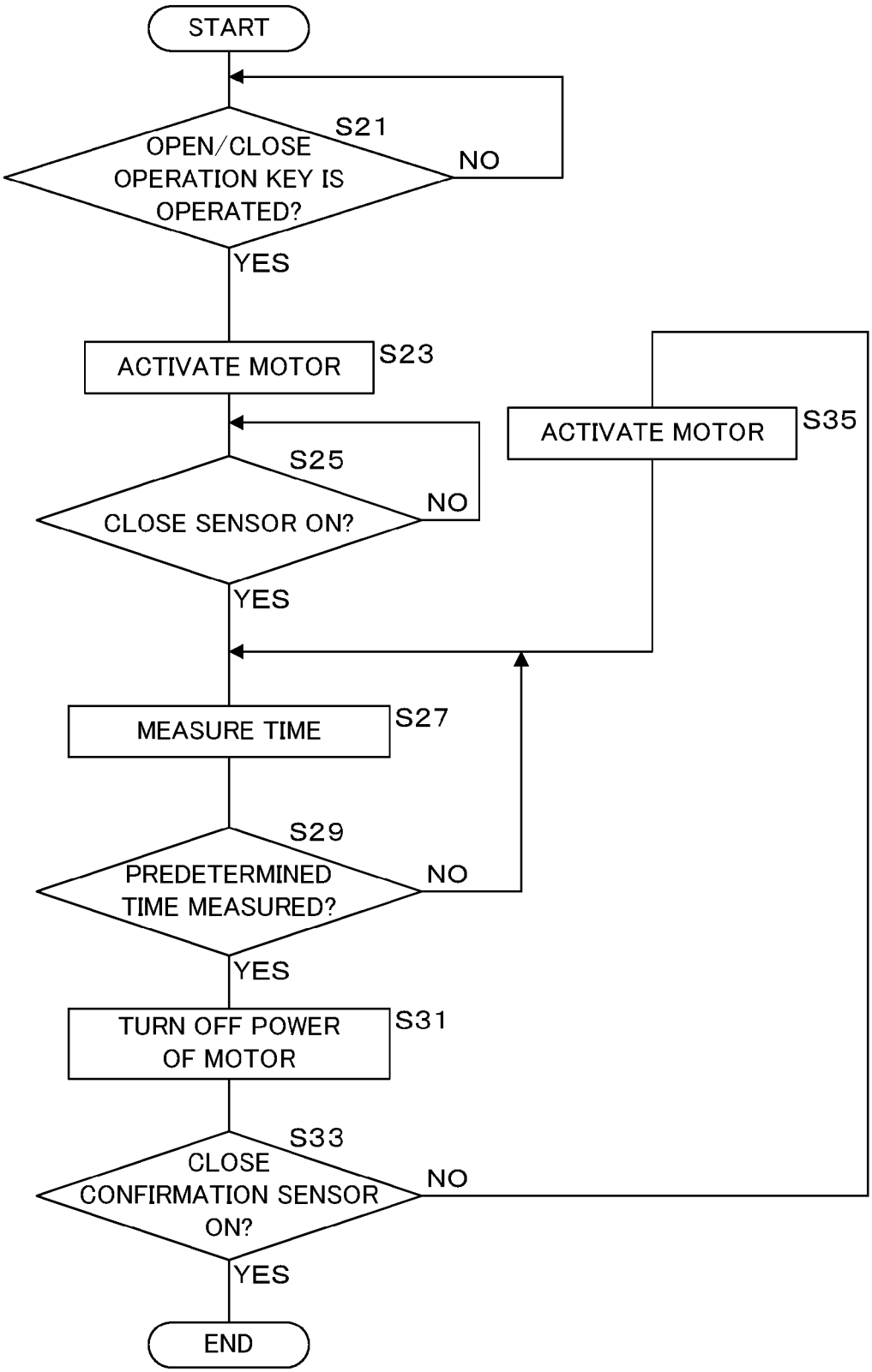
FIG. 48 is a flowchart illustrating the opening/closing operation of the door of a microwave according to an embodiment of the present invention.

The opening/closing operation of the door 4004 of the microwave 4001 configured as described above will be described below with reference to the flowchart in FIG. 48 illustrating the same.

If the open/close operation key 4042 is operated while the door is in the open state (S21), the open/close control unit 4011 activates the motor 4103 by the drive circuit 4106 in the direction of closing the door 4004 (S23).

If the ON signal is applied from the close sensor 4007*a* while the motor 4103 is being driven in the direction of closing the door 4004 (S25), the open/close control unit 4011 starts measuring time by the timer 4111 (S27) and keeps driving the motor 4103 by the drive circuit 4106 until the timer 4111 measures a predetermined time (S29). It is configured that the close sensor 4007*a* is turned on at the time point when the oil dampers 4063, 4063 collide against the back wall 4031 of the heating chamber 4003 and the oil dampers 4063, 4063 start being effective.

As the timer 4111 measures the predetermined time (S29), the open/close control unit 4011 turns off the power of the motor 4103 to stop it (S31).

Subsequently, the open/close control unit 4011 determines whether or not the ON signal is applied from the close confirmation sensor 4008 (S33), and terminates the processing if the ON signal is applied.

If the ON signal is not applied (S33), the open/close control unit 4011 activates the motor 4103 by the drive circuit 4106 in the direction of closing the door 4004 (S35), and drives the motor 4103 until a predetermined time is measured (S29).

The heating cooker (4001) according to an embodiment of the present disclosure comprising a cooker body (4002) with a box-like shape including a heating chamber having an opening at the front side (4002), a door (4004) for opening/closing the opening, a storage (4010) formed continuous to the door (4004) to store an object to be cooked, moving mechanisms (4101, 4102) moving the storage (4010) to the front and back sides, a motor (4103) driving the moving mechanism (4101, 4102), and a detector (4008) detecting that the door (4004) is closed, the heating cooker (4001) being configured to stop the motor (4013) if the detector (4008) detects that the door (4004) is closed, further comprises: a second detector (4007) detecting the state where the door (4004) is positioned closer to the front side by a predetermined length than the position where the door (4004) is closed, and a drive circuit (4016) driving the motor (4103) while gradually reducing the speed thereof if the moving mechanism (4101, 4012) moves the storage (4010) to the back side and the second detector (4007) detects the above-described state.

In the heating cooker, if the second detector detects the state where the door is located at a position closer to the front side by a predetermined length than the position where the door is closed in the case where the moving mechanism moves the storage to the back side, the drive circuit gradually reduces the speed of the motor which drives the moving mechanism. This can realize a drawer-type heating cooker which can completely close the door without any impact and can reliably start the heating operation even if the ambient temperature is low and even without the use of an oil damper.

The heating cooker (4001) according to an embodiment of the present disclosure is configured to, after the drive circuit (4106) drives the motor (4103) while gradually reducing the speed thereof, repeat the moving operation of the storage (4010) to the back side and driving of the drive circuit (4106) while gradually reducing the speed thereof, until the detector (4008) detects that the door (4004) is closed.

In the heating cooker, after the drive circuit drives the motor while gradually reducing the speed thereof, the moving operation of the storage to the back side and the driving of the drive circuit while gradually reducing the speed thereof are repeated until the detector detects that the door is closed. This can realize a drawer-type heating cooker which can completely close the door without any impact and can reliably start the heating operation even if the ambient temperature is low and even without the use of an oil damper.

In the heating cooker (4001) according to an embodiment of the present disclosure, if the detector (4008) does not detect that the door (4004) is closed after a predetermined time has elapsed since the drive circuit (4106) starts driving the motor (4103) while gradually reducing the speed thereof, the driving while reducing the speed of the motor (4103) according to the detection result by the second detector (4007) is not carried out and the storage (4010) is moved to the back side by the drive circuit (4106) until the detector (4008) detects that the door (4004) is closed.

In this heating cooker, if the detector does not detect that the door is closed after a predetermined time has elapsed since the drive circuit starts driving the motor while gradually reducing the speed thereof, the driving while reducing the speed of the motor according to the detection result by the second detector is not carried out and the storage is moved to the back side by the drive circuit until the detector detects that the door is closed. This can realize a drawer-type heating cooker which can completely close the door without any impact and can reliably start the heating operation even if the ambient temperature is low and even without the use of an oil damper.

The heating cooker (4001) according to an embodiment of the present disclosure comprising a cooker body (4002) with a box-like shape including a heating chamber (4003) having an opening at the front side, a door (4004) opening/closing the opening, a storage (4010) formed continuous to the door (4004) to store an object to be cooked, moving mechanism (4101, 4102) moving the storage (4010) to the front and back sides, a motor (4103) driving the moving mechanism (4101, 4102), a damper (4063) absorbing an impact caused when the moving mechanism (4101, 4102) moves the storage (4010) to the back side to close the door (4004), and a detector (4007*a*) detecting that the door (4004) is closed, the heating cooker (4001) being configured to stop the motor (4013) if the detector (4007*a*) detects that the door (4004) is closed, further comprises: a drive circuit (4016) further driving the motor (4103) for a predetermined time so as to move the door (4004) to the back side if the moving mechanism (4101, 4012) moves the storage (4010) to the back side and the detector (4007*a*) detects that the door (4004) is closed.

In this heating cooker, if the detector detects that the door is closed in the case where the moving mechanism moves the storage to the back side, the drive circuit further drives the motor for driving the moving mechanism for a predetermined time period so as to further move the door to the back side. This can realize a drawer-type heating chamber which can completely close the door without any impact and can reliably start the heating operation even if the ambient temperature is low and even with the use of an oil damper.

It should be understood that the embodiments disclosed herein are illustrative and non-restrictive in every respect. All changes that fall within metes and bounds of the claims, or equivalence of such metes and bounds thereof are therefore intended to be embraced by the scope of the present inventions.

According to Embodiments 14-16 as described above, the following effects are produced. That is, as the conventional heating cooker, a drawer-type (built-in) microwave is known which is configured to be incorporated into a kitchen table (cooking table) and is configured that a storage, in which an open/close door is integrated into an inner box storing an object to be cooked, and slides from the cooker body as a drawer to put in and take out the object to be cooked to/from the heating chamber. In such a drawer-type microwave, a rack-and-pinion (moving mechanism) driven by the motor is employed to put in or take out the storage in which an object to be cooked is stored to/from the heating chamber, while a large impact is caused when the door is closed after putting the storage into the heating chamber. Thus, an oil damper is provided at the leading end of the rail fixed to the storage side of the slide unit which slidably guides the storage, and the power of the motor is turned off as the oil damper starts to collide against the rear wall of the heating chamber, to absorb the impact due to inertia. Moreover, a sensor is provided which detects that the door is completely closed, and a safety mechanism is provided in which a magnetron is actuated only in the case where the sensor detects that the door is closed. In Japanese Patent Application Laid-Open No. 2010-133634, a drawer-type heating cooker including an open/close door with respect to the heating cooker body, in which the drawer part in which an object to be cooked is placed is arranged so as to be movable inside the cooker body and to be pulled out to the outside the heating chamber. In the drawer-type microwave, however, the oil has higher viscosity if the temperature is low, causing such problems that the door is not completely closed, the sensor does not detect that the door is closed and the magnetron cannot be actuated even if the power of the motor is turned off as the oil damper starts to be effective.

According to Embodiments 14 to 16 as described above, a drawer-type heating cooker may be realized which can completely close the door without any impact and can reliably start the heating operation even if the ambient temperature is low.

It is to be noted that, as used herein and in the appended claims, the singular forms "a", "an", ad "the" include plural referents unless the context clearly dictates otherwise.

It is to be noted that the disclosed embodiment is illustrative and not restrictive in all aspects. The scope of the present invention is defined by the appended claims rather than by the description preceding them, and all changes that fall within metes and bounds of the claims, or equivalence of such metes and bounds thereof are therefore intended to be embraced by the claims.

The invention claimed is:

1. A heating cooker comprising:

a cooker body in a shape of a box having a heating chamber with an opening at a front side;

a storage having a door which opens and closes the opening, and an inner box including two side plates, a bottom plate and a back plate connected to the door, the storage being movable to the front side and storing an object to be cooked;

a hot-air generating unit generating hot air; and an introducing late configured to introduce the hot air into the storage, wherein the hot-air generating unit is located at an outer side of a rear wall of the heating chamber, an outlet port from which the hot air is blown out is located at a position on the rear wall to be higher than the back plate of the storage, one end of the introducing plate is connected to the rear wall of the heating chamber, and another end of the introducing plate is connected to the back plate of the storage.

2. A heating cooker comprising:

a cooker body in a shape of a box having a heating chamber with an opening at a front side;

a storage having a door which opens and closes the opening, and an inner box including two side plates, a bottom plate and a back plate connected to the door, the storage being movable to the front side and storing an object to be cooked; and a hot-air generating unit generating hot air, wherein the hot-air generating unit is located at an outer side of the heating chamber, a first outlet port from which the hot air is blown out is located at a wall surface of the heating chamber, a guide part is located at a position opposed to the outlet port, the guide part guiding the hot air to an outer side of the side plate of the storage, and a second outlet port from which the hot air is blown out is located at the bottom plate of the storage.

3. The heating cooker according to claim 2, wherein the hot-air generating unit is located at an outer side of the top wall of the heating chamber, and the outlet port is provided at the upper wall.

* * * * *